US010682853B2

(12) United States Patent
Kanaris et al.

(10) Patent No.: US 10,682,853 B2
(45) Date of Patent: Jun. 16, 2020

(54) DROPLET DEPOSITION HEAD AND MANIFOLD COMPONENTS THEREFOR

(71) Applicant: Xaar Technology Limited, Cambridge (GB)

(72) Inventors: Athanasios Kanaris, Cambridge (GB); Colin Brook, Cambridge (GB); Alfonso Cameno Salinas, Cambridge (GB); Jesus Garcia Maza, Cambridge (GB); Artur Jedynak, Cambridge (GB)

(73) Assignee: XAAR TECHNOLOGY LIMITED, Cambridge (GB)

( * ) Notice: Subject to any disclaimer, the term of this patent is extended or adjusted under 35 U.S.C. 154(b) by 0 days.

(21) Appl. No.: 16/678,435

(22) Filed: Nov. 8, 2019

(65) Prior Publication Data

US 2020/0070515 A1 Mar. 5, 2020

Related U.S. Application Data

(63) Continuation of application No. 16/081,579, filed as application No. PCT/GB2017/050596 on Mar. 6, 2017, now Pat. No. 10,479,076.

(30) Foreign Application Priority Data

Mar. 4, 2016 (GB) ..... 1603826.7

(51) Int. Cl.
*B41J 2/14* (2006.01)
*B41J 2/175* (2006.01)

(52) U.S. Cl.
CPC ..... *B41J 2/14145* (2013.01); *B41J 2/14233* (2013.01); *B41J 2/175* (2013.01);
(Continued)

(58) Field of Classification Search
CPC . B41J 2/14; B41J 2/17513; B41J 2002/14419
(Continued)

(56) References Cited

U.S. PATENT DOCUMENTS 6,247,782 B1 6/2001 Takata
8,678,549 B2 3/2014 Silverbook et al.
(Continued)

FOREIGN PATENT DOCUMENTS

CN 1048589308 A 8/2015
EP 1 101 615 A1 5/2001
(Continued)

OTHER PUBLICATIONS

International Search Report and Written Opinion dated May 23, 2017, in International Application No. PCT/GB2017/050596 (12 pgs.).
(Continued)

*Primary Examiner* — An H Do
(74) *Attorney, Agent, or Firm* — Finnegan, Henderson, Farabow, Garrett & Dunner LLP

(57) ABSTRACT

A droplet deposition head includes: one or more manifold components, providing one or more fluid inlets, each of which is connectable to a fluid supply system so that the head can receive a corresponding droplet fluid; and two or more arrays of fluid chambers, each chamber being provided with a respective actuating element and a respective nozzle, each actuating element being actuable to eject a droplet of fluid in an ejection direction through the corresponding one of the nozzles, each array extending in an array direction. The head extends, in the ejection direction, from a first end, at which the one or more fluid inlets are located, to a second end, at which the arrays of fluid chambers are located. One or more branched inlet paths are provided within the manifold components over a first portion of their height in the
(Continued)

ejection direction, each of the branched paths being fluidically connected so as to receive fluid at a main branch thereof from a respective one of the fluid inlets, branching at one or more branching points into two or more sub-branches, and culminating in a plurality of end sub-branches, to which fluid is conveyed. A plurality of widening inlet chambers is provided within the manifold components over a second portion of their height in the ejection direction, the width of each widening inlet chamber in the array direction increasing with distance in the ejection direction from a first end to a second end thereof, the first end being fluidically connected so as to receive fluid from one or more of the branched paths and the second end being fluidically connected so as to supply fluid to one or more of the arrays. Each of the branched inlet paths is fluidically connected so as to supply fluid to two or more of the widening inlet chambers. Also provided are manifold components, which include a plurality of layers, for a droplet deposition head.

20 Claims, 21 Drawing Sheets

(52) U.S. Cl.
CPC .. *B41J 2/17513* (2013.01); *B41J 2002/14362* (2013.01); *B41J 2002/14403* (2013.01); *B41J 2002/14419* (2013.01); *B41J 2202/12* (2013.01); *B41J 2202/19* (2013.01); *B41J 2202/20* (2013.01)

(58) Field of Classification Search
USPC ..... 347/20, 40, 44, 54, 63
See application file for complete search history.

(56) References Cited

U.S. PATENT DOCUMENTS

| | | | |
|---|---|---|---|
| 9,102,152 | B2 | 8/2015 | Silverbrook et al. |
| 9,233,545 | B2 | 1/2016 | Kamo |
| 2008/0259115 | A1 | 10/2008 | Yamaguchi et al. |
| 2009/0309917 | A1 | 12/2009 | Inada et al. |
| 2011/0102508 | A1 | 5/2011 | Kim et al. |
| 2013/0201255 | A1 | 8/2013 | Dowell et al. |
| 2014/0043395 | A1 | 2/2014 | Shimizu et al. |
| 2015/0239243 | A1 | 8/2015 | Muraoka et al. |
| 2015/0258791 | A1 | 9/2015 | Togashi |
| 2015/0266292 | A1 | 9/2015 | Yoshida |
| 2015/0267868 | A1 | 9/2015 | Yoshida |

FOREIGN PATENT DOCUMENTS

| | | | |
|---|---|---|---|
| EP | 1 172 214 | A1 | 1/2002 |
| EP | 1 228 876 | A2 | 8/2002 |
| EP | 1 364 790 | A2 | 11/2003 |
| EP | 1 366 904 | A2 | 12/2003 |
| GB | 2520574 | A | 5/2015 |
| JP | H10-86374 | | 4/1998 |
| JP | 2010-149371 | | 7/2010 |
| JP | 2016/016638 | A | 2/2016 |
| WO | WO 2012/074514 | A1 | 6/2012 |
| WO | WO 2015/022833 | A1 | 2/2015 |
| WO | WO 2015/079223 | A2 | 6/2015 |
| WO | WO 2015/147307 | A1 | 10/2015 |

OTHER PUBLICATIONS

First Chinse Office Action, dated Jan. 19, 2020, in Chinese Application No. 201780015158.8 with machine translation (22 pages).
European Examination Report, dated Feb. 28, 2020, in European Application No. 17710038.5 (6 pages).

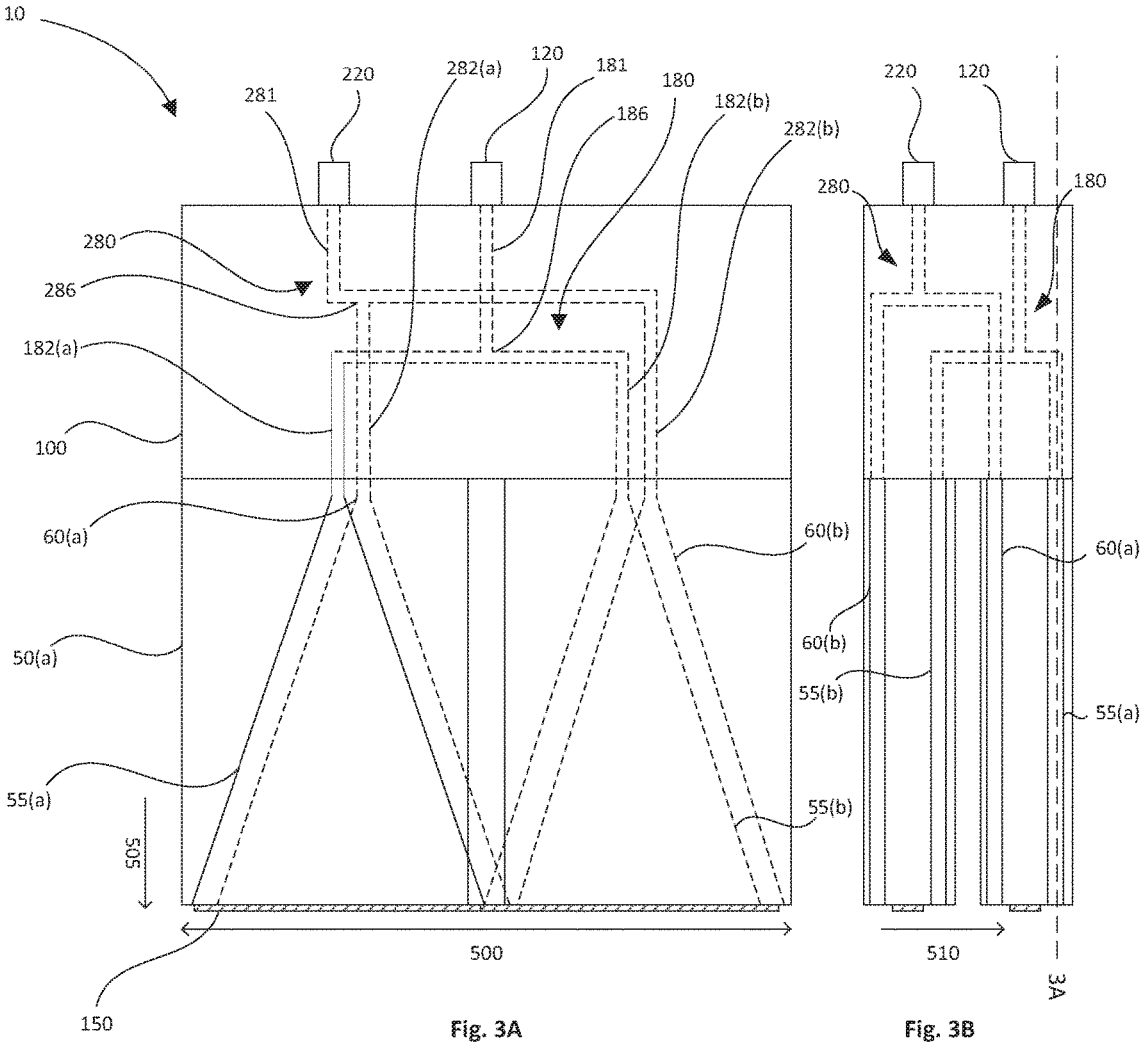
Fig. 3A
Fig. 3B
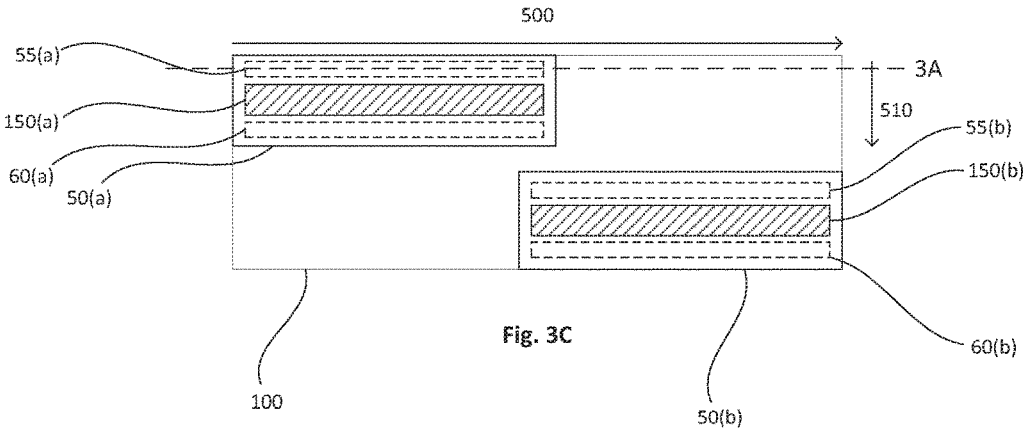
Fig. 3C

DROPLET DEPOSITION HEAD AND MANIFOLD COMPONENTS THEREFOR

This application is a continuation of U.S. application Ser. No. 16/081,579, filed Aug. 31, 2018 (currently pending), which is a National Stage Entry of International Application No. PCT/GB2017/050596, filed Mar. 6, 2017, which is based on and claims the benefit of foreign priority under 35 U.S.C. § 119 to Great Britain Patent Application No. 1603826.7, filed Mar. 4, 2016. The entire contents of the above-referenced applications are expressly incorporated herein by reference.

The present invention relates to a droplet deposition head and to manifold components therefor. It may find particularly beneficial application in a printhead, such as an inkjet printhead, and to manifold components therefor.

Droplet deposition heads are now in widespread usage, whether in more traditional applications, such as inkjet printing, or in 3D printing, or other rapid prototyping techniques. Accordingly, the fluids may have novel chemical properties to adhere to new substrates and increase the functionality of the deposited material.

Recently, inkjet printheads have been developed that are capable of depositing ink directly onto ceramic tiles, with high reliability and throughput. This allows the patterns on the tiles to be customized to a customer's exact specifications, as well as reducing the need for a full range of tiles to be kept in stock.

In other applications, inkjet printheads have been developed that are capable of depositing ink directly on to textiles. As with ceramics applications, this may allow the patterns on the textiles to be customized to a customer's exact specifications, as well as reducing the need for a full range of printed textiles to be kept in stock.

In still other applications, droplet deposition heads may be used to form elements such as colour filters in LCD or OLED displays used in flat-screen television manufacturing.

It will therefore be appreciated that droplet deposition heads continue to evolve and specialise so as to be suitable for new and/or increasingly challenging deposition applications. However, while a great many developments have been made in the field of droplet deposition heads, there remains room for improvements in the field of droplet deposition heads.

SUMMARY

Aspects of the invention are set out in the appended claims.

BRIEF DESCRIPTION OF THE DRAWINGS

The invention will now be described with reference to the drawings, in which:

FIG. 3A is a cross-sectional view of a droplet deposition head according to another embodiment of the invention;

FIG. 3B is an end view of the droplet deposition head shown in FIG. 3A;

FIG. 3C is a side view of the droplet deposition head shown in FIGS. 3A and 3B;

DETAILED DESCRIPTION OF THE DRAWINGS

Figure 1A:
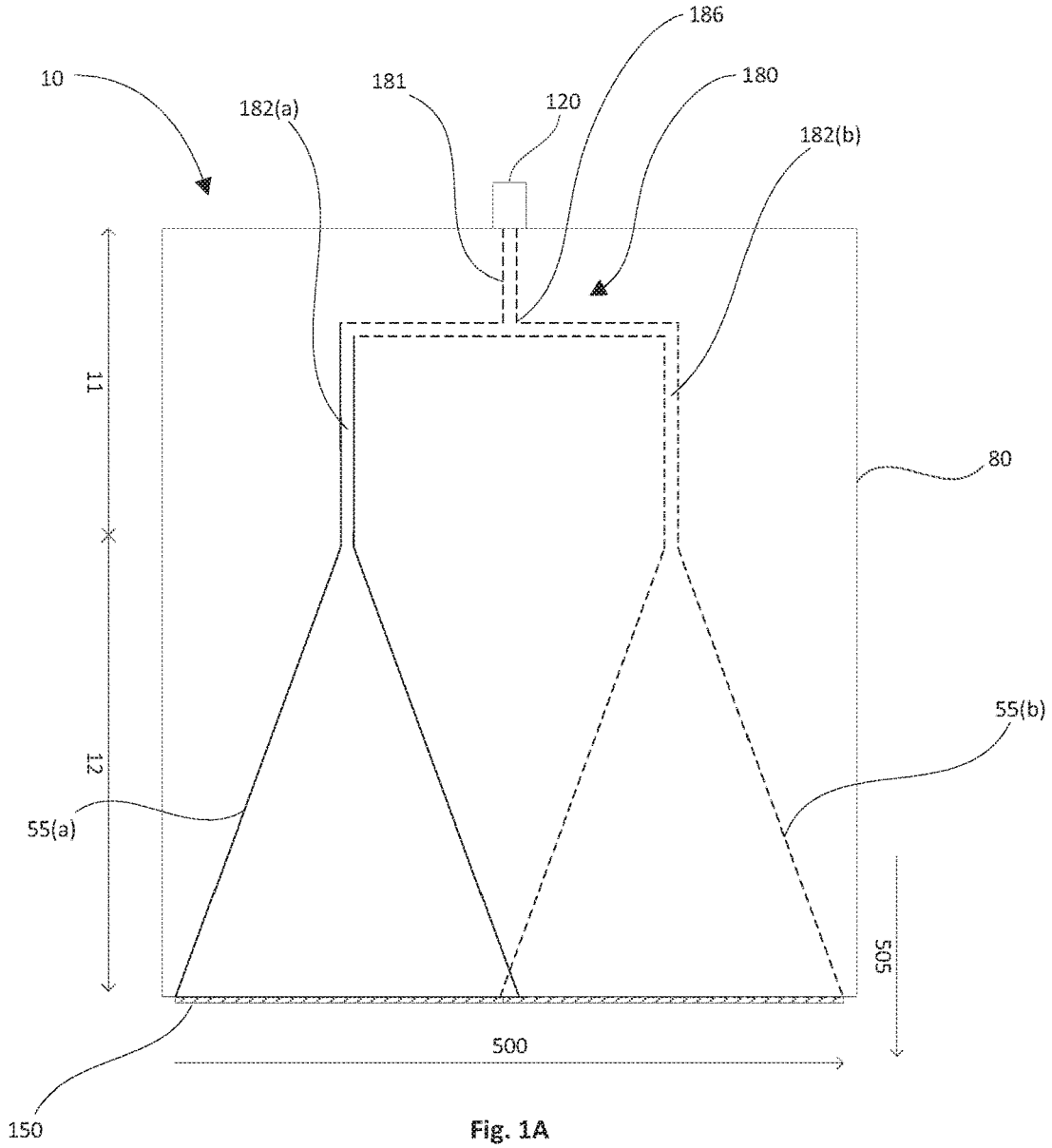
FIG. 1A is a cross-sectional view of a droplet deposition head according to a first embodiment of the invention.

Embodiments of the disclosure in general relate to a droplet deposition head, or a manifold component therefor, that comprises two or more arrays of fluid chambers, where each fluid chamber has a respective actuating element and a respective nozzle.

It should be appreciated that the actuator components that provide such arrays of fluid chambers are typically costly to manufacture, especially if such actuator components are fabricated from silicon, where fewer rectangular die of larger sizes can be extracted from a standard circular wafer. A related factor is that, the greater the number of fluid chambers of an array or the smaller the feature size (for example in high resolution arrays), the greater the likelihood that defects arise during manufacturing. Thus, it may be appropriate to provide more than one array, each with a smaller number of fluid chambers, rather than a single array with a large number of fluid chambers.

In some cases, the effective length of an array that is cost-efficient to produce may be excessively small that, unless multiple such arrays are provided within the same head, the resulting head may be of an impractical size for the user to handle.

Further, where it is desirable to provide a plurality of arrays using a number of separate droplet deposition heads (for instance to enable the heads to collectively address a deposition medium, such as a sheet of paper, ceramic tile, circuit board etc. in a single pass) these heads must be carefully aligned so that the pattern of droplets that the heads produce in combination is in corresponding alignment. Typically, this will require alignment of the heads to a high level of accuracy, for example the alignment error may be a fraction of the nozzle spacing. Thus, where multiple arrays are provided over a large number of heads (for instance, where each head has only one array), alignment of the arrays may be time-consuming, as compared with the situation where a smaller number of heads, each with a relatively larger number of arrays, is provided. For instance, the arrays within each head may be pre-aligned during printhead manufacture, thus reducing the amount of alignment operations that must be carried out later.

However, if multiple arrays are provided within a single droplet deposition head, fluid supply to the chambers of the arrays may be complex. For example, it could be necessary to connect fluid supply pipes to a number of inlet ports in order to supply the chambers within the multiple arrays with fluid that has the appropriate fluidic properties.

In one aspect, the following disclosure describes a droplet deposition head comprising one or more manifold components, providing one or more fluid inlets, each of the fluid inlets being connectable to a fluid supply system so that the head can receive a droplet of fluid.

The droplet deposition head comprises two or more arrays of fluid chambers (which may be spaced in a generally regular manner), each chamber being provided with a respective actuating element and a respective nozzle, each actuating element being actuable to eject a droplet of fluid in an ejection direction through the corresponding one of said nozzles, each array extending in an array direction.

The head extends, in said ejection direction, from a first end, at which said one or more fluid inlets are located, to a second end, at which said arrays of fluid chambers are located. One or more branched inlet paths are provided within the manifold components over a first portion of their height in said ejection direction, each of the branched paths being fluidically connected so as to receive fluid at a main branch thereof from a respective one of said fluid inlets and branching at one or more branching points such that the branched path in question culminates in a plurality of end sub-branches, to which fluid is conveyed.

A plurality of widening inlet chambers are provided within the manifold components over a second portion of their height in said ejection direction, the width of each widening inlet chamber in said array direction increasing with distance in the ejection direction from a first end to a second end thereof, the first end being fluidically connected so as to receive fluid from one or more of said branched paths and the second end being fluidically connected so as to supply fluid to one or more of said arrays. Fluid flowing within each widening inlet chamber may be described as "fanning out" as it approaches the second end of the widening end.

Each of said branched inlet paths is fluidically connected so as to supply fluid to two or more of said widening inlet chambers.

The branched inlet paths and widening chambers as described herein may allow fluid to be supplied to multiple arrays, using only a small number of inlet ports, and in some cases a single inlet port (thus allowing simple connection of the head to a fluid supply system, it being noted that the head may be in position that makes it hard for the user to reach), but to be distributed to the chambers of the arrays with appropriate control of flow characteristics. For instance, fluid may be supplied with substantially balanced pressures, and/or with balanced flow rates and/or with balanced velocities, to each of the fluid chambers of the arrays.

Providing such a construction, including branched paths and widening chambers may, in some arrangements, reduce the size of the head in a direction perpendicular to that in which the arrays extend. This may assist in achieving a desired level of accuracy in droplet placement on the deposition medium, since maintaining the medium in a desired spatial relationship with respect to the arrays while the head(s) and the medium are moved relative to each other is typically more complex when the heads are relatively larger in the direction of movement (generally perpendicular to the array direction). This may be particularly important when the deposition medium is curved, such as where printing graphics onto bottles, cans and the like.

Additionally, or instead, such a construction, including branched paths and widening chambers may, in some arrangements, be relatively compact in the ejection direction, which may in turn simplify integration of the head (or, indeed, a number of like heads) into a larger droplet deposition apparatus.

The first portion and second portion may be non-overlapping; for example, the first portion may be spaced apart from the second portion or may be substantially adjacent or contiguous.

In some examples, the array direction may be perpendicular to the ejection direction.

In some examples, all of the end-sub-branches within each branched path may be of the same branching level. Moreover, all of the end sub-branches for all of the branched paths may be of the same branching level.

Additionally or alternatively, each of the inlets extends in a direction parallel to the ejection direction and/or directs fluid in a direction parallel to the ejection direction.

In addition or instead, each of the end sub-branches is fluidically connected so as to supply fluid to a respective one of the widening inlet chambers.

In some examples, there are two or more of the branched inlet paths. In such examples each branched inlet path overlaps with another branched inlet path in the array direction and in a depth direction, which is perpendicular to the array direction and to the ejection direction; preferably wherein the branched inlet paths all overlap in the array direction and the depth direction.

In addition or instead, the footprint of each branched inlet path, viewed from the ejection direction, overlaps with the footprint of another branched inlet path; preferably wherein the footprints, viewed from the ejection direction, of all of the branched inlet paths overlap. Additionally or alternatively, at least one of the branched inlet paths intertwines with another branched inlet path and preferably wherein each branched inlet path intertwines with another branched inlet path. In addition or instead, a sub-branch of one branched inlet path crosses a sub-branch of another branched inlet path, when viewed in the ejection direction and preferably wherein at least one sub-branch of each branched inlet path crosses a sub-branch of another branched inlet path, when viewed in the ejection direction.

In some examples, the plurality of manifold components further provides one or more fluid outlets, each of the fluid outlets being connectable to a fluid supply system so that the head can return a droplet fluid to the fluid supply system; and wherein one or more branched outlet paths are provided within the manifold components over a third portion of their height in the ejection direction, each of the branched outlet paths being fluidically connected so as to supply fluid from a main branch thereof to a respective one of the fluid outlets, branching at one or more branching points into two or more sub-branches, and culminating in a plurality of end sub-branches, from which fluid is conveyed; wherein a plurality of narrowing outlet chambers are provided within the manifold components over a fourth portion of their height in the ejection direction, the width of each narrowing outlet chamber in the array direction decreasing with distance in the ejection direction from a first end to a second end thereof, the first end being fluidically connected so as to receive fluid from a one or more of the arrays and the second end being fluidically connected so as to supply fluid to one or more of the branched paths; wherein each of the branched outlet paths is fluidically connected so as to receive fluid from two or more of the narrowing outlet chambers.

In such examples, the first portion of the height of the manifold components is the same as the third portion and/or the second portion of the height of the manifold components is the same as the fourth portion. In addition or instead, the width, in the array direction, of each of each narrowing outlet chamber at its first end is substantially equal to the width of the array from which it receives fluid.

Additionally or alternatively, the extent of each narrowing outlet chamber in the ejection direction is approximately equal to or greater than its extent in the array direction. In addition or instead, each of the outlets extends in a direction antiparallel to the ejection direction and/or directs fluid in a direction antiparallel to the ejection direction. Additionally or alternatively, the first end of each of the narrowing outlet chambers is fluidically connected so as to receive fluid from a respective one of the arrays. In addition or instead, each of the end sub-branches is fluidically connected so as to receive fluid from a respective one of the narrowing outlet chambers.

In some examples, the one or more manifold components are formed, at least in part, and preferably substantially from a plurality of layers, each of which preferably extends generally normal to the ejection direction. In such examples, the plurality of layers provide, in each of a plurality of planes parallel to the layers, multiple curved fluid paths, and a plurality of fluid paths perpendicular to the layers that fluidically connect together curved paths in different planes; wherein the branched inlet paths and/or the branched outlet paths include the perpendicular paths and the curved paths.

In addition or instead, the perpendicular paths are defined by through-holes within the layers. Additionally or alternatively, N+1 of the curved paths that lie within the same plane meet at a junction, the junction providing a branching point where one of the branched paths branches into N sub-branches. In addition or instead, a first perpendicular path meets a first curved path part-way along its length at a junction, the junction providing a branching point of one of the branched paths. Additionally or alternatively, second and third perpendicular paths meet the first curved path at the ends thereof, preferably wherein the second and third perpendicular paths extend in the opposite direction to the first perpendicular path.

In addition or instead, the droplet deposition head further includes a generally planar filter that extends parallel to the layers, the filter cutting across at least some of the branched paths, preferably wherein the filter is formed of a mesh. Additionally or alternatively, one of the layers provides the filter. In addition or instead, the filter lies in the same plane as one of, or the junction. Additionally or alternatively, the filter lies in the same plane as a plurality of curved paths, so that it divides each of these curved paths along their lengths. In addition or instead, one or more of the thus-divided curved paths each form a part of the main branch of a respective one of the branched paths. Additionally or alternatively, at least some of the thus-divided curved paths each form a part of a sub-branch of a branched path.

In some examples, the one or more manifold components includes at least one upper manifold component and one or more lower manifold components, the branched paths being provided within the upper manifold component, with the widening inlet chambers and, where present, the narrowing outlet chambers, being provided within the lower manifold components. In such examples, the upper manifold component is formed, at least in part, from a plurality of layers, preferably wherein the layers of the upper manifold component extend generally normal to the ejection direction.

In addition or instead, the layers of the upper manifold component provide, in each of a plurality of planes parallel to the layers, multiple curved fluid paths, and a plurality of fluid paths perpendicular to the layers that fluidically connect together curved paths in different planes; wherein the branched inlet paths and/or the branched outlet paths include the perpendicular paths and the curved paths. Additionally or alternatively, the perpendicular paths are defined by through-holes within the layers. In addition or instead, N+1 of the curved paths that lie within the same plane meet at a junction, the junction providing a branching point where one of the branched paths branches into N sub-branches.

In addition or instead, a first perpendicular path meets a first curved path part-way along its length at a junction, the junction providing a branching point of one of the branched paths. Additionally or alternatively, second and third perpendicular paths meet the first curved path at the ends thereof, preferably wherein the second and third perpendicular paths extend in the opposite direction to the first perpendicular path.

Additionally or alternatively, the droplet deposition head further includes a generally planar filter that extends parallel to the layers, the filter cutting across at least some of the branched paths, preferably wherein the filter is formed of a mesh. In addition or instead, one of the layers of the upper manifold component provides the filter. Additionally or alternatively, the filter lies in the same plane as one of, or the, junction.

In addition or instead, the filter lies in the same plane as a plurality of curved paths, so that it divides each of these curved paths along their lengths. Additionally or alternatively, one or more of the thus-divided curved paths each forms a part of the main branch of a respective one of the branched paths. In addition or instead, at least some of the thus-divided curved paths each forms a part of a sub-branch of a branched path Additionally or alternatively, each lower manifold component provides fluidic connection to arrays from two or more of the groups of arrays. In addition or instead, each array in the first group that corresponds to a lower manifold component is aligned in the array direction with a respective array in the second group that corresponds to the same lower manifold component. Additionally or alternatively, each lower manifold component provides fluidic connection to at least two arrays from each of the groups of arrays.

In addition or instead, arrays that correspond to the same lower manifold component and to the same group are offset relative to one another in the array direction such that their nozzles are interspersed with respect to the array direction. Additionally or alternatively, for each lower manifold component, pairs of the corresponding arrays from the same group are provided side-by-side and are both fluidically connected to the same widening inlet chamber or the same narrowing outlet chamber, preferably wherein, when viewed from the ejection direction, the arrays within each pair are disposed on either side of the shared widening inlet or narrowing outlet chamber. Additionally or alternatively, at least one of the narrowing outlet chambers for each lower manifold component is provided adjacent an outer surface of that lower manifold component.

Additionally or alternatively, a driver IC is provided on the outer surface.

In addition or instead, each lower manifold component is formed, at least in part, from a plurality of layers. Additionally or alternatively, the layers the lower manifold components each extend generally normal to the ejection direction. In addition or instead, the layers of the lower manifold components each extend generally normal to a depth direction, which is perpendicular to the array direction and the ejection direction.

Additionally or alternatively, the lower manifold components overlap in the array direction.

In addition or instead, the upper manifold component(s) is/are connected to the lower manifold components with a plurality of flexible connectors, each of which providing a fluid path therethrough; wherein the flexible connectors reduce the transfer of mechanical stress from the upper manifold to the lower manifold.

Manufacturing a manifold component within which there is a branched path, as described herein, and which is compact in the ejection direction is challenging.

According to a further aspect of the present disclosure there is provided a manifold component for a droplet deposition head, includes a plurality of layers, each of which extends generally normal to a first direction; wherein the plurality of layers provide, in each of a plurality of planes parallel to the layers, multiple curved fluid paths, and a plurality of fluid paths perpendicular to the layers that fluidically connect together curved paths in different planes; wherein the perpendicular paths and the curved paths provide one or more branched fluid paths within the manifold component, each of the branched paths: having a main branch; branching at one or more branching points into two or more sub-branches; and culminating in a plurality of end sub-branches.

Some examples of such manifold components may be straightforward to manufacture while also being compact in the ejection direction and/or allowing for relatively complex branched-path structures to be provided.

Furthermore, manufacturing a manifold component within which there are widening inlet chambers, as described herein, with suitable accuracy to provide desired fluidic properties over the whole of an array of fluid chambers is challenging.

According to a further aspect of the present disclosure there is provided a manifold component for a droplet deposition head, includes: a plurality of layers, each of which extends generally normal to an ejection direction; at least one fluid inlet located at a first end of the manifold component with respect to the ejection direction; wherein the manifold component provides, at a second end of the manifold component with respect to the ejection direction, the second end being opposite to the first end, a mount for receiving an actuator component that provides at least one array of fluid chambers, each chamber being provided with a respective actuating element and a respective nozzle, each actuating element being actuable to eject a droplet of fluid in the ejection direction through the corresponding one of the nozzles, each array extending in an array direction; wherein at least one widening inlet chamber is provided within the manifold component, the width of each widening inlet chamber in the array direction increasing with distance in the ejection direction from a first end to a second end thereof, the first end being fluidically connected so as to receive fluid from one or more of the fluid inlets and the second end providing a fluid connection at the mount, so as to supply fluid to one or more of the arrays.

Some examples of such manifold components may be may be straightforward to manufacture while affording sufficient accuracy that desired fluidic properties over the whole of an array of fluid chambers may be achieved.

It should be appreciated that, depending on the application, a variety of fluids may be deposited by a droplet deposition head. For instance, a droplet deposition head may eject droplets of ink that may travel to a sheet of paper or card, or to other receiving media, such as ceramic tiles or shaped articles (e.g. cans, bottles etc.), to form an image, as is the case in inkjet printing applications (where the droplet deposition head may be an inkjet printhead or, more particularly, a drop-on-demand inkjet printhead).

Alternatively, droplets of fluid may be used to build structures, for example electrically active fluids may be deposited onto receiving media such as a circuit board so as to enable prototyping of electrical devices.

In another example, polymer containing fluids or molten polymer may be deposited in successive layers so as to produce a prototype model of an object (as in 3D printing).

In still other applications, droplet deposition heads might be adapted to deposit droplets of solution containing biological or chemical material onto a receiving medium such as a microarray.

Droplet deposition heads suitable for such alternative fluids may be generally similar in construction to printheads, with some adaptations made to handle the specific fluid in question.

Droplet deposition heads as described in the following disclosure may be drop-on-demand droplet deposition heads. In such heads, the pattern of droplets ejected varies in dependence upon the input data provided to the head.

Figure 1B:
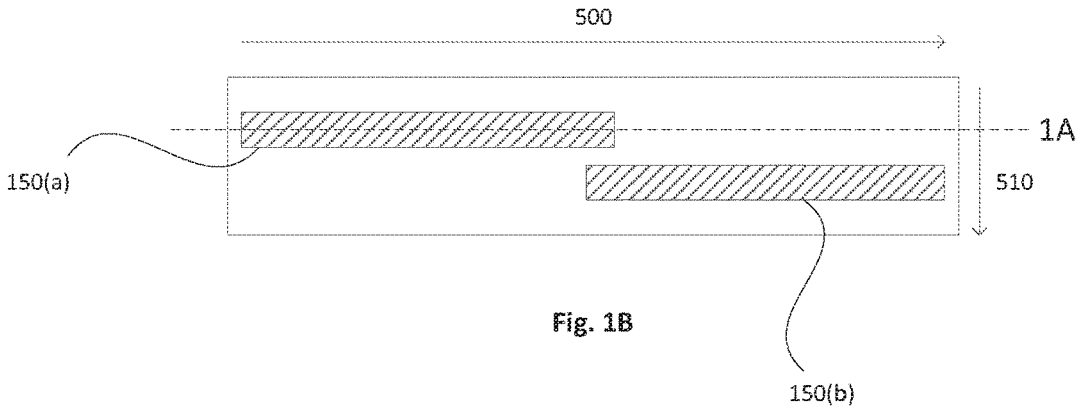
FIG. 1B is an end view of the droplet deposition head shown in FIG. 1A.
Figure 1C:
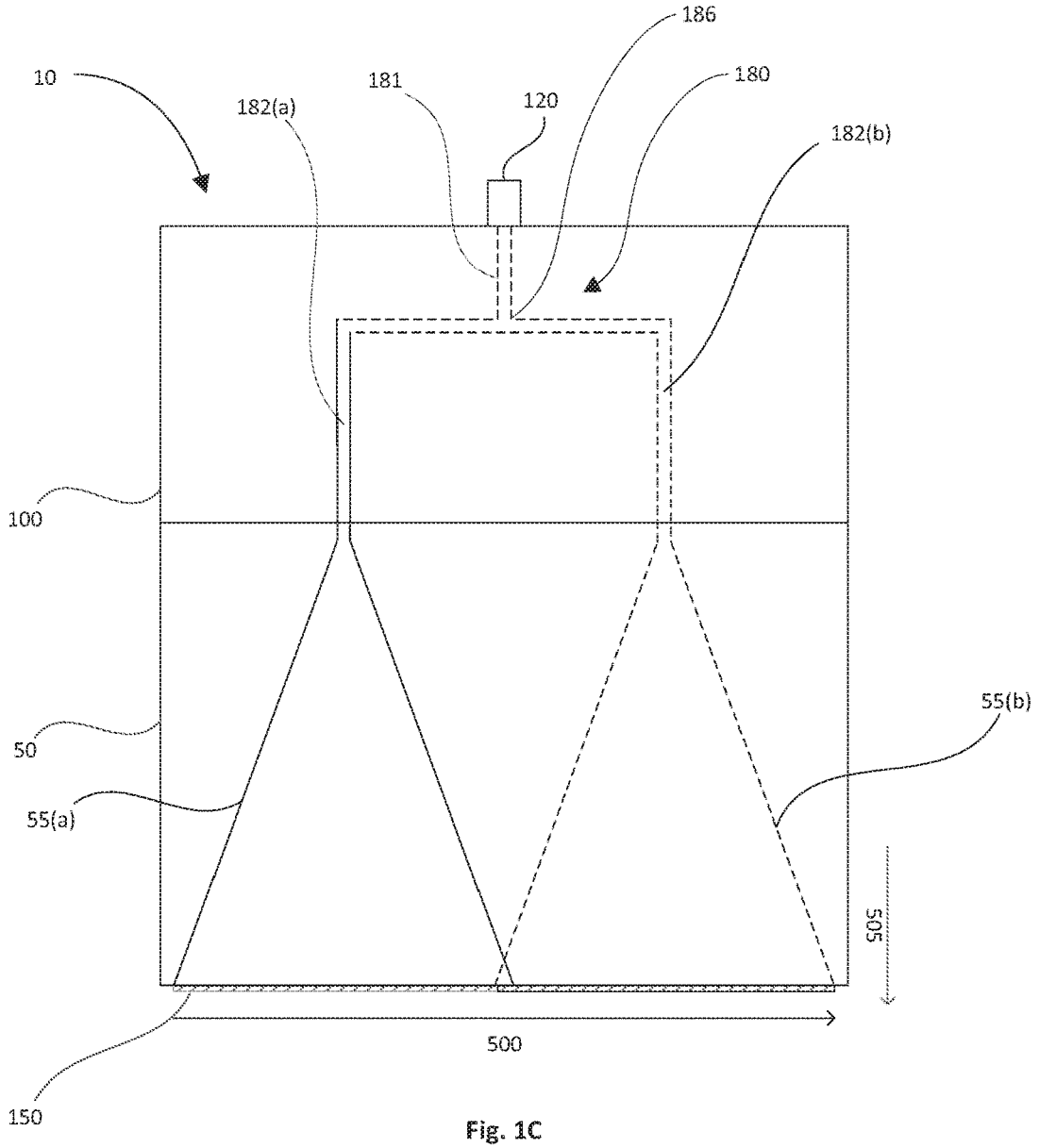
FIG. 1C is a cross-sectional view of a droplet deposition head according to another embodiment of the invention.
Figure 1D:
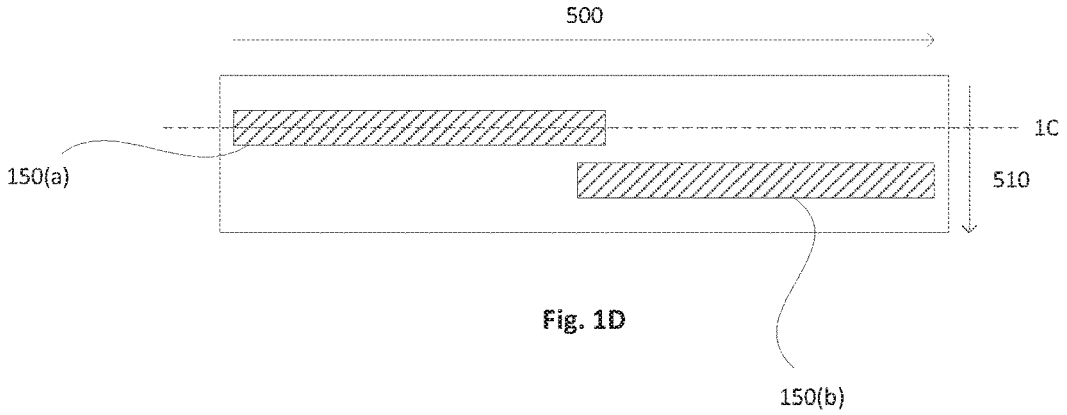
FIG. 1D is an end view of the droplet deposition head shown in FIG. 1C.

Turning now to FIGS. 1A to 1D, the example embodiment shown relates in general to a droplet deposition head 10 comprising one or more manifold components, for instance in the arrangement of FIGS. 1C and 1D, an upper manifold component 100 and a lower manifold component 50. The droplet deposition head 10 may comprise, at an end of one of the manifold components, two or more arrays 150 of fluid chambers together with corresponding actuating elements and nozzles for ejecting fluid in an ejection direction.

As will be discussed in greater detail below, the manifold components comprise one or more branched inlet paths 180 that branch into at least two corresponding sub-branches 182(*a*), 182(*b*) over a first portion of the height 11 of the droplet deposition head 10 in the ejection direction 505. The one or more branched inlet paths 180 are provided, for instance, within the upper manifold component 10. The manifold components also provide a plurality of widening chambers 55. Specifically, these are provided within the manifold components over a second portion of their height 12 in the ejection direction 505. The plurality of widening chambers 55 may, for instance, be provided within the lower manifold component 50. Each of the sub-branches 182(*a*), (*b*) may be fluidically coupled to a respective widening chamber 55.

As noted above, the branched paths and widening chambers not only allow fluid to be supplied to the droplet deposition head via using only a small number of inlet ports, and in some cases a single inlet port, but also allow fluid to be distributed, for example at a substantially even pressure and flow rate, to each of the fluid chambers of the array. This may simplify coupling of the droplet deposition head to a fluid supply. Providing such an arrangement of branched paths and widening chambers may enable the droplet deposition head to be relatively compact in the ejection direction, which may in turn simplify integration of the head (or, indeed, a number of like heads) into a larger droplet deposition apparatus.

Additionally, or instead, certain constructions having such branched paths and widening chambers may be compact in a direction perpendicular to the array direction. As noted above, this may assist in achieving a desired level of accuracy in droplet placement on the deposition medium, since maintaining the medium in a desired spatial relationship with respect to the arrays while the head(s) and the medium are moved relative to each other is typically more complex when the heads are relatively larger in the direction of movement (generally perpendicular to the array direction).

In the example embodiment of FIGS. 1A and 1B, which show a cross-sectional view of a droplet deposition head and an end view of a droplet deposition head respectively according to an embodiment of the invention (with the cross-section of FIG. 1A being taken in the plane indicated by line 1A in FIG. 1B), the droplet deposition head 10 extends, in an ejection direction, from a first end, at which a fluid inlet 120 is located, to a second end, at which two arrays 150 of fluid chambers are located. As may be seen, the head 10 further includes a manifold component 80, with the two arrays 150 being mounted at an end of the manifold component 80.

Each of the fluid chambers in the two arrays 150 is provided with a respective actuating element and a respective nozzle. As may be seen from FIG. 1B, each array 150 extends in an array direction 500. The two arrays 150 shown in FIGS. 1A and 1B are spaced apart, one from the other, in a depth direction 510 (which, in the specific arrangement displayed, is substantially perpendicular to the array direction 500 and to the ejection direction 505), allowing the two arrays 150 to overlap in the array direction 500. It will be understood that the corresponding nozzles for the arrays will be similarly arranged.

In the specific construction shown in FIGS. 1A and 1B, each array of fluid chambers is provided by a respective actuator component, which, in the case of a thin-film type droplet deposition head, may be a silicon die stack. An example of such an actuator component is described further below with reference to FIG. 13.

As is also shown in FIG. 1B, the amount of overlap in the array direction 500 is small in comparison to the length of each array 150 in the array direction 500. This overlap may allow the two arrays 150 to collectively address a deposition medium (such as a sheet of paper, ceramic tile, circuit board etc.) in a similar manner to a single array having the overall width of the two arrays, as it is indexed past the head 10, for instance in depth direction 510. The two arrays may, for example, enable the medium to be addressed in a single pass, where their overall width is sufficiently large. In some cases, the overlap region may allow for fine alignment between the two arrays by electronic means, for example by selecting suitable nozzles between the arrays in the overlap region and controlling their droplet ejection properties through their individual drive waveform.

As shown in FIG. 1A, the branched inlet path 180 is fluidically coupled to the fluid inlet 120 and is provided within the manifold component 80 over a first portion 11 of the height of the droplet deposition head 10 in the ejection direction 505. The branched inlet path 180 divides, at a branching point 186, into two sub-branches 182(*a*),(*b*). In the simple branching structure shown in FIG. 1A, which has only one branching point 186, these sub-branches are end sub-branches 182(*a*),(*b*); the branched inlet path 180 culminates in these end sub-branches 182(*a*),(*b*). Each of the end sub-branches 182(*a*),(*b*) is fluidically coupled to the fluid inlet 120 via the main branch 181 of the branched inlet path 180.

As may also be seen from FIG. 1A, two widening inlet chambers 55(*a*), 55(*b*) are provided over a second portion 12 of the height of the droplet deposition head 10 in the ejection direction 505. The width of each widening inlet chamber 55(*a*), 55(*b*) in the array direction 500 increases with distance in the ejection direction 505 from its first end to its second end. In this way, the width of each widening inlet chamber 55 increases as it approaches the arrays 150.

In the specific example shown in FIG. 1A, the width of the widening chamber in the array direction 500 increases at a substantially constant rate with increasing distance in the ejection direction 505. The sides of each widening inlet chamber 55 are substantially straight, when viewed in a depth direction 510 (substantially perpendicular to the array direction 500 and the ejection direction 505).

It should be noted that the sides (with respect to the chamber height in the ejection direction 505) of the widening inlet chamber 55(*a*), 55(*b*) may be shaped in such a way as to assist in providing fluid to the chambers within the corresponding one of the arrays 150 with balanced flow characteristics (for instance with substantially balanced pressures, and/or with balanced flow rates and/or with balanced velocities). Hence (or otherwise), the sides of each widening inlet chamber 55 in some alternative constructions may instead be convex, or concave, when viewed in the depth direction 510 (though such shapes may, depending on the circumstances, be more difficult to manufacture).

More generally, it should be noted that the width of each widening inlet chamber 55 in the array direction 500 may increase with distance in the ejection direction 505 from its first end to its second end in any suitable manner. The increase may, for example, be gradual and/or the width in the array direction may increase substantially monotonically with respect to distance in the ejection direction 505, as is the case in FIG. 1A.

It should be noted that, in the specific droplet deposition head of FIGS. 1A-1D, the depth of each widening inlet chamber 55 does not change significantly over the height of the widening inlet chamber 55; however, in other examples the depth may taper towards the second end of the widening inlet chamber 55, where it is fluidically connected to a corresponding one of the arrays 150. For example, the size of the widening inlet chamber in the depth direction 510 may decrease with increasing distance in the ejection direction 505. The depth and width of the widening inlet chamber might, for example, change in such a way that the cross-sectional area of the widening inlet chamber remains constant for substantially the whole of its height.

As is shown in FIG. 1A, each widening inlet chamber 55 is fluidically connected, at its first end, to a corresponding one of the end sub-branches 182(*a*), 182(*b*) and, at its second end, to a corresponding one of the arrays 150.

Specifically, as may be seen from FIG. 1A, widening inlet chamber 55(*a*) is fluidically connected at its first end to sub-branch 182(*a*) and is fluidically connected at its second end to array 150(*a*), whereas widening inlet chamber 55(*b*) is fluidically connected at its first end to sub-branch 182(*b*) and is fluidically connected at its second end to array 150(*b*).

As may also be seen from FIG. 1A, the width, in the array direction 500, of each of the widening inlet chambers 55 at its second end (that nearmost the arrays 150) is substantially equal to the width of the array 150 to which it supplies fluid. This may assist in evenly distributing fluid over the length of the array 150.

As may also be seen from FIG. 1A, the extent of each widening inlet chamber 55 in the ejection direction 505 is greater than its extent in the array direction 500. This may assist in developing an evenly distributed flow of fluid at the ends of the widening inlet chambers 55 that are connected to the arrays 150. More generally, a similar effect may be experienced where the extent of each widening inlet chamber 55 in the ejection direction 505 is approximately equal to or greater than its extent in the array direction 500.

As may be seen from FIGS. 1A and 1B, the branched inlet path 180 is fluidically connected so as to receive fluid from the fluid inlet 120, which is then conveyed through the branched inlet path 180, until it reaches the end sub-branches 182(*a*), 182(*b*). Each of the end sub-branches 182(*a*), 182(*b*) is then fluidically connected so as to supply fluid to a respective one of the widening inlet chambers 55 at a first end thereof (that furthest from the arrays 150). The second end (that nearmost the arrays 150) of each of said widening inlet chambers 55 is configured to supply fluid to a corresponding array 150.

In some examples, each sub-branch within the branched inlet path 180 is adapted to provide balancing of the flow characteristics for the fluid in the sub-branches, for instance so that the sub-branches have balanced pressures, and/or balanced flow rates and/or balanced velocities.

As is apparent from FIG. 1A, the two widening inlet chambers 55(*a*), 55(*b*) have substantially the same shape. Hence (or otherwise), the widening inlet chambers 55 of the droplet deposition head 10 may be shaped so as to have substantially the same effect on fluid flowing through them.

The fluid inlet 120 is configured to receive fluid from a fluid supply system, which may supply fluid at a positive pressure. The actuating elements of the arrays 150 are configured to be actuable by drive circuitry (not shown), such as ICs (Integrated Circuits) or ASICs (Application-Specific Integrated Circuits), to eject droplets from the nozzles of the chambers that are deposited on a deposition medium.

In use (for example, following the connection of the inlet 120 to a suitable fluid supply system and activation of the fluid supply system), fluid is supplied to the droplet deposition head 10 via the fluid inlet 120 and thereby reaches the branched inlet path 180. The fluid flows down along the branched inlet path 180 and splits from a main branch 181, at branching point 186, into each of two sub-branches 182(*a*), 182(*b*). As noted above, as there is only one branching point in the branched inlet path 180, these sub-branches are end sub-branches 182(*a*), 182(*b*). From each end sub-branch 182(*a*), 182(*b*), the fluid flows into a first end of a corresponding widening inlet chamber 55(*a*), 55(*b*). Each widening inlet chamber 55(*a*), 55(*b*) widens as the fluid flows down, in an ejection direction 505, through the droplet deposition head 10 towards the arrays 150. Because each widening inlet chamber 55 widens, the fluid is spread out and distributed over the length of each array 150 at the second end of each widening inlet chamber 55. As discussed above, each widening inlet chamber 55 may be shaped such that fluid is distributed to the chambers within the corresponding one of the arrays 150 with balanced flow characteristics (for example, with balanced pressures, and/or with balanced flow rates and/or with balanced velocities for the chambers of the arrays).

Thus, the combination of the branched inlet path 180 and widening inlet chambers 55 may supply fluid from a single fluid inlet port 120 to the chambers of a number of arrays 150 with balanced flow characteristics.

In some examples, as shown in FIGS. 1C and 1D, which show, respectively, a cross-sectional view and an end view of a modified version of the droplet deposition head shown in FIGS. 1A and 1B (with the cross-section of FIG. 1C being taken in the plane indicated by dashed line 1C in FIG. 1D), the droplet deposition head 10 comprises an upper manifold component 100 and a lower manifold component 50.

The lower manifold component 50 is coupled to the upper manifold component 10. The upper manifold component 100 comprises the branched inlet path 180, including the main branch 181, the branching point 186 and the end-sub branches 182(*a*), 182(*b*). The lower manifold component 50 comprises the widening inlet chambers 55.

The upper manifold component 100 may be coupled to the lower manifold component 50 in any suitable manner such as, for example, using adhesive or fixing means, such as a screw or bolt, or via an ultrasonic weld.

Figure 1E:
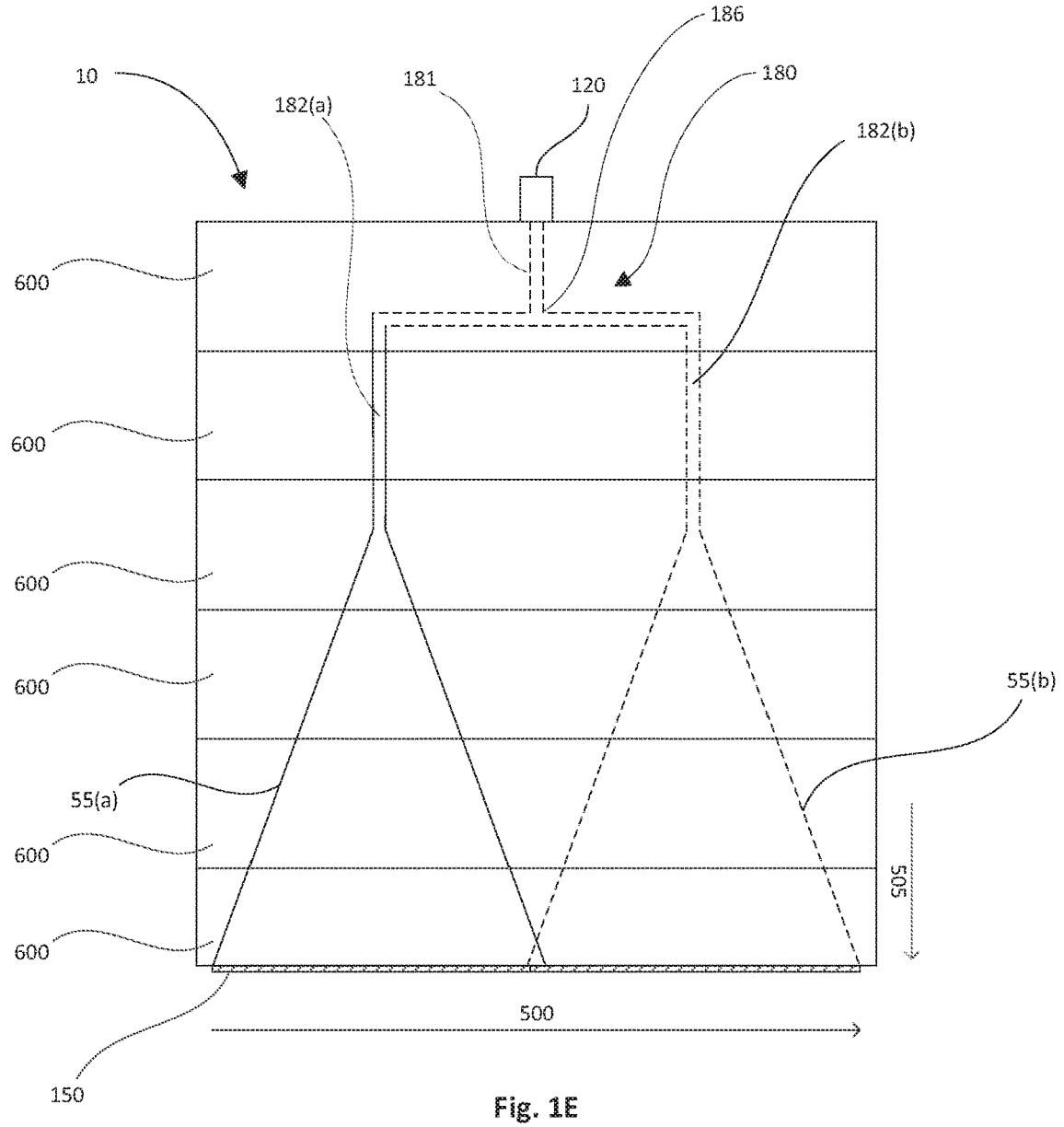
FIG. 1E is a cross-sectional view of a droplet deposition head according to a first embodiment of the invention.
Figure 1F:
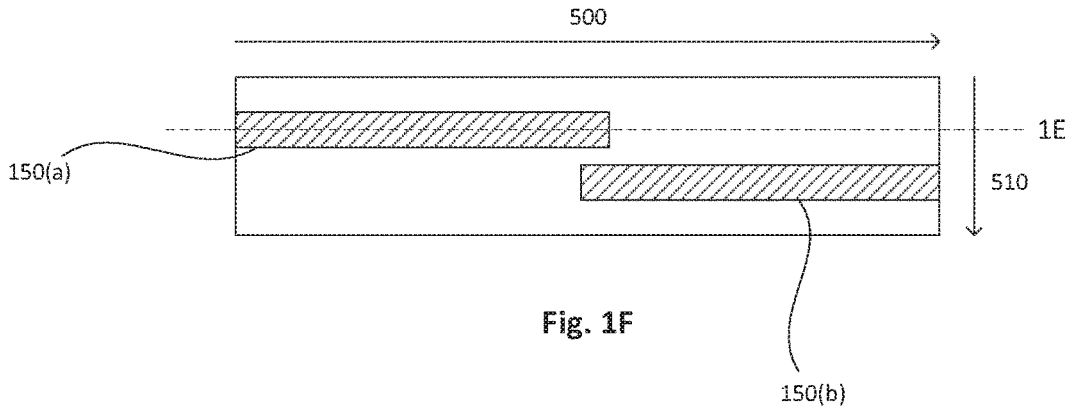
FIG. 1F is an end view of the droplet deposition head shown in FIG. 1E.

In some examples, as illustrated in FIGS. 1E and 1F, which show, respectively, a cross-sectional view and an end view of a modified version of the droplet deposition head of FIGS. 1A and 1B (with the cross-section of FIG. 1E being taken in the plane indicated by 1E in FIG. 1F), the droplet deposition head 10 may be formed, at least in part, from a plurality of layers 600. As may be seen, in the specific example of FIGS. 1E and 1F, each of the layers extends in a plane that is generally normal to the ejection direction 505. The branched inlet paths 180 and the widening inlet chambers 55 are formed by the different layers 600 being stacked upon each other.

While in the specific example shown in FIG. 1C the upper manifold component 100 is illustrated as being attached directly to the lower manifold component 50, the upper manifold component 100 could, for example, be connected to the lower manifold component 50 with a plurality of flexible connectors, each of which providing a fluid path therethrough. An example of such a connection arrangement will be described in more detail below with reference to FIG. 4. Such flexible connectors may reduce the transfer of mechanical stress from the upper manifold 100 to the lower manifold 50. This may be an important consideration, for instance, when a user is connecting the inlet port 120 to a fluid supply or reservoir.

While not shown in FIGS. 1A-1D, a driver IC may be provided on the outer surface of the droplet deposition head 10.

While in the specific examples shown in FIGS. 1A-1D the branched inlet path 180 includes only one branching point 186 and, therefore, only two sub-branches 182(*a*). 182(*b*), it should be appreciated that branched inlet paths 180 could split into more sub-branches 182(*a*),(*b*). This will be demonstrated with reference to the example droplet deposition head 10 shown in FIGS. 2A and 2B, which is in many respects similar to the droplet deposition head 10 shown in FIGS. 1A and 1B.

Figure 2A:
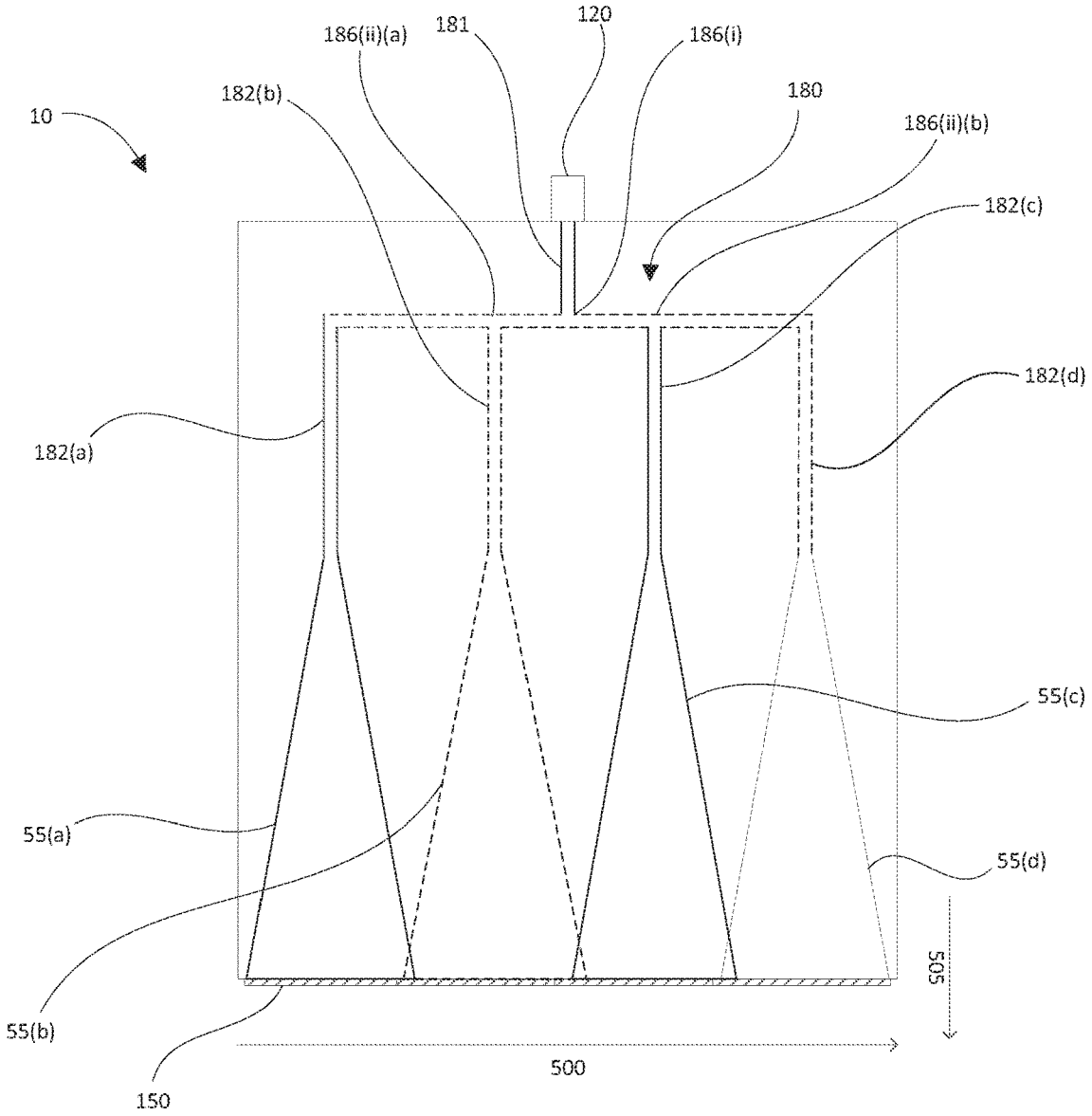
FIG. 2A is a cross-sectional view of a droplet deposition head according to another embodiment of the invention.
Figure 2B:
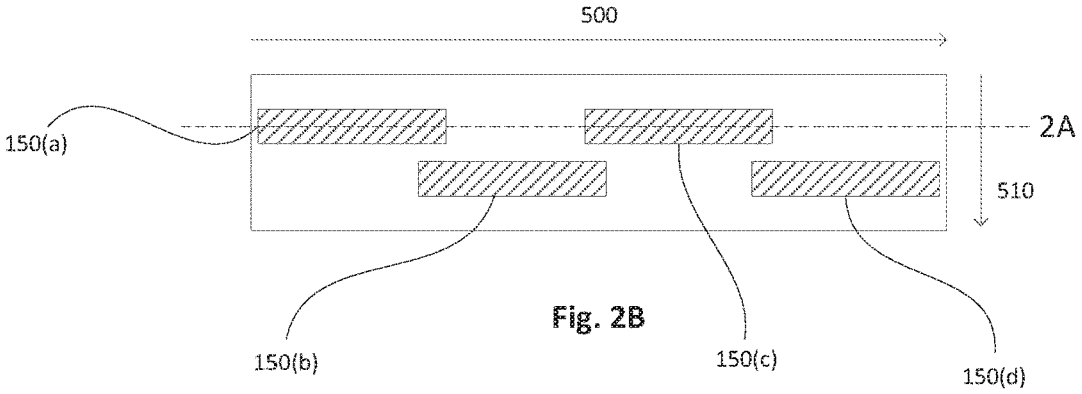
FIG. 2B is an end view of the droplet deposition head shown in FIG. 2A.

In the droplet deposition head 10 shown in FIGS. 2A and 2B, the branched inlet path 180 in the upper manifold 100 splits from a main branch 181 and culminates in four end sub-branches 182(*a*)-(*d*), with each end sub-branch 182(*a*)-(*d*) being fluidically coupled to a respective widening inlet chamber 55.

More specifically, main branch 181 branches at a first-level branching point 186(i) (where the suffix (i) indicates the first level) into two sub-branches, which in turn branch at respective branching points 186(ii)(a), 186(ii)(b) (where the suffix (ii) indicates the second level) into the four end sub-branches 182(*a*)-(*d*).

It should however be noted that, while in the droplet deposition head 10 of FIGS. 2A and 2B, the branched inlet path 180 includes only three branching points 186(i), 186(ii)(a), 186(ii)(b), in other examples, each branched inlet path 180, by having the appropriate number of branching points 186 (and/or by branching into more than two sub-branches 182 at each branching point 186), may culminate in any other number of end sub-branches 182.

It may further be noted that in the droplet deposition head 10 shown in FIGS. 1A-1D and 2A-2B only a single fluid inlet 120 is provided. As a result, only a single type of fluid (e.g. one colour of ink, in the case where the droplet deposition head 10 is configured as an inkjet printhead) is supplied to the arrays 150. However, it should be appreciated that, the droplet deposition head 10 could include a first group of two or more arrays 150 for depositing a first type of droplet fluid and a second group of arrays 150 for depositing a second type of droplet fluid. The different types of droplet fluid may, where the droplet deposition head 10 is configured as an inkjet printhead, correspond to different colours of ink, for instance. Accordingly, more than two such groups may be provided; for example, four groups of arrays could be provided, one for each of the four process colours (cyan, magenta, yellow and black). Where the head is configured for use with several different types of droplet fluid, the fluid paths may be arranged such that the different types of fluid are separated from each other within the head.

In such examples, each type of droplet fluid may be received from a respective fluid inlet 120. Similarly to the arrays shown in FIGS. 1B and 2B, adjacent arrays 150 within the same group may be spaced apart in a depth direction 510 so as to allow them to overlap in the array direction 500, for example by a relatively small amount in comparison with the length of the array. In addition, each of the arrays 150 in a first group may be aligned in the array direction 500 with a respective one of the arrays 150 in a second group. Examples of such an arrangement will be described further below with reference to FIGS. 6B and 11; the examples shown in FIGS. 1A-1F and 2A-B include only one group of arrays. In this way, as the deposition medium is indexed past the droplet deposition heads, each portion of the width (in the array direction 500) of the deposition medium is addressed by an array from every group.

In some examples, for each lower manifold component 50, pairs of arrays 150 from the same group (and therefore receiving the same type of fluid) may be provided side-by-side, with both of the arrays within the pair being fluidically connected to the same widening inlet chamber 55. Thus, when viewed from the ejection direction 505 (for instance as shown in FIGS. 1B and 2C), the arrays 150 within each such pair of arrays may be disposed on either side of the shared widening inlet 55. The widening inlet 55 may thus appear to divide or separate the arrays 150 when viewed from the ejection direction 505 (though it should be noted that it may not necessarily physically separate the pair of arrays 150, especially where the pair of arrays 150 is provided by a single actuator component, and may thus be offset from the pair of arrays in the ejection direction 505).

Attention is now directed to FIGS. 3A, 3B and 3C, which show, respectively, a cross-sectional view, a side view and an end view of a droplet deposition head 10 according to another embodiment of the invention (with the cross-section of FIG. 3A being taken in the plane indicated by dashed line 3A in FIGS. 3B and 3C). As may be seen, the droplet deposition head 10 of FIGS. 3A-3C comprises an upper manifold component 100 and a plurality of lower manifold components 50, in this example two lower manifold components 50.

As may be seen from FIGS. 3A and 3B, the manifold components provide a fluid outlet 220, in addition to a fluid inlet 120. Thus, the droplet deposition head 10 of FIGS. 3A, 3B and 3C may be considered an example of a head where the plurality of manifold components 100, 50 provides one or more fluid outlets.

As will be appreciated from the drawings, the example droplet deposition head 10 shown in FIGS. 3A, 3B and 3C has a similar branched fluid inlet path structure 180 to that described above in relation to FIGS. 1A, 1B, 2A and 2B, but additionally has a branched fluid outlet path structure 280 for returning fluid to the fluid supply system. This may enable recirculation of fluid through the head, for example by establishing a continuous flow of fluid through the head during use. More particularly, there may be established a continuous flow of fluid through each of the chambers in the arrays. This flow may, depending on the configuration of the fluid supply system (e.g. the fluid pressures applied at the fluid inlet 120 and fluid outlet 220), continue even during droplet ejection, albeit potentially at a lower flow rate.

As shown in FIGS. 3A, 3B and 3C, the fluid outlet 220 is located at the same end of the droplet deposition head 10 as the fluid inlet 120 (specifically, the end furthest from the arrays 150 in the droplet ejection direction 505).

In the example shown in FIG. 3A, two branched outlet end sub-branches 282(*a*), 282(*b*) are provided within the upper manifold component 10. Each of the branched outlet end sub-branches 282(*a*), 282(*b*) is fluidically connected, at a branching point 286, to the main branch 281 of the branched outlet path 280. The main branch 281 is, in turn, coupled to the fluid outlet 220. The plurality of sub-branches 282(*a*), 282(*b*) and the main branch 281 together form a single branched outlet path 280.

Although, during use, fluid will flow from the end sub-branches 282(*a*), 282(*b*) to the main branch 281 to be returned to the fluid outlet 220 (as will be discussed in detail below), the branched outlet path 280 may nonetheless be described, in a topological sense, as "culminating" in the end sub-branches 282(*a*), 282(*b*).

As may be seen from FIGS. 3B and 3C, one widening inlet chamber 55(*a*), 55(*b*) and one narrowing outlet chamber 60(*a*), 60(*b*) is provided within each lower manifold component 50. The width of each narrowing outlet chamber 60(*a*), 60(*b*) in the array direction decreases with distance in a direction opposition to the ejection direction 505 from a first end (that nearmost the arrays 150), which is fluidically coupled to a corresponding fluid array 150, to a second end (that furthest from the arrays 150), which is fluidically coupled to a corresponding one of the end sub-branches 282(*a*), 282(*b*) provided by the branched outlet path 280.

As is apparent from FIG. 3A, the width in the array direction 500 of each of the narrowing outlet chambers 60 at its first end is substantially equal to the width of the array 150 from which it receives fluid. As noted above, this may assist in evenly distributing fluid over the length of each array 150.

As is also apparent from FIG. 3A, the extent of each widening inlet chamber 55 in the ejection direction 505 is greater than its extent in the array direction 500. As also discussed above, this may assist in developing an evenly distributed flow of fluid at the ends of the widening inlet chambers 55 that are connected to the arrays 150.

As illustrated in FIGS. 3A and 3B, the fluid inlet structure overlaps parts of the fluid outlet structure in the array direction 500. For instance, each narrowing outlet chamber 60 overlaps, in an array direction 500 of the droplet deposition head 10, with a widening inlet chamber 55. In addition, the branched inlet path 180 overlaps, in the array direction 500, with the branched outlet path 280. As is apparent from FIG. 3B, the branched outlet path 180 overlaps with the branched inlet path 280 in the head depth direction 510 as well (the depth direction 510 being perpendicular to the array direction 500 and to the ejection direction 505).

Each lower manifold component 50 provides fluidic connection to at least one array of chambers 150.

In the example shown in FIG. 3C, each lower manifold component 50 has mounted thereupon a respective array of chambers 150. As shown in FIG. 3C, one lower manifold component 50(*a*) is spaced apart from the other 50(*b*) in the depth direction 510, while overlapping in the array direction 500. Similarly, the array 150(*a*) of one lower manifold component is spaced apart from the array 150(*b*) of the other lower manifold component 50(*b*) in the depth direction 510, while the arrays 150(*a*), 150(*b*) overlap in the array direction 500. It will be understood that the corresponding nozzles for the arrays will be similarly arranged.

The fluid inlet structure shown in FIGS. 3A, 3B and 3C (which includes branched inlet path 180 and widening inlet chambers 55(*a*), 55(*b*)) connects to a fluid supply system using inlet 120 and thereafter functions in generally the same way as that described above in reference to FIGS. 1A, 1B, 2A and 2B.

The fluid outlet 220 is connectable to a fluid supply system so that the head 10 can return droplet fluid to the fluid supply system. The fluid supply system may, for example, be configured to apply a negative pressure to the fluid outlet 220 so as to draw droplet fluid through the system. In addition, the fluid supply system will typically be configured to apply a positive pressure to the fluid inlet 120 (though, potentially, the negative pressure at the fluid outlet 220 could be used alone in some circumstances).

As may be seen from FIGS. 3A, 3B and 3C, each of the branched outlet end sub-branches 282(*a*), 282(*b*) is configured to receive fluid from a corresponding narrowing outlet chamber 60(*a*), 60(*b*). As is also shown, the first end of each of the narrowing outlet chambers 60(*a*), 60(*b*) (that nearmost the arrays 150) is configured to receive fluid from a respective array 150.

In the specific example shown in FIGS. 3A-3C, the width of the widening inlet chambers 55 in the array direction 500 increases at a substantially constant rate with increasing distance in the ejection direction 505. The sides of each widening inlet chamber 55 are substantially straight, or linear, when viewed in depth direction 510 (which is substantially perpendicular to the array direction 500 and the ejection direction).

It should be noted that the sides (with respect to the chamber height in the ejection direction 505) of the widening inlet chamber 55(*a*), 55(*b*) may be shaped in such a way as to assist in providing fluid to the chambers within the corresponding one of the arrays 150 with balanced flow characteristics (for instance with substantially balanced pressures, and/or with balanced flow rates and/or with balanced velocities). Hence (or otherwise), the sides of each widening inlet chamber 55 in some alternative constructions may instead be convex, or concave, when viewed in the depth direction 510 (though such shapes may, depending on the circumstances, be more difficult to manufacture).

More generally, the width of each widening inlet chamber 55 in the array direction 500 may increase with distance in the ejection direction 505 from its first end to its second end in any suitable manner. The increase may, for example, be gradual and/or the width in the array direction may increase substantially monotonically with respect to distance in the ejection direction 505, as is the case in FIG. 3A.

In the specific example shown in FIGS. 3A-3C, the width, in the array direction 500, of the narrowing outlet chambers 60 decreases at a substantially constant rate with increasing distance in a direction opposition to the ejection direction 505. The sides of each narrowing outlet chamber 60 are substantially straight, or linear, when viewed in depth direction 510 (which is substantially perpendicular to the array direction 500 and the ejection direction).

It should be noted that the sides (with respect to the chamber height in the ejection direction 505) of each narrowing outlet chamber 60(*a*), 60(*b*) may be shaped so as to assist in balancing the flow characteristics of fluid at the arrays 150. For instance, the shape may assist in balancing the pressures and/or flow rates and/or velocities of the fluid in the chambers of the arrays 150. Hence (or otherwise), the sides of each narrowing outlet chamber 60 in some alternative constructions might instead be convex, or concave, when viewed in the depth direction 510 (though such shapes may, depending on the circumstances, be more difficult to manufacture).

More generally, the width, in the array direction 500, of each narrowing outlet chamber 60(*a*), 60(*b*) may decrease with distance in a direction opposition to the ejection direction 505 in any suitable manner. The increase may, for example, be gradual and/or the width in the array direction may increase substantially monotonically with respect to distance in the ejection direction 505, as is the case in FIG. 3A.

In the specific droplet deposition head of FIGS. 3A-3C, the depth of each widening inlet chamber 55 does not change significantly with distance 55 in the ejection direction 505. However, in other examples the depth of each widening inlet chamber 55 may taper towards the second end of the widening inlet chamber 55, where it is fluidically connected to a corresponding one of the arrays 150. For example, the size of the widening inlet chamber in the depth direction 510 may decrease with increasing distance in the ejection direction 505. The depth and width of the widening inlet chamber might, for example, change in such a way that the cross-sectional area of the widening inlet chamber 55 remains constant for substantially the whole of its height in the ejection direction 505.

It will similarly be noted that the depth of each narrowing outlet chamber 60 does not change significantly with distance 55 in the ejection direction 505. However, in other examples the depth of each narrowing outlet chamber 60 may taper towards the first end of the narrowing outlet chamber 60, where it is fluidically connected to a corresponding one of the arrays 150. For example, the size of the narrowing outlet chamber 60 in the depth direction 510 may decrease with increasing distance in the ejection direction 505. The depth and width of the widening inlet chamber might, for example, change in such a way that the cross-sectional area of the narrowing outlet chamber 60 remains constant for substantially the whole of its height in the ejection direction 505.

In use, fluid is supplied to each array 150 of the droplet deposition head 10 in generally the same way as described above in relation to FIGS. 1A, 1B, 2A and 2B.

However, once fluid is supplied to each array 150, and more particularly to the chambers thereof, the fluid may, as part of the recirculation of fluid through the head mentioned above, flow through each of the chambers. For example, where the chambers are elongate, the fluid may flow along their lengths. When the actuating elements of the array 150 are then actuated so as to cause the ejection of droplets through the nozzles of the chambers, some fluid will leave the chambers in the form of droplets. Also as part the of recirculation of fluid through the head, fluid that is not ejected will flow from the chambers into a corresponding narrowing fluid outlet chamber 60(*a*), 60(*b*) in the lower manifold 50. As the fluid flows through the narrowing fluid outlet chamber 60(*a*), 60(*b*), the flow is concentrated in a manner similar to a funnel so that the fluid flows out of the narrowing outlet chamber 60 and into an outlet end sub-branch 282(*a*). 282(*b*). Fluid flows through the outlet sub-branches 282(*a*), 282(*b*) of the branched outlet path 280 in the upper manifold 100 and is combined at a branching point 286, before flowing into and along the main path 281 of the branched outlet path 280. The fluid flows from the main branch 281 of the branched outlet path 280 to the fluid outlet 220, where it may return to the fluid supply system.

While the droplet deposition head 10 of FIGS. 3A-3C has been described as having only one fluid inlet 120 and one fluid outlet 220, it should be appreciated that, particularly where different groups of arrays are provided, several fluid inlets and several fluid outlets could be included. For instance, a respective fluid inlet and a respective fluid outlet could be provided for each of a number of different types of droplet fluid. A respective group of arrays could be provided for each type of droplet fluid. The different types of droplet fluid may, where the droplet deposition head 10 is configured as an inkjet printhead, correspond to different colours of ink, for instance. Where the head is configured for use with several different types of droplet fluid, the fluid paths may be arranged such that the different types of fluid are separated from each other within the head.

It should further be noted that, while the droplet deposition head 10 of FIGS. 3A-3C is illustrated as having only one array for each lower manifold component 50, it is envisaged that each lower manifold component may provide fluidic connection to multiple arrays.

For instance, a widening inlet chamber 55 may be configured to provide fluid to two arrays 150 from the same group. In such examples, the two arrays may share a widening inlet chamber 55 but have a respective narrowing outlet chamber 60, such that there are two narrowing outlet chambers 60 and one widening inlet chamber 55 per two arrays 150 of the same group. Examples of such an arrangement will be described further below with reference to FIGS. 6B and 11; the examples shown in FIGS. 1A-1F and 2A-B include only one group of arrays. Alternatively, the two arrays 150 could each be provided with a respective widening inlet chamber 55 and share a single narrowing outlet chamber 60.

Indeed, in some examples, each lower manifold component 50 may provide fluidic connection to arrays from two or more groups of arrays, with each group corresponding to a specific type of droplet fluid, as discussed above.

In some examples, arrays 150 that correspond to the same lower manifold component 50 and to the same group may be spaced apart from one another in the depth direction 510 and offset from one another in the array direction 500, for example by a small amount, for example, of the order of the nozzle spacing for each array. The offset could, for example be approximately 1/N times the nozzle spacing, where N is the number of arrays within the same group that correspond to the same lower manifold component (or, potentially. M+1/N times the nozzle spacing, where M is an integer). Hence, or otherwise, the nozzles of the N arrays may together provide an array of nozzles with spacing 1/N, when viewed in a depth direction 505, perpendicular to the array direction 500 and the ejection direction 510. The nozzles from the N arrays may accordingly be interleaved with respect to the array direction 500, for example as shown in FIG. 6B, which shows an example where 2 arrays from a first group are interleaved and 2 arrays from a second group are interleaved. Thus, the multiple arrays may provide the printhead with a higher resolution than a single array.

Hence, or otherwise, arrays 150 may overlap in the array direction 500 by an amount less than the distance between pressure chambers, such that their nozzles are interleaved with respect to the array direction 500. Such an arrangement may improve the resolution that can be printed by the droplet deposition head 10.

In some examples, each lower manifold component may provide fluidic connection to arrays from multiple groups. In such cases, the arrays 150 corresponding to different groups (but to the same lower manifold component 50) may be aligned in the array direction 500. In this way, as the deposition medium is indexed past the droplet deposition heads, each portion of its width in the array direction 500 is addressed by an array from each of the two or more groups It is envisaged that at least one of the narrowing outlet chambers 60 for each lower manifold component 50 may be provided adjacent an outer surface of that lower manifold component 50. Such an arrangement may provide cooling to circuitry coupled to the outer surface of the lower manifold component 50 or the droplet deposition head 10 more generally.

It should be noted that, the droplet deposition head shown in FIGS. 3A, 3B and 3C may comprise any of the features described above in relation to FIGS. 1A, 1B, 2A and 2B.

Figure 4:
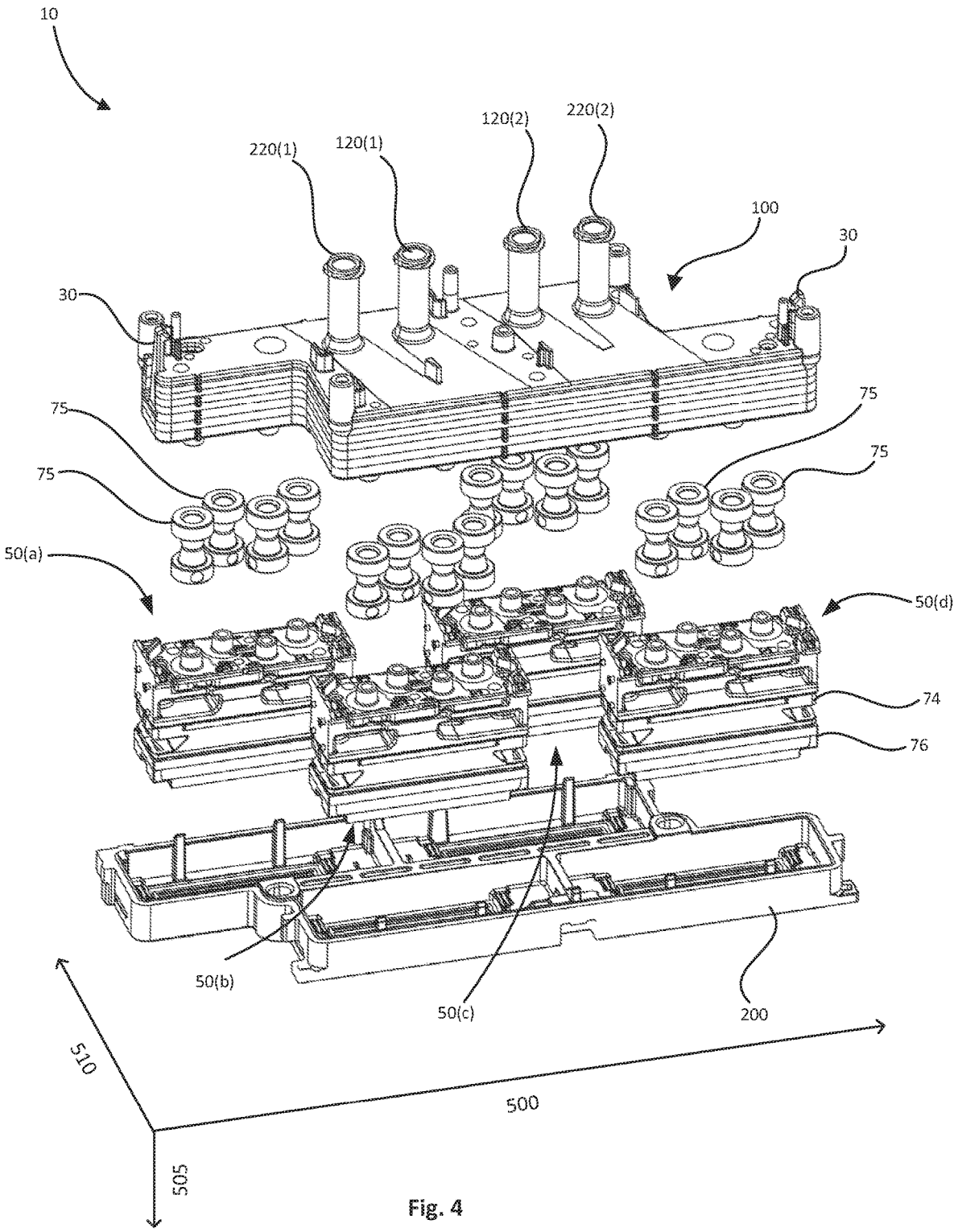
FIG. 4 is an exploded perspective view of a droplet deposition head according to another embodiment of the invention.

FIGS. 4 to 12B illustrate a droplet deposition head 10 according to a further embodiment of the invention. FIG. 4 shows an exploded perspective view of an example droplet deposition head 10. As may be seen, the droplet deposition head 10 comprises an upper manifold component 100 and four lower manifold components 50.

The droplet deposition head of FIGS. 4 to 12B is configured for use with two different types of droplet fluid and, when connected to a suitable fluid supply system, may provide for recirculation of the droplet fluid, in a similar manner to that described above with reference to FIG. 3A-3C. Accordingly, the droplet deposition head includes two fluid inlets 120(1), 120(2) and two fluid outlets 220(1), 220(2) (where the suffixes (1) and (2) indicate that the inlet/outlet is configured for use with, respectively, droplet fluid of the first and of the second type).

As also shown in FIG. 4, between the upper manifold component 100 and each lower manifold component 50 are a series of flexible connectors 75. Some of the flexible connectors 75 couple end sub-branches 20 of the branched inlet paths 180 within the upper manifold component 100 to widening inlet chambers 50 within the lower manifold components 50, whereas other flexible connectors 75 couple end sub-branches 32 of the branched outlet paths 280 within the upper manifold component 100 to narrowing outlet chambers 55 within the lower manifold components 50.

The flexible connectors 75 are therefore adapted to transfer fluid from the upper manifold component 100 to the lower manifold components 50, and vice versa.

Accordingly, the flexible connectors may be individually designed so as to make respective small adjustments to individual fluid paths between the lower manifold components 50 and the upper manifold component 100. For instance, these adjustments may improve the balance of the flow characteristics of the paths (e.g. balancing the pressures, and/or the flow rates and/or the velocities, within the paths). Thus, the flexible connectors might be used to correct small deviations in flow characteristics that arise from manufacturing variability.

The particular flexible connectors 75 in the example shown have an hourglass configuration, so that they narrow at their waists. The narrowing at the waist of each flexible connector 75 may allow it to bend or flex about the waist. This flexibility may assist in compensating for minor misalignments of the upper manifold component 100 with respect to the various lower manifold components 50.

More generally though, the flexible connectors 75 are adapted to flex and bend if one component, for instance the upper manifold component 10, is moved with respect to the other, for instance the lower manifold component 50, but to still maintain a sealed fluidic connection between the two. In this way, the flexible connectors 75 may reduce the transfer of mechanical stress from the upper manifold component to the lower manifold components while still acting to transfer fluid from the upper manifold component 100 to the lower manifold components 50, and vice versa.

Figure 5A:
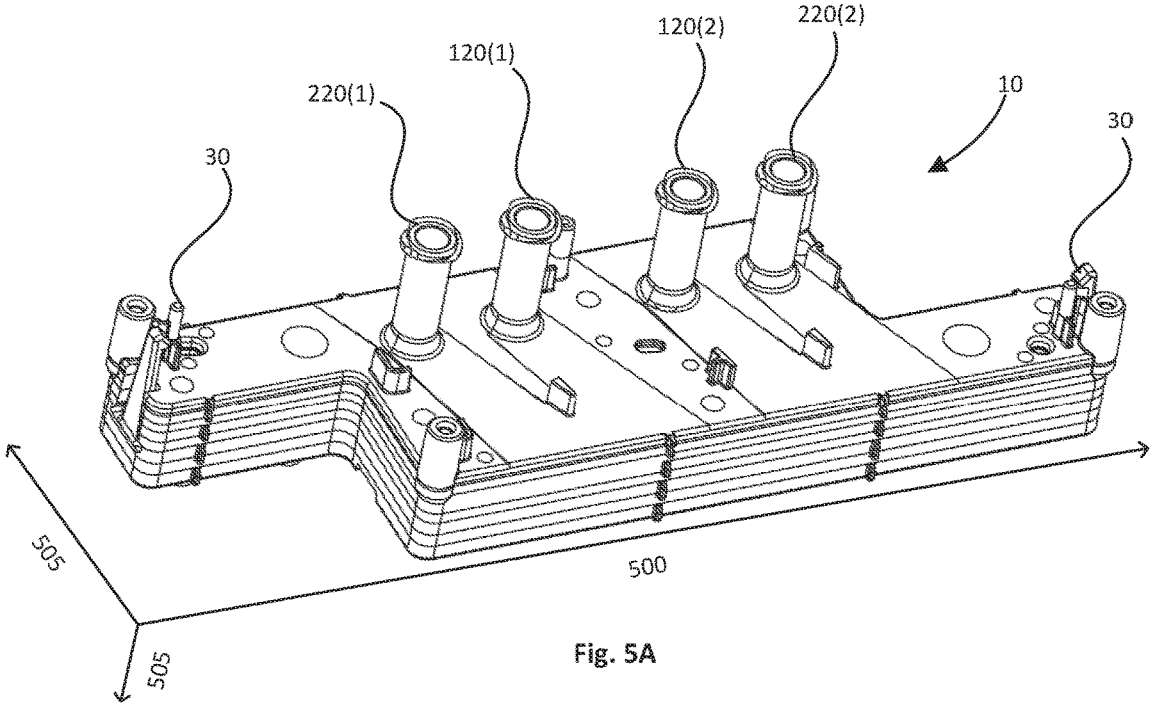
FIG. 5A is a perspective view of an upper manifold component of the droplet deposition head of FIG. 4.

As shown in FIG. 5A, which shows a perspective view of an upper manifold component 100 of the droplet deposition head of FIG. 4, it will be noted that the specific example of an upper manifold component 100 shown is generally z-shaped, when viewed in the ejection direction 505. The z-shape of the upper manifold component 100 is configured to engage with a z-shape of another upper manifold component 100 so that a series of droplet deposition heads 10 can be arranged together on a support (such as a print bar, in the case of an inkjet printhead) in an interlocking, or tessellating manner so as to provide overlap between arrays from different heads. Of course, it will be appreciated that other shapes of the upper manifold component are possible in order to provide tessellation and, more generally, overlap between arrays from different heads. Indeed, the head could have a simple cuboid form.

As may be seen from FIG. 5A, the upper manifold component 100 provides the two inlet ports 120(1), 120(2) and the two outlet ports 220(1), 220(2) at a first end of the head 10. As noted above, each inlet port 120(1), 120(2), and each outlet port 220(1), 220(2) may, for example, be configured to supply or receive a different type of fluid, such as a different colour of ink (the suffixes (1) and (2) indicate that the inlet or outlet port in question is configured for use with, respectively, a first or a second type of fluid). Specifically, inlet port 120(1) and outlet port 220(1) are configured for, respectively, the supply and return of a first type of droplet fluid, while inlet port 120(2) and outlet port 220(2) are configured for, respectively, the supply and return of a second type of droplet fluid.

As will be described in more detail below with reference to FIGS. 8A-8C, the upper manifold component 100 is formed from a plurality of layers. As is shown in FIG. 5A, the upper manifold component 100 comprises a fastening feature 30 at each end for coupling the upper manifold component 100 to a structure, such as a cover component (not shown).

Returning now to FIG. 4, it should be noted that lower manifold components 50 are each mounted in a respective recess in a base 200. As may be seen, the base 200 generally mirrors the shape of the upper manifold component 10. The frame 200 is adapted to receive the lower manifold components 50. More particularly, a carrier layer 76 of each lower manifold component is shaped so as to slot into the corresponding recess in base 200. The base 200 may have features to assist in mounting it on a support. For instance, it may include alignment features, such as one or more datums, as well as attachment features, such as screw-holes to allow the base 200 to be attached to the support using screws.

Figure 5B:
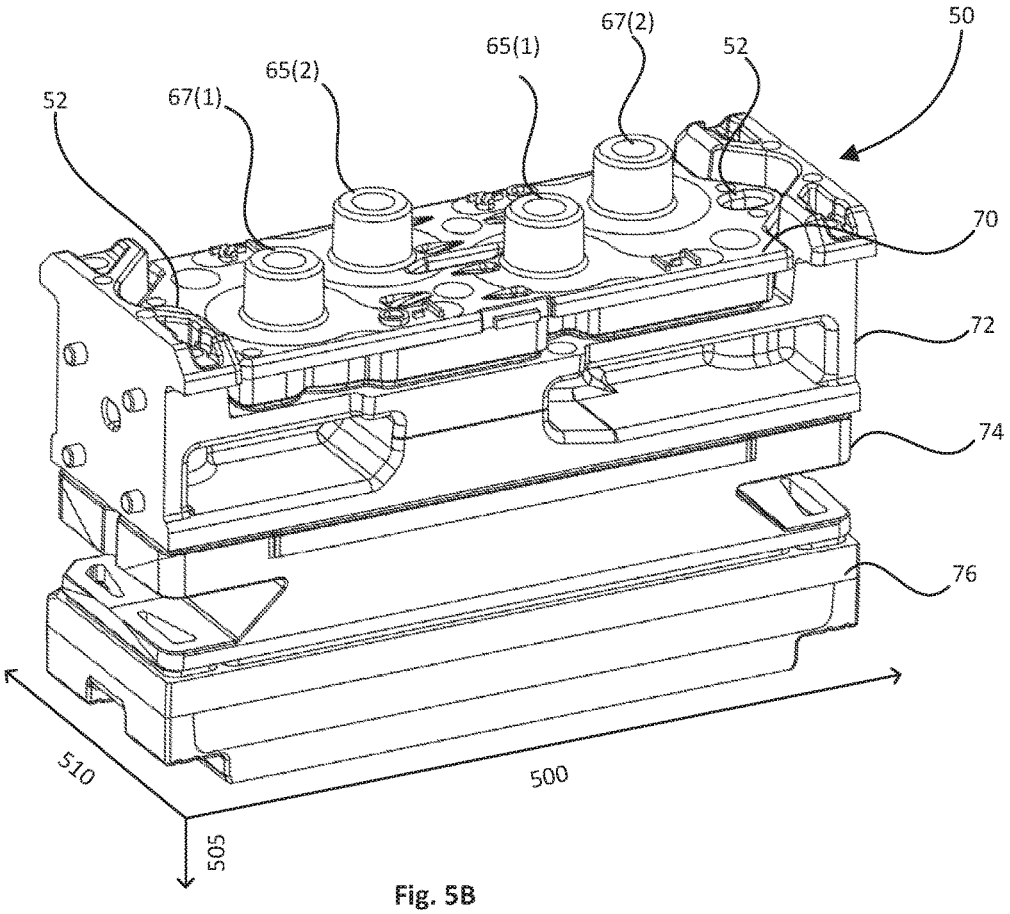
FIG. 5B is a perspective view of a lower manifold component of the droplet deposition head of FIG. 4.

Attention is now directed to FIG. 5B, which shows a perspective view of a lower manifold component 50 of the droplet deposition head 10 of FIG. 4. As may be seen, each lower manifold component 50 comprises two inlet ports 65(1), 65(2) and two outlet ports 67(1), 67(2). As with the ports of the upper manifold layer 10, each inlet port 65(1), 65(2), and each outlet port 67(1), 67(2) is configured to receive a different type of fluid, such as a different colour of ink.

Each lower manifold component 50 supplies fluid to and receives fluid from a number of arrays of fluid chambers 150. More particularly, each lower manifold component 50 supplies fluid of a first type to, and receives fluid of a first type from, two arrays of fluid chambers 150, while also supplying fluid of a second type to, and receiving fluid of a second type from, two arrays of fluid chambers 150.

As may be seen from FIG. 5B, each lower manifold component 50 is formed from a plurality of layers. Each layer extends generally perpendicularly to the ejection direction 505. As may also be seen, each widening inlet chamber 55 and each narrowing outlet chamber 60 is formed within several of the layers. Utilising layers that extend generally perpendicularly to the ejection direction 505 may enable the various narrowing and widening chambers 55, 60 to be formed accurately and relatively straightforwardly, since the layers will generally "cut across" these chambers. Hence, only a small number of layers may be required, it being appreciated that the lower the number of layers, the better the alignment will be between the layers. More specifically, the alignment between the top layer 70 in FIG. 5B, which provides fluidic connection to the upper manifold component 100, and the bottom layer 76 in FIG. 5B, which provides fluidic connection to the arrays 150 may be improved owing to reduced accumulation of alignment error.

It should however be noted that the lower manifold component 50 may be formed in any suitable manner; for example, it could be formed (at least in part) from a plurality of layers that each extend perpendicularly to the depth direction 505 or, potentially, layers that each extend perpendicularly to the array direction 500.

Figure 6A:
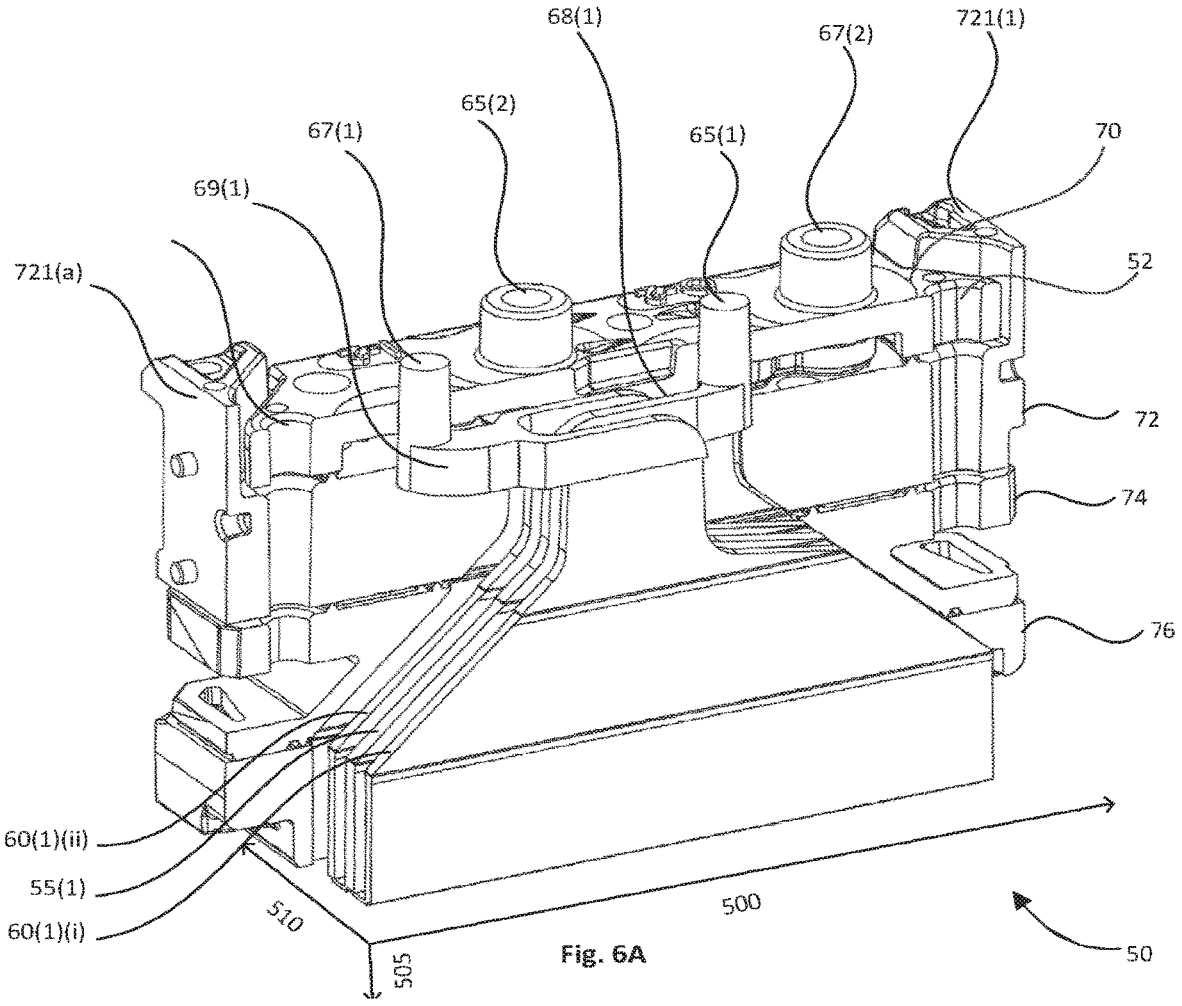
FIG. 6A is a cross-sectional view of the lower manifold component shown in FIGS. 4 and 5B that illustrates the internal features of the lower manifold component.
Figure 6B:
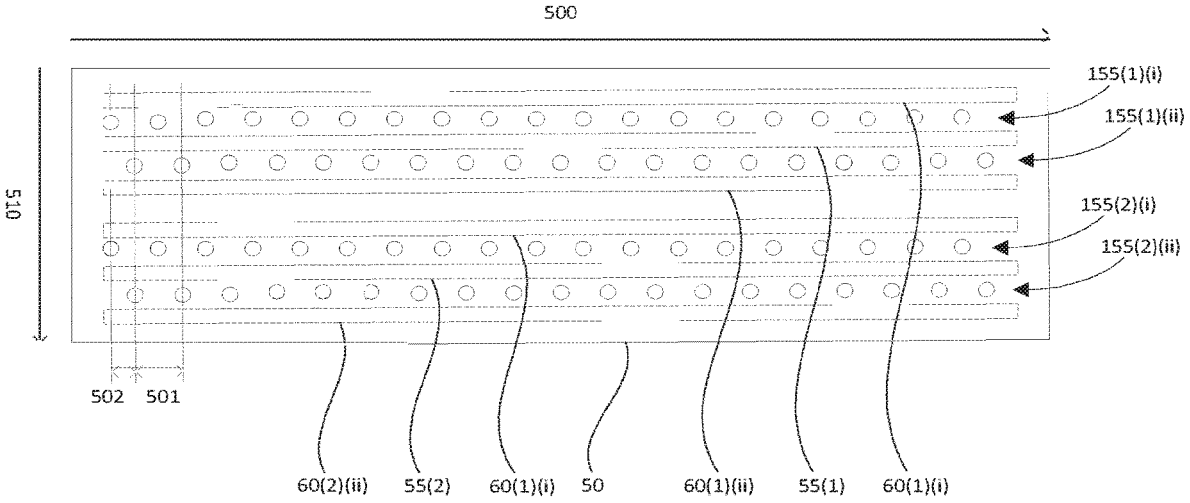
FIG. 6B is a schematic end view of the lower manifold component of FIG. 6A.

In the specific example shown in FIGS. 5B, 6A and 6B, each lower manifold component has four layers: a first lower manifold layer 70, a second lower manifold layer 72, a third lower manifold layer 74 and a fourth lower manifold layer 76, which is a carrier layer 76.

As is apparent from FIG. 5B, in the particular example shown, the first lower manifold layer 70 is mounted within the second lower manifold layer 72, with the second lower manifold layer 72 having two arms 721(*a*), 721(*b*) that cradle the first lower manifold layer 70.

Each lower manifold component 50 also comprises holes 52 that extend through the layers of the lower manifold component 50 at opposing ends. Each hole can receive a fastening means such as a screw, bolt, fastening rod etc. that fastens the layers together. In addition (or potentially instead), the layers of the lower manifold component may be coupled by glue bonding, welding, etc.

FIG. 6A, which is a cross-sectional view of the lower manifold component shown in FIGS. 4 and 5B, illustrates the internal features of the lower manifold component. More particularly, FIG. 6A illustrates as solid objects the respective spaces within the widening inlet chamber 55(1), the narrowing outlet chambers 60(1)(i), 60(1)(ii) and the inlet and outlet port 65(1), 67(1) for one type of droplet fluid.

Addressing the layers in order of increasing proximity to the arrays 150, the first lower manifold layer 70, as may be seen from FIG. 6, comprises inlet ports 65(1), 65(2) and outlet ports 67(1), 67(2). The inlet ports 65(1), 65(2) are located towards the centre of the first layer 70 of the lower manifold component 50 (which is uppermost in FIG. 6A), and the outlet ports 67(1), 67(2) are located towards the sides of the first layer 70 of the lower manifold component 50. Thus, the inlet ports 65(1), 65(2) are located relatively more centrally (when viewed from the array direction 500) than the outlet ports 67(1), 67(2).

In the specific example shown, the ports 65, 67 are integrally moulded as part of the first lower manifold layer 70. Further towards the arrays 150, the first lower manifold layer 70 also comprises corresponding inlet and outlet ducts 68, 69 for the inlet and outlet ports 65, 67 respectively. Each inlet duct is configured to supply fluid to a single corresponding widening inlet chamber 55, whereas each outlet duct 69 is configured to receive fluid from two corresponding narrowing outlet chambers 60.

For example, duct 68(1) supplies fluid to widening inlet chamber 55(1), whereas duct 69(1) receives fluid from both narrowing outlet chamber 60(1)(i) and narrowing outlet chamber 60(1)(ii). These narrowing and widening chambers 55, 60 are in turn fluidically connected to the arrays of fluid chambers 150.

More particularly, each lower manifold chamber, such as the widening inlet chamber 55 or the narrowing outlet chamber 60, may provide fluidic connection to at least two arrays 150 from the same group. In the example shown in FIG. 6, each widening outlet chamber 55(1), 55(2), is fluidically connected to two arrays 150; thus, a pair of arrays 150 shares the same widening inlet chamber 55(1), 55(2). However, it should be noted that a pair of arrays 150 could instead (or possibly in addition) share the same narrowing outlet chamber 60.

In the example shown in FIGS. 6A and 6B, the lower manifold component 50 is configured for use with two types of fluid, with each type of fluid being supplied to the lower manifold component 50 via a respective inlet port 65(1), 65(2) and being returned to the upper manifold component 100 via a respect outlet port 67(1), 67(2).

Each widening inlet chamber 55 is configured to distribute a specific type of fluid from a respective inlet port 65(1), 65(2) to two arrays 150 from the same group. Thus, as noted above, the two arrays 150 in the same group receive fluid from the same widening inlet chamber 55. This is illustrated in further detail by FIG. 6B, which is a schematic end view of the lower manifold component 50 of FIG. 6A, taken from the end at which the arrays are located.

As may be seen from FIG. 6B, two pairs of nozzle rows 155(1)(i)-(ii) and 155(2)(i)-(ii) are provided adjacent the carrier layer 76 of the lower manifold component 50, each nozzle row 155 corresponding to a respective array 150. The nozzle rows 155 within a pair are located adjacent one another, as are the corresponding arrays of fluid chambers.

Each pair of arrays may, for example, be provided by a single actuator component, though in other constructions each array could be provided by a separate actuator component, or all of the arrays for a lower manifold component could be provided by the same actuator component.

The first pair of nozzle rows 155(1)(i)-(ii) is configured for ejection of one type of droplet fluid and the second pair of nozzle rows 155(2)(i)-(ii) is configured for ejection of another type of droplet fluid.

As is illustrated in FIG. 6B, widening inlet chamber 55(1) is fluidically connected to the array corresponding to nozzle rows 155(1)(i), 155(1)(ii), whereas widening inlet chamber 55(2) is fluidically connected to nozzle rows 155(2)(i), 155(2)(ii). In addition, narrowing outlet chambers 60(1)(i) and 60(1)(ii) are fluidically connected to the array corresponding to nozzle rows 155(1)(i) and 155(1)(ii) respectively, whereas narrowing outlet chambers 60(2)(i) and 60(2)(ii) are fluidically connected to the array corresponding to nozzle rows 155(2)(i) and 155(2)(ii) respectively.

As is apparent from FIG. 6B, when viewed from the ejection direction 505, the two arrays 150 within a group are disposed on either side of the corresponding shared widening inlet chamber 55. The widening inlet chamber 55 may thus appear to divide or separate the arrays 150 when viewed from the ejection direction 505.

Contrastingly, each narrowing outlet chamber 60 is configured to receive fluid from only a single array 150 and return it to an outlet port 67(1), 67(2). In the specific example of FIG. 6A, the two narrowing outlet chambers 60 corresponding to one type of fluid return fluid to the same outlet port 67(1), 67(2), such that they share the outlet port 67(1), 67(2).

Returning now to FIG. 6B, it will be noted that nozzles 155(1)(i), which correspond to an array within the first group, are aligned with nozzles 155(2)(i), which correspond to an array within the second group. Similarly, nozzles, 155(1)(ii) are aligned with nozzles 155(2)(ii). It will be appreciated that the respective arrays of chambers 150 will be aligned in substantially the same manner. Thus, FIG. 6B may be considered an example of where, for arrays corresponding to a particular one of the lower manifold components 50, each array 150 in a first group is aligned in the array direction 500 with a respective array 150 in the second group. In this way, as the deposition medium is indexed past the droplet deposition head 10, each portion of its width in the array direction 500 is addressed by an array 150 from every group within the lower manifold component 50.

As is apparent from FIG. 6B, the nozzle rows 155 for arrays 150 within the same group (e.g. nozzle rows 155(1)(i) and 155(1)(ii)) are offset from each other in the array direction 500 by a small amount 502. It will be appreciated that the respective arrays of chambers 150 will be offset in substantially the same manner.

More generally, arrays 150 corresponding to the same group and the same lower manifold component 50 may be offset in the array direction 500 with respect to one another.

This offset may, for example, be of the order of the nozzle spacing 501 for each array. The offset could, for example be approximately 1/N times the nozzle spacing 501, where N is the number of arrays within the same group that correspond to the same lower manifold component (or, potentially, M+(1/N) times the nozzle spacing, where M is an integer); in the example shown in FIG. 6B, N=2. Hence, or otherwise, the nozzles of the N arrays may together provide an array of nozzles with spacing 1/N, when viewed in a depth direction 505, perpendicular to the array direction 500 and the ejection direction 510. The nozzles 155 from the N arrays may accordingly be interleaved with respect to the array direction 500, as shown in FIG. 6B. Thus, the multiple arrays may provide the printhead with a higher resolution than a single array.

Returning now to FIG. 6A, as may be seen from the drawing, each outlet duct 69 for coupling two narrowing outlet chambers 60 to the corresponding one of the outlet ports 67(1), 67(2) combines the two narrowing outlet chambers 60 fluidically in the upper layer 70 of the lower manifold 50. For example, as shown in FIG. 6, two narrowing outlet chambers 60(1)(i), 60(1)(ii) may be merged by forming a merging portion between the two parallel upper slots of the two narrowing outlet chambers 60(1)(i), 60(1)(ii) to form a 'U'-shaped fluid path in the plane of layer 70. In this way, each parallel channel of each outlet duct 69 couples to a corresponding narrowing outlet chamber 60, such that each outlet duct 69 fluidically couples to two narrowing outlet chambers 60.

The substantially parallel channels of the outlet ducts 69 are configured to extend along either side, with respect to the depth direction 510, of a channel of the inlet duct 68 which couples one of the widening inlet chambers 55 to a corresponding one of the inlet ports 65(1), 65(2).

While the specific example shown in FIGS. 6A and 6B includes a widening inlet chamber 55 that is shared between two arrays within the same group, in other examples one (or more) of the narrowing outlet chambers 60 might be shared between two arrays within the same group in a similar manner. Hence, or otherwise, there may be provided a respective widening inlet chamber 55 for each array (whether within the same group or otherwise). In other examples, each array may be provided with a respective widening inlet chamber 55 and a respective narrowing outlet chamber 60. Thus, there may be one widening inlet chamber 55 for each narrowing outlet chamber 60.

Turning now to the second lower manifold layer 72, this layer is fluidically coupled to the first lower manifold layer 70 and comprises a first portion of the widening inlet chambers 55 and the narrowing outlet chambers 60, where, with increasing distance in the ejection direction 505, each of these chambers widens in the array direction 500 (it being noted that the width of the narrowing outlet chambers 60 narrows with increasing distance in the opposite direction to the ejection direction 505). As may be seen from FIG. 6A, the widening inlet chambers 55 and the narrowing outlet chambers 60 are substantially aligned with respect to the array direction 500 (though they may be offset with respect to each other by a small amount, e.g. a fraction of the nozzle spacing 501, in the same way as their corresponding arrays of fluid chambers 150).

Turning now to the third lower manifold layer 74, this layer is fluidically coupled to the second lower manifold layer 72 and comprises a second portion of the widening inlet chambers 55 and the narrowing outlet chambers 60, where, with increasing distance in the ejection direction 505, each of these chambers continues to widen in the array direction 500.

Turning now to the carrier layer 76, as is apparent from FIG. 6, this layer is fluidically coupled to the third lower manifold layer 74. The carrier comprises an end portion of the widening inlet chambers 55 and of the narrowing outlet chambers 60, where these chambers remain substantially of constant width in the array direction 500. When viewed in the depth direction 510, the end portions of the narrowing outlet chambers 60 and the widening inlet chambers 55 do not narrow or widen; they have sides that generally extend parallel to the ejection direction 505. This constant width portion may allow further flow development to a substantially uniform velocity profile across the array of fluid chambers 150.

It should further be appreciated that the actuator components, which each provide at least one array 150 of regularly-spaced fluid chambers (with each chamber being provided with a respective actuating element, such as a piezoelectric actuator, and a respective nozzle) are mounted on the carrier 76 in such a way as to allow fluid to be supplied to and received from the fluid chambers of the arrays 150. Each actuating element is actuable to eject a droplet of fluid in an ejection direction 505 through a corresponding nozzle. Each array extends in an array direction 500, similar to that shown in FIGS. 1B, 2B and 3C. The width, in the array direction 500, of the end portion (the "straight" portion) of the narrowing outlet chambers 60 and the widening inlet chambers 55 is substantially the same as that of the arrays 150. This width may also correspond to the width of the widening inlet chambers 55 and narrowing outlet chambers 60 of the third lower manifold layer 74 at its widest point at the bottom (i.e. nearmost the arrays 150) of the third lower manifold layer 74.

The first, second and third lower manifold layers 70, 72, 74 may, for example, be formed of polymeric materials and/or plastic materials. Factors that may be taken into account when selecting appropriate polymeric materials and/or plastic materials are discussed in further detail below. In some cases, a filled polymeric material may be appropriate; the filler may suitably be a fibrous material, such as glass, mineral and/or ceramic fibres. Filling may impart greater mechanical strength and thermal resistance. Moreover, it may aid in achieving a particular coefficient of thermal expansion (CTE) for the layers.

The carrier 76 may be made from a different material to the other layers of the lower manifold. For instance, the carrier 76 may be made from a material whose coefficient of thermal expansion is similar to, or matches with, that of the actuator components that are mounted thereupon. Such thermal matching may reduce the amount of mechanical stress that the actuator component experiences during use.

Additionally. (or instead) the carrier 76 may be made from a material that is thermally conductive, for instance more thermally conductive than the other layers of the lower manifold component. This may assist in transferring heat away from the actuator component(s) that are mounted on the carrier 76. For instance, heat may be transferred to fluid within the narrowing outlet chambers 60, with the thus-heated fluid then flowing out of the lower manifold component 50 and therefore drawing heat out away from the actuator component(s). In constructions, such as that shown in FIG. 6A, where the carrier layer 76 includes a "straight" portion of the narrowing outlet chambers 60, this heat transfer may be particularly efficient since it can occur over a large surface area. It should further be noted that, even in constructions where no outlet path is provided (e.g. where there is only a widening inlet chamber 55 and no narrowing outlet chambers 60), the carrier 76 may usefully function as a heat sink, drawing heat away from the actuator and transferring it to the environment.

Where a driver IC is provided on the outer surface of the lower manifold component, such thermal conductivity may assist in transferring heat away from such a driver IC. Similarly to the heat transfer from the actuator, heat from the driver IC may, for instance, be transferred to fluid within the narrowing outlet chambers 60, with the thus-heated fluid then flowing out of the lower manifold component 50 and therefore drawing heat out away from the driver IC. In cases where one or more of the narrowing outlet chambers 60 for the lower manifold component 50 is provided adjacent an outer surface of that lower manifold component 50 and the driver IC is mounted on that surface, this type of heat transfer may be particularly efficient. In any case, as noted above, the carrier 76 may function as a heat sink and may thus draw heat away from the driver IC and transfer it to the environment, even where no outlet path is provided.

In some examples, the carrier layer 76 may be made of ceramic material(s). This may be particularly appropriate as many actuator components will themselves be made of ceramic materials. Hence, it may be easier to match the coefficients of thermal expansion of the carrier and of the actuator component. In addition, ceramic materials may provide good thermal conductivity.

However, other materials might also be used for the carrier layer, for instance, the carrier layer might be formed of a metal or an alloy. Where an alloy is used, the formulation may be tailored to provide desired properties, such as a desired CTE and/or thermal conductivity.

As noted above, a filled polymeric material may be utilised for the first, second and third lower manifold layers 70, 72, 74. Such filling may, for example, assist in reducing the difference in CTE between the first, second and third lower manifold layers 70, 72, 74 and the carrier layer 76.

Nonetheless, some difference in CTE may remain, despite such efforts. Moreover, there may exist differences in the CTE values for the materials of the various lower manifold layers for other reasons.

Figure 7A:
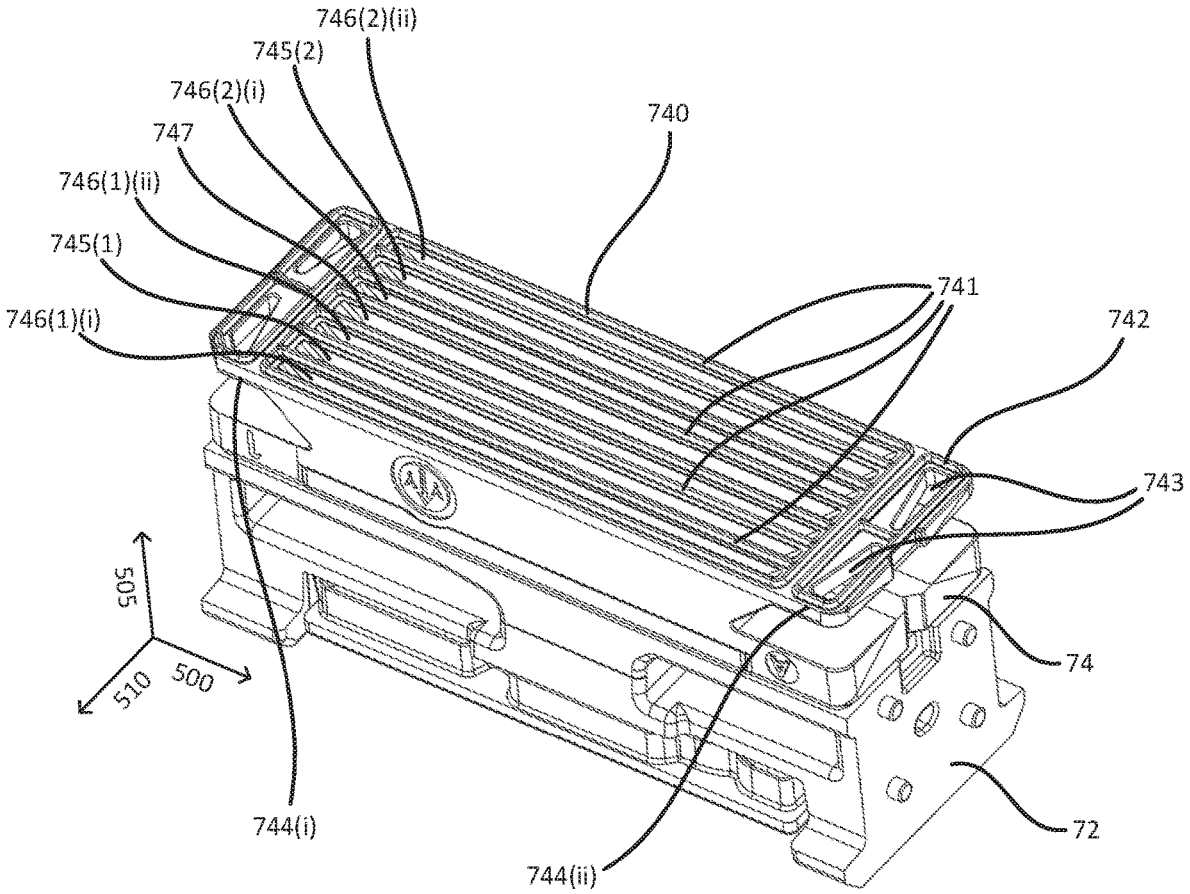
FIG. 7A is a perspective view from below of certain layers of the lower manifold component shown in FIGS. 4, 5B, 6A and 6B.
Figure 7B:
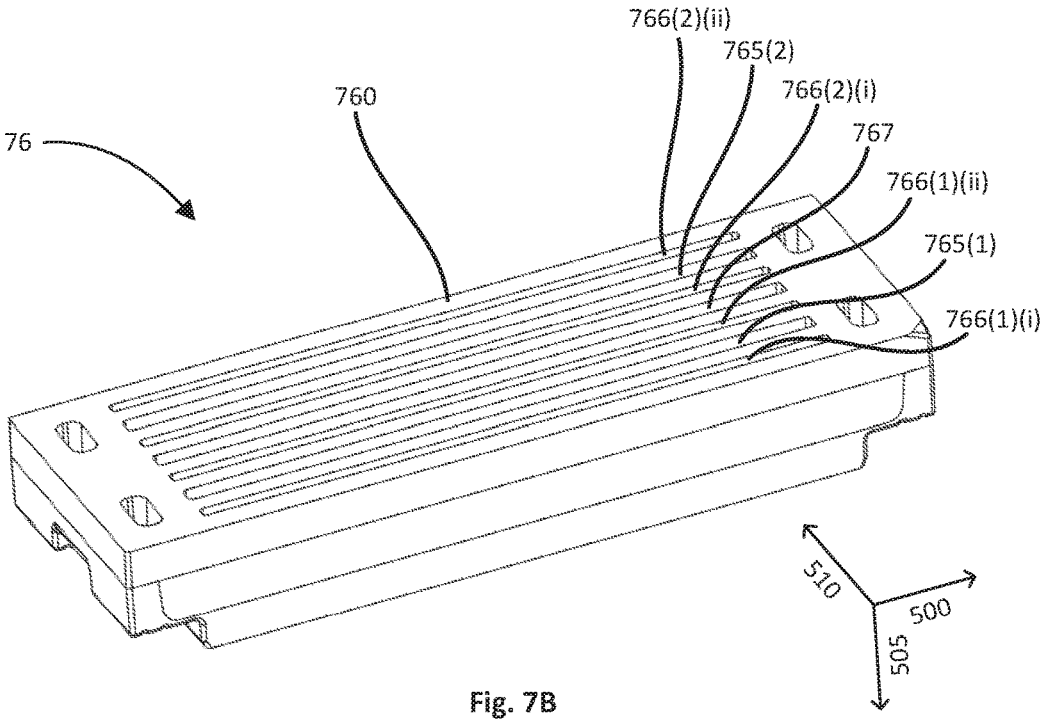
FIG. 7B is a perspective view of the carrier layer of the lower manifold component shown in FIGS. 4, 5B, 6A and 6B.
Figure 7C:
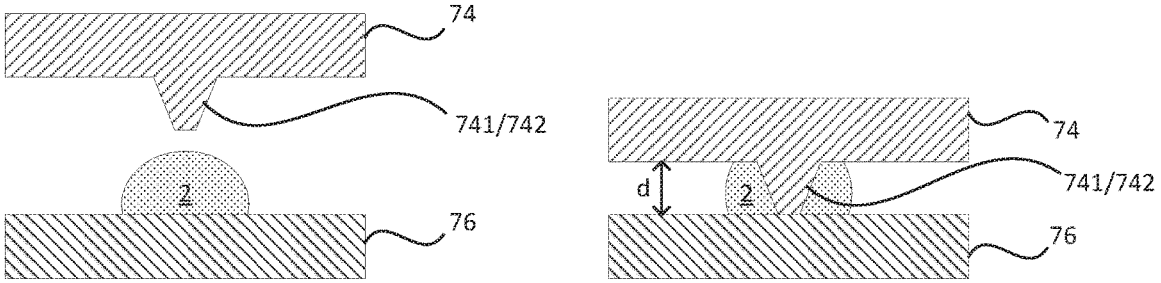
FIG. 7C is a schematic diagram illustrating the bonding of certain layers of the lower manifold component shown in FIGS. 4, 5B, 6A and 6B.

In this regard, reference is directed to FIGS. 7A-7C, which illustrate certain features of the lower manifold component 50 that may address issues that arise with layers having different CTE values. Turning first to FIG. 7A, which is a perspective view from below of the first, second and third layers 70, 72, 74 of the lower manifold component shown in FIGS. 4, 5B, 6A and 6B, the side of the third layer 74 to which the carrier layer 76 is bonded is clearly visible. As is apparent from the drawing, this side extends generally perpendicular to the ejection direction 505. Conversely, FIG. 7B, which is a perspective view of the carrier layer 76, shows clearly the side of the carrier layer 76 to which the third layer 74 is bonded. This similarly extends generally perpendicular to the ejection direction 505.

As is shown in FIG. 7A, formed on the bonding side of the third layer 74 is a plurality of ridges 741, 742. To bond the carrier layer 76 to the third layer 74, adhesive is applied to the bonding side of the carrier layer 76 in a pattern that corresponds to the ridges 741, 742 on the opposing bonding side of the third layer 74. For instance, the adhesive may be applied in a pattern that follows the paths of substantially all of the ridges. When the bonding sides are brought into contact, each ridge 741/742 may be pressed into a corresponding portion of the adhesive pattern 2, as is shown in FIG. 7C. As shown in the drawing, this may, for example, lead to the ridge 741/742 splitting the corresponding portion of adhesive 2 into two wedge-shaped portions, or fillets.

In some cases, substantially the only contact between the bonding sides is through the ridges 741, 742. The ridges may thus conveniently determine the separation distance d between the layers 74, 76, as indicated in FIG. 7C.

Depending on the particular adhesive used, it may then be necessary to cure the adhesive. In some cases, this may involve the assembly being heated to a relatively high temperature (in many cases more than 80° C.). Such heating will cause the layers to expand, with the third layer 74 expanding by a different (typically greater) amount than the carrier layer 76. Had the bonding sides of the two layers 74, 76 simply been flat, this differential thermal expansion might have led to warpage and, potentially, the separation of the two layers as a result of the curing process.

Such issues may, for example, arise because the typical thickness at which adhesive can be applied (which is determined by such factors as viscosity, surface energy, surface roughness etc.) is relatively small. A possible consequence is that the bonding sides are secured only a short distance apart. With such a thin layer of adhesive between the bonding sides, almost all of the expansion of the bonding side of one layer is applied to the bonding side of the other layer. This in turn may lead to the layers 74, 76 bending with a relatively tight radius of curvature, potentially leading to the separation of the layers. Such bending caused by the heating is effectively locked-in to the component by the curing of the adhesive. When the component returns to room temperature, stress/strain is generated within the component as the layers attempt to return to their original sizes. Still greater stresses may be experienced during shipping of the component, for example if the component is shipped by air-freight, where temperatures might fall to −20° C., for instance. Such stresses may, as mentioned above, lead to separation of the layers.

The ridges 741, 742 essentially enable the adhesive to span a greater distance between the layers. Thus, for a given differential in the expansion of the two layers during heat-curing, less stress will be imparted to the adhesive when the component returns to room temperature. A possible consequence is that there is less risk of the adhesive failing and the layers thus separating.

Referring once more to FIG. 7A, it may be noted that formed in the bonding side of the third layer 74 are respective apertures for each widening inlet chamber 55 and for each narrowing outlet chamber 60. Specifically, there are two apertures 745(1), 745(2) corresponding to respective widening inlet chambers 55(1), 55(2) and four apertures 746(1)(i), 746(1)(ii), 746(2)(i), 746(2)(ii) corresponding to respective narrowing outlet chambers 60(1)(i), 60(1)(ii), 60(2)(i), 60(2)(ii).

Similarly, as may be seen from FIG. 7B, respective apertures for each widening inlet chamber 55 and for each narrowing outlet chamber 60 are formed in the bonding side of the carrier layer 76. Specifically, there are two apertures 765(1), 765(2) corresponding to respective widening inlet chambers 55(1), 55(2) and four apertures 766(1)(i), 766(1)(ii), 766(2)(i), 766(2)(ii) corresponding to respective narrowing outlet chambers 60(1)(i), 60(1)(ii), 60(2)(i), 60(2)(ii).

As will be apparent from a comparison of FIG. 7A with FIG. 7B, each of the apertures in the bonding side of the third layer 74 directly opposes a respective aperture in the bonding surface of the carrier layer 76.

It may be noted that an additional aperture 747, 767 is formed in the bonding side of each of the third layer 74 and the carrier layer 76. These apertures may simplify the moulding of the layers and should be understood as being entirely optional.

Returning now to FIG. 7A, it is apparent that certain of the ridges 741 separately surround each of the apertures 745(1), 745(2), 746(1)(i), 746(1)(ii), 746(2)(i), 746(2)(ii) formed in the bonding side of the third layer 74. Thus, the fluid path corresponding to each aperture 745(1), 745(2), 746(1)(i), 746(1)(ii), 746(2)(i), 746(2)(ii) is separated from the fluid paths corresponding to the other apertures 745(1), 745(2), 746(1)(i), 746(1)(ii), 746(2)(i), 746(2)(ii). This may, for example, ensure that pressure is not lost from the widening inlet chambers 55 and narrowing outlet chambers 60 and that different types of droplet fluid do not mix.

It should be noted that while in the particular example shown in FIGS. 7A-7D, the ridges 741, 742 are formed on the bonding side of the third layer 74, they could of course be formed on the bonding side of the carrier layer 76 instead. Nonetheless, as the third layer 74 is formed of polymeric material, it may be particularly straightforward to form the ridges 741, 742 on the third layer 74.

Figure 7D:
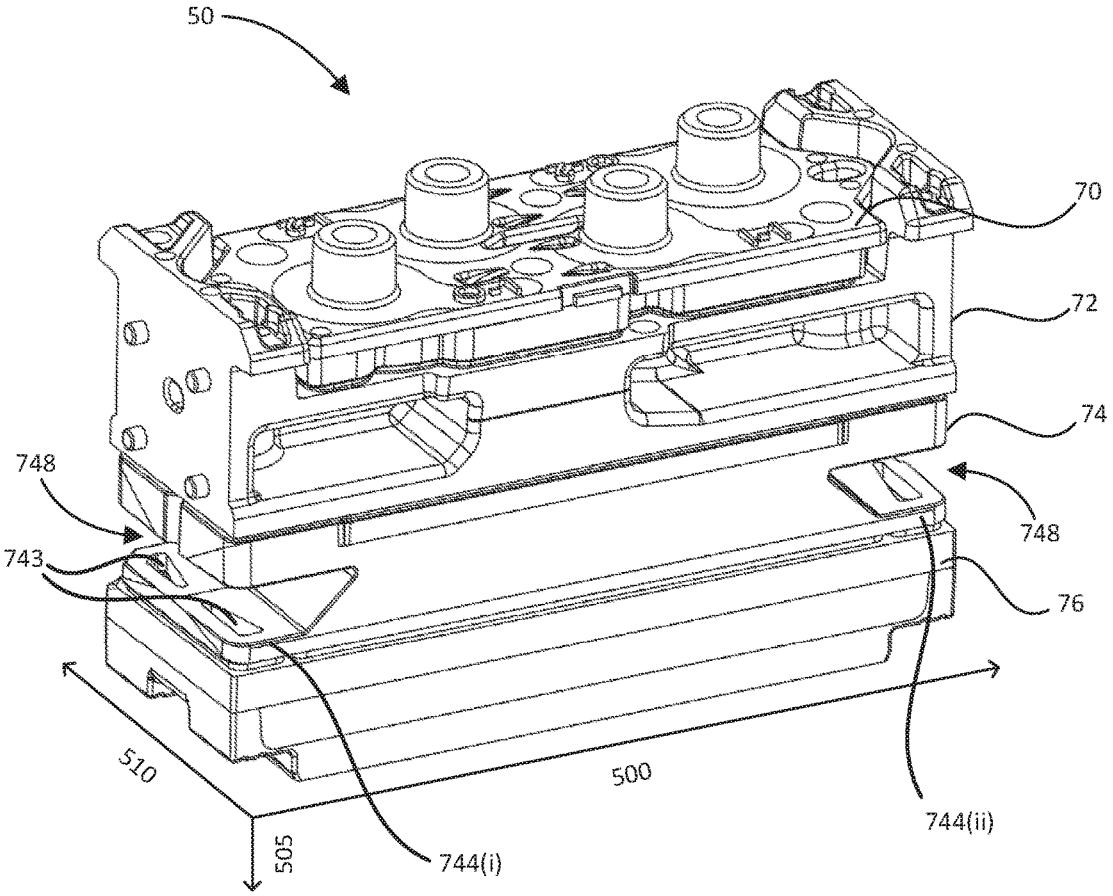
FIG. 7D is a perspective view of the lower manifold component 50 of FIGS. 4, 5B, 6A and 6B.

Turning now to FIG. 7D, which is a perspective view of the lower manifold component 50 of FIGS. 4, 5B, 6A and 6B, still further features to address issues caused by stresses arising as a result of the curing process are visible.

Specifically, it is apparent from FIG. 7D that the thickness, in the ejection direction 505, of the portion of the third layer 74 adjacent the carrier layer 76 decreases towards each end of the third layer with respect to the array direction 500. In this way, a respective reduced-thickness region 744(i), 744(ii) is provided at each end of the third layer 74 with respect to the array direction 500. This reduced-thickness region 744(i), 744(ii) may act to increase the flexibility of the third layer 74 in areas where stresses are particularly large, as stresses will generally increase with distance from the centre of the layer.

It may further be noted that in the particular example shown a recess 748 is formed at each end of the third layer 74 with respect to the array direction 500. Each of these recesses 748 separates one of the reduced-thickness regions 744(i), 744(ii) from another portion of the first layer with respect to the ejection direction 505, in this case a portion adjacent the next layer, second layer 72.

Returning briefly to FIG. 7A, it is apparent that a second group of the ridges 742 follows the boundary of each of the reduced-thickness regions 744(i), 744(ii). These ridges 742 may, for example, separate the reduced-thickness regions 744(i), 744(ii) from a central region of the third layer 74. Such ridges may, for instance, serve as a line of weakness that, should stresses within the component 50 cause separation of the layers 74, 76, prevents this separation from spreading to the central region of the third layer 74, where the widening inlet chambers 55 and narrowing outlet chambers 60 will typically be located.

While in this discussion of FIGS. 7A-7D the reduced-thickness regions 744(i), 744(ii) and corresponding recesses 748 have been described as being located at an end of the third layer 74 with respect to the array direction 500, it should be understood that they may more generally be located at an edge of the layer (e.g. an edge in the plane of the layer).

Referring now to FIGS. 7A and 7D, it may be noted that voids 743 are formed in the portion of the third layer 74 adjacent the carrier layer 76. As may be seen, each of these voids 743 is located in a corner of the third layer 74 and extends into the layer in the ejection direction 505. Indeed, as is apparent from a comparison of FIG. 7A with FIG. 7D, each of these further voids extends through the entirety of the portion of the third layer 74 adjacent the carrier layer 76.

Such further voids may increase the flexibility of the layer in the corners, where stresses may be particularly high, in view of their distance from the centre of the layer. In addition, where the layer is moulded (e.g. injection moulded) using a filled polymeric material, forming such voids in the corners will encourage the filler to flow around the corners. Where the filler is fibrous, the fibres 749 will tend to follow a path around the corner. This is shown schematically in FIG. 7E, with the size of the fibres 749 being exaggerated in the drawing so that the paths are shown clearly.

Figure 7E:
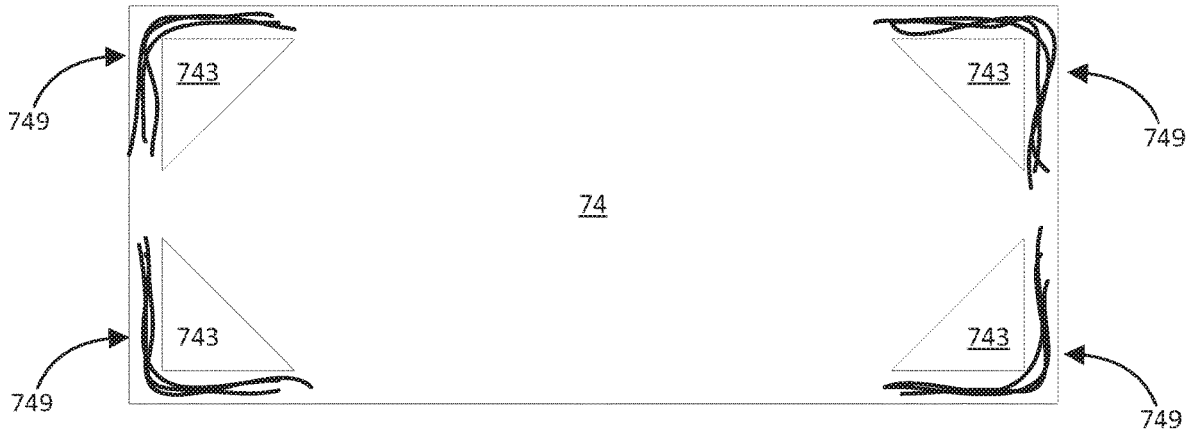
FIG. 7E is a schematic diagram showing the effect of voids formed in the corner of a layer on fibre-filled polymeric material.
Figure 7F:
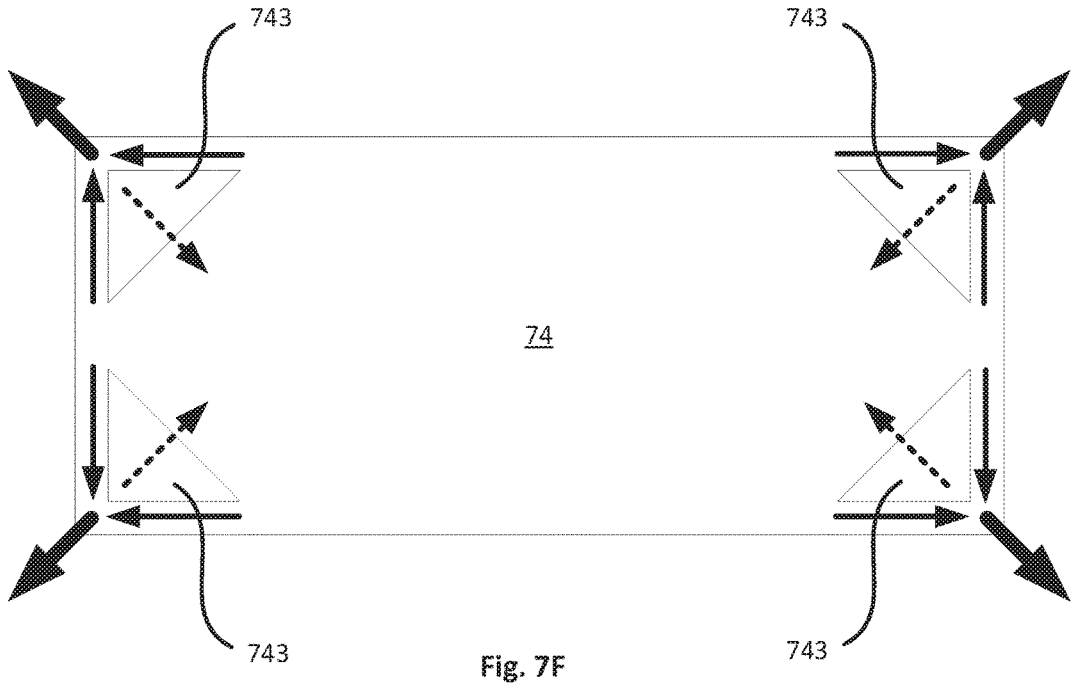
FIG. 7F is a schematic diagram showing the mechanical effects of voids formed in the corner of a layer.

Typically, the CTE for a fibrous material will be lowest in the direction in which the fibres 749 extend and smallest in a direction perpendicular to the fibres 749. Thus, providing voids in the corners of the layer 74 may lead to an expansion pattern as indicated by the small solid arrows in FIG. 7F. As may be seen, when the layer 74 shown in FIG. 7E is heated, the greatest expansion is in a direction parallel to the sides and towards the corners. The net result of such expansion is illustrated by the large solid arrows. As may be appreciated, when the component is later cooled, e.g. to room temperature, the layer will tend to contract in the opposite direction, indicated by the dashed arrow. As may also be appreciated, the presence of the voids 743 provides additional flexibility in this direction, helping to relieve the stress that the adhesive might otherwise experience. A possible consequence is that there is less risk of the adhesive failing and the layers thus separating.

It should further be understood that such voids 743 located in the corners of a layer 74 may be of benefit regardless of whether a fibre-filled polymeric material is used. As the corners are particularly distant from the centre of the layer 74 they would typically experience high stress: by providing voids 743 in the corners, such stresses are reduced. This may, for example, be as a result of there being less material through which stress may be transferred from the centre of the layer 74.

It should still further be understood that while various features have been described with reference to FIGS. 7A-7F in the context of the third layer 74 and the carrier layer 76, they may be applied more generally to any two layers formed of materials with different CTE values.

The configuration and operation of the upper manifold component 100 of the droplet deposition head 10 shown in FIG. 4 will now be described with reference to FIGS. 8A-8C, 9A-9C and 10 to 12.

Figure 8A:
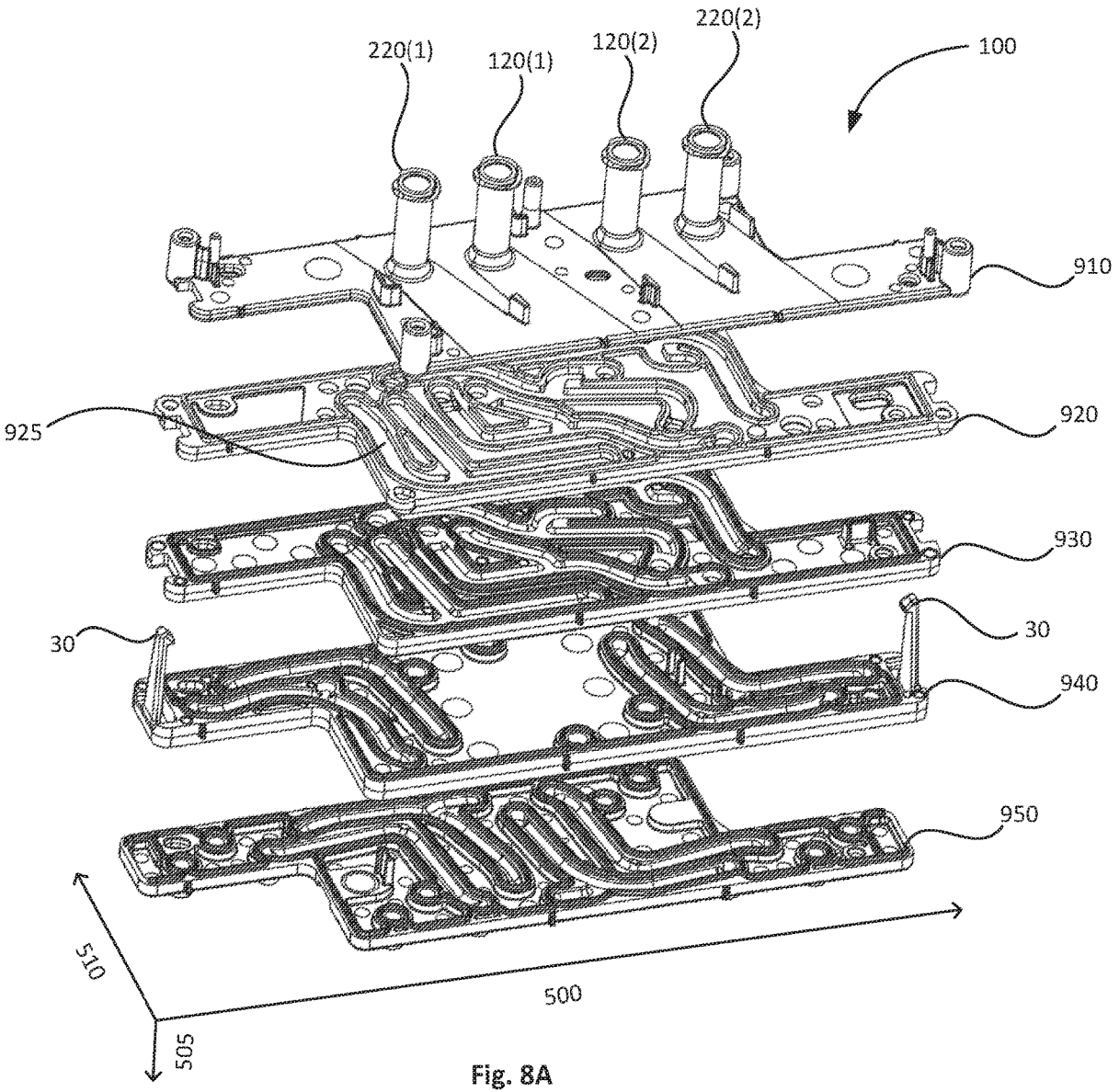
FIG. 8A is an exploded perspective view of the upper manifold component of FIG. 4 and its constituent layers.

Turning first to FIG. 8A, which shows an exploded perspective view of the upper manifold component 100 of FIG. 4 and its constituent layers, the upper manifold component 100 is made from a plurality of layers which extend generally perpendicularly to the ejection direction 505.

In the specific example shown in FIGS. 8-11 there are five layers; in order of increasing proximity to the arrays 150 they are: a first, top layer 910, a second, filter layer 920, a third layer 930, a fourth layer 940 and a fifth, bottom layer 950 (though any suitable configuration and number of layers could be used instead).

As may be seen from FIG. 8A, the top layer 910 comprises the fluid inlet 120(1), 120(2) and outlet 220(1), 220(2) ports. As with the ports of the lower manifold components 50(*a*)-(*d*), these may be integrally moulded with the top layer 910.

The plurality of layers 910-950 are shaped so that, in each of a plurality of planes parallel to the layers, multiple curved, serpentine paths are provided. These curved paths are fluidically connected together by paths extending generally perpendicularly to the layers, for example provided by through-holes 960, 970 within the layers.

In the specific construction illustrated by FIGS. 8-11 such multiple curved paths are, on the whole, defined between adjacent layers (once combined, as illustrated in FIG. 5A). However, three, four or more layers might combine to define such multiple curved paths in some cases.

The layers 910-950 are coupled in a fluid-tight manner, so as to prevent leakage of fluid. In addition, one of the layers of the upper manifold component 10, in this example the fourth layer 940, may comprise two fastening features 30 at opposing ends of the upper manifold component 100 for coupling the upper manifold layer 100 to a head cover component (not shown).

In the specific construction illustrated by FIGS. 8-11, one of the layers of the upper manifold component 100 is a filter layer 920, which comprises a filter 925. The filter 925 is generally planar and may, for example be formed of a mesh. As shown in the drawing, the filter 925 extends in the same plane as the filter layer 920. The filter layer 920 may be manufactured by insert-moulding, where the filter 925 is used as the insert. The filter is adapted, for example by suitable choice of the pore size of its mesh, to remove impurities from the fluid and prevent them from reaching the array 150. For instance, the filter may have pores with smaller diameter than such impurities. On the other hand, where the droplet fluid is intended to contain particulates, the filter may be adapted (e.g. by providing pores with larger diameter than such particulates) so as to permit such particulates to pass through. Either side of the filter layer 920 are first and third layers 910, 930 respectively.

Figure 8B:
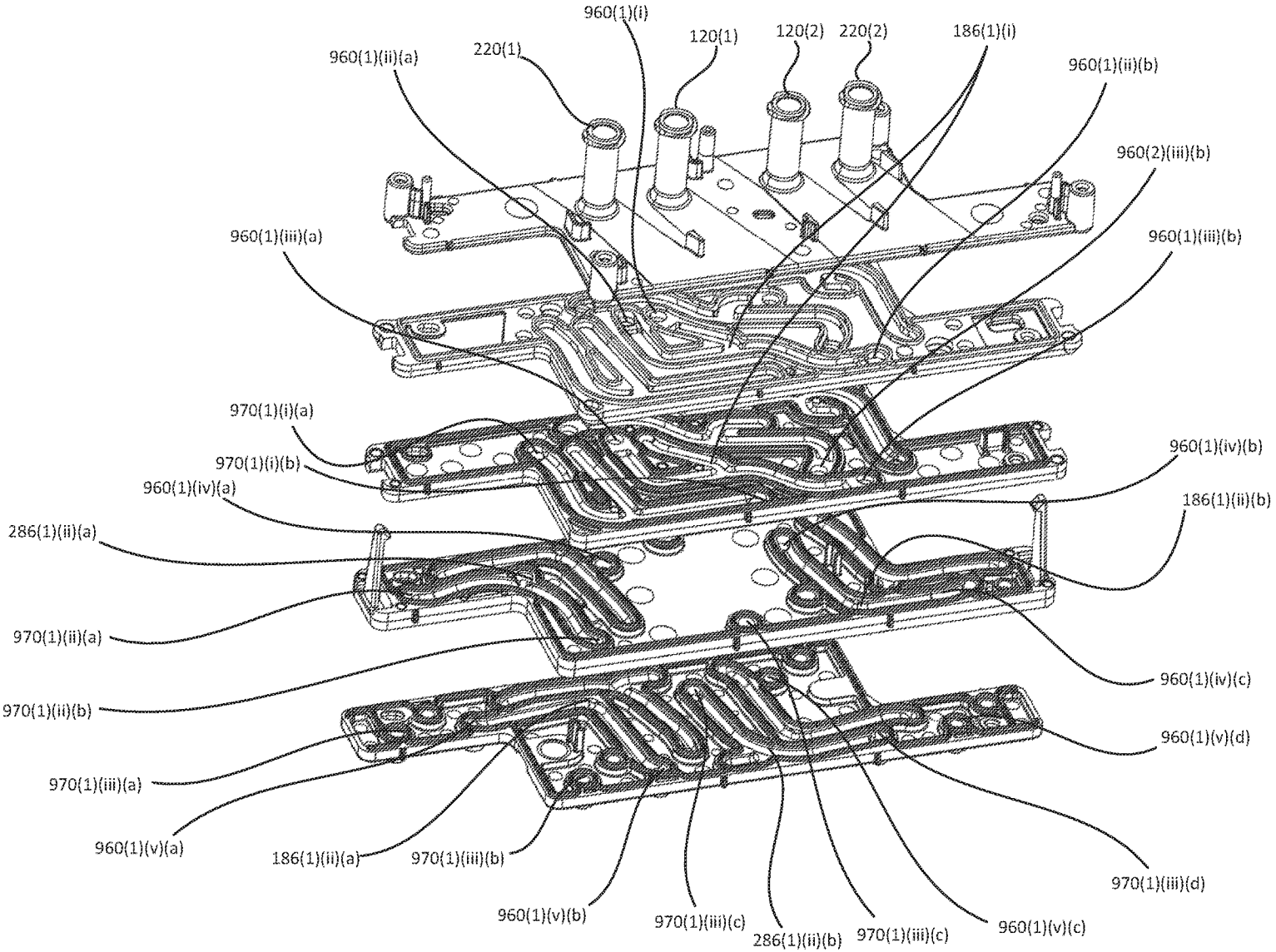
FIG. 8B is a further exploded perspective view of the upper manifold component of FIG. 4 that indicates the features which provide branched inlet and outlet paths for a first type of fluid.
Figure 8C:
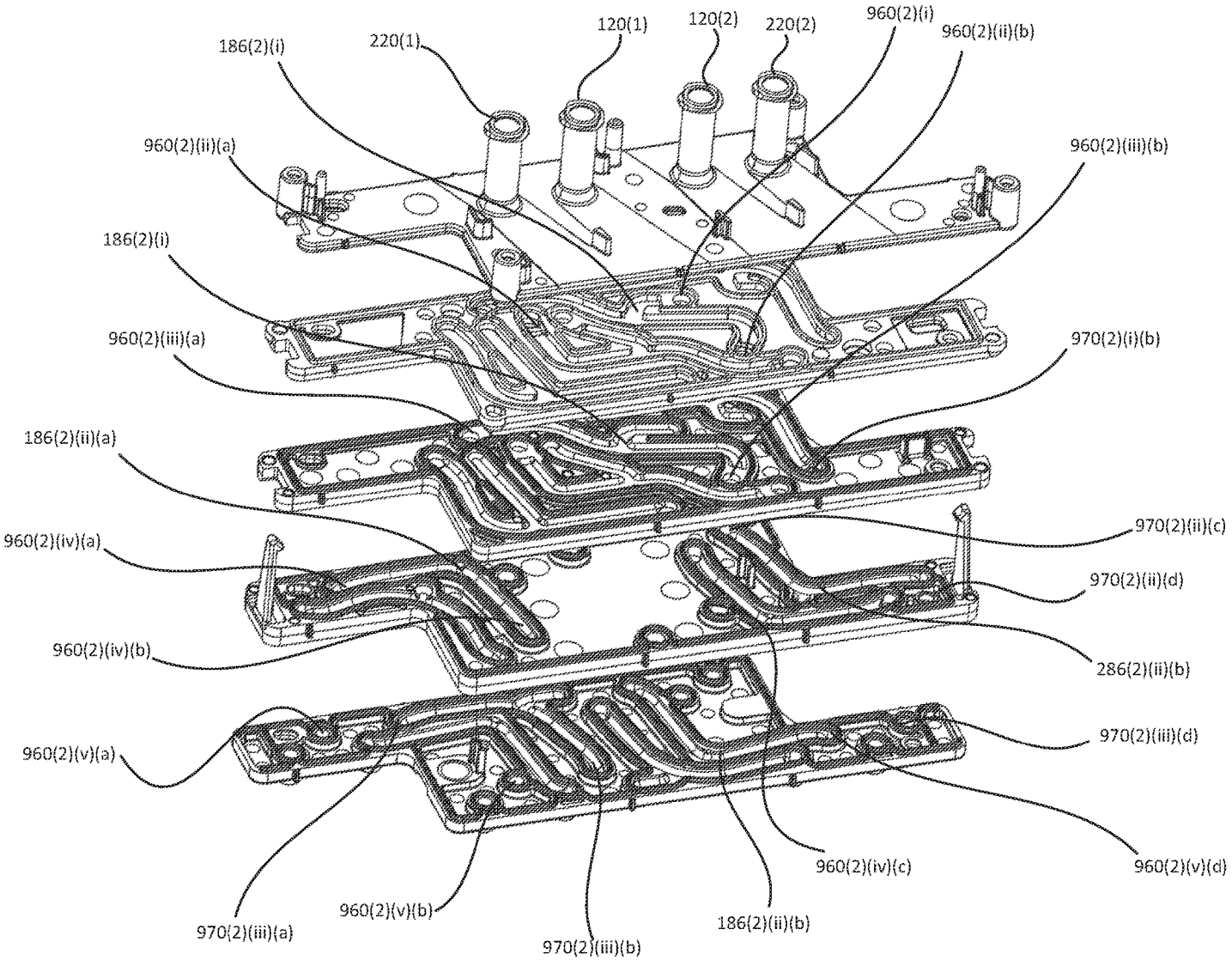
FIG. 8C is a further exploded perspective view of the upper manifold component of FIG. 4 that indicates the features which provide branched inlet and outlet paths for a second type of fluid.

As may be seen from FIGS. 8B and 8C, which are further exploded perspective views of the upper manifold component 100 of FIG. 4, each layer of the upper manifold component 100 includes one or more through-holes 960, 970. Adjacent layers, once combined, define one or more curved fluid paths therebetween, whereby each of the through-holes 960, 970 allows fluid to pass from a curved path in one plane to a curved path in the consecutive plane. As will now be described with reference to FIGS. 8B and 8C, the curved paths and the paths defined by the through-holes 960, 970 combine to provide branched inlet and branched outlet paths within the upper manifold component 100.

In more detail, FIG. 8B illustrates the through-holes 960(1), 970(1) and branching points 186(1) that correspond to a branched inlet path 180(1) and a branched outlet path 280(1) (where 960 and 970 indicate through-holes that define part of, respectively, a branched inlet path 180 and a branched outlet path 280) for a supplying a first droplet fluid type (as indicated by the suffix (1)). FIG. 8C, by contrast, illustrates the through-holes 960(2), 970(2) and branching points 186(2) that correspond to a branched inlet path 180(2) and a branched outlet path 280(2) for a supplying a second droplet fluid type (as indicated by the suffix (2)).

Figure 9A:
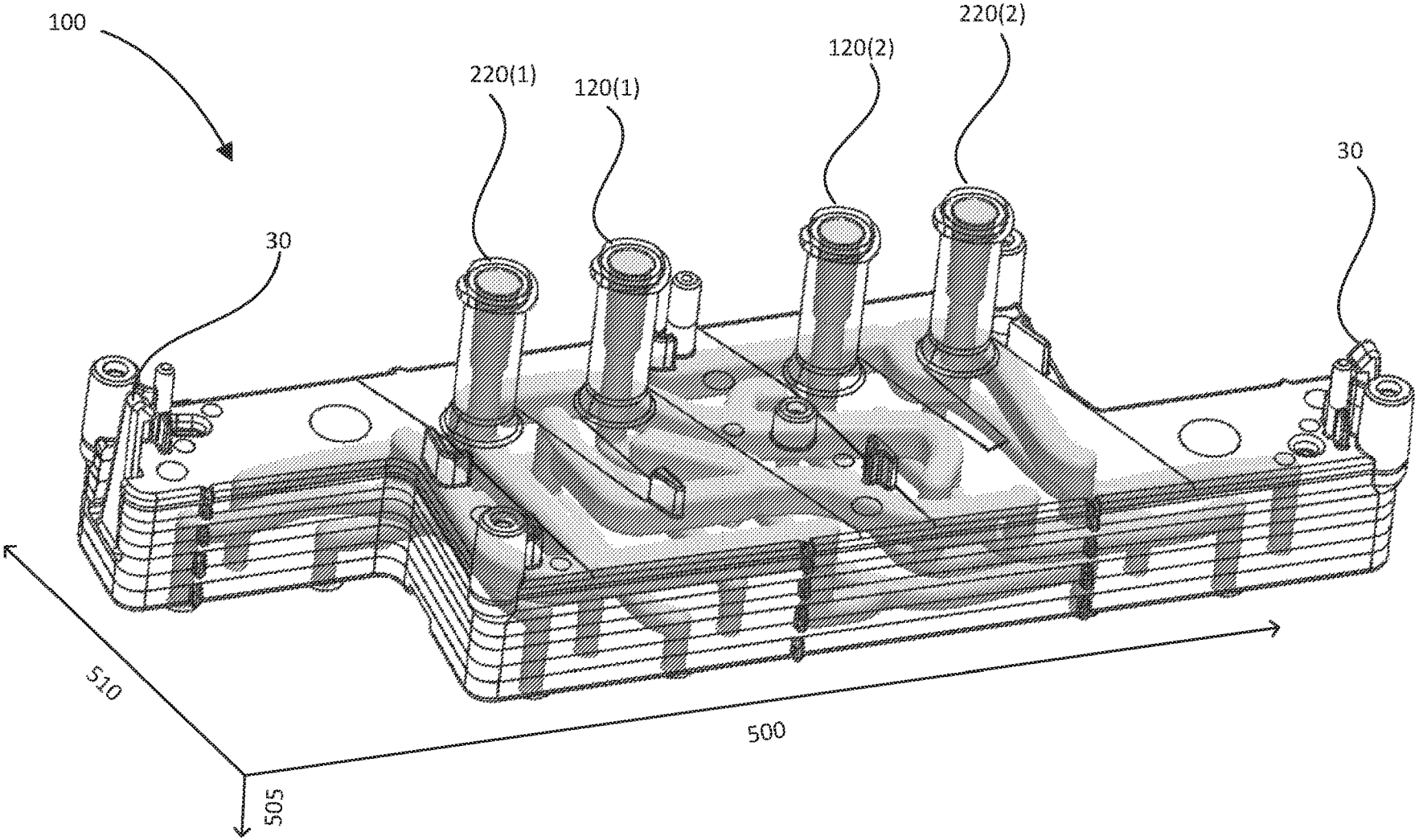
FIG. 9A is a partially exposed perspective view of the upper manifold component of FIG. 4.
Figure 9B:
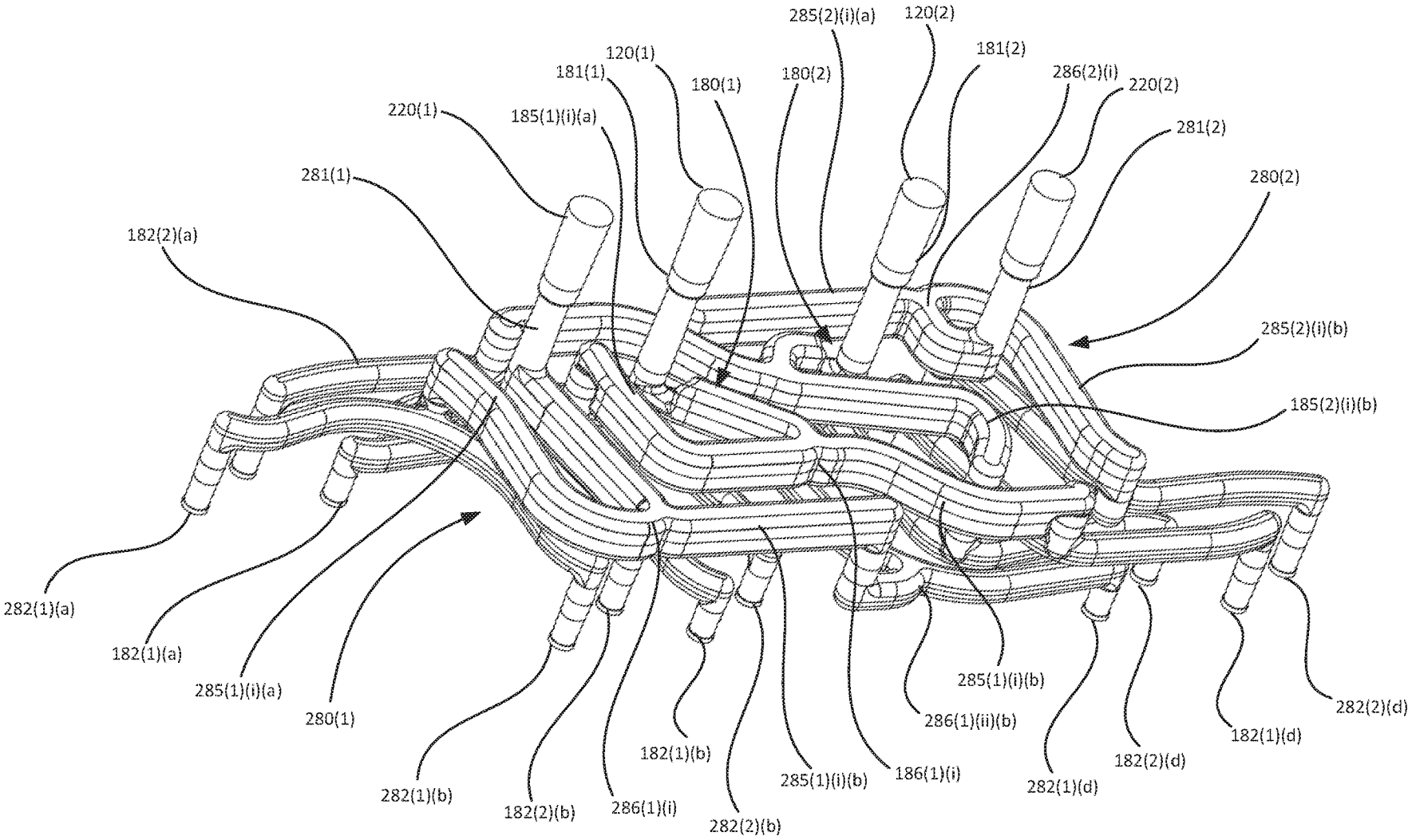
FIG. 9B is a perspective view of the fluid flow paths formed in the upper manifold component of FIG. 4.
Figure 9C:
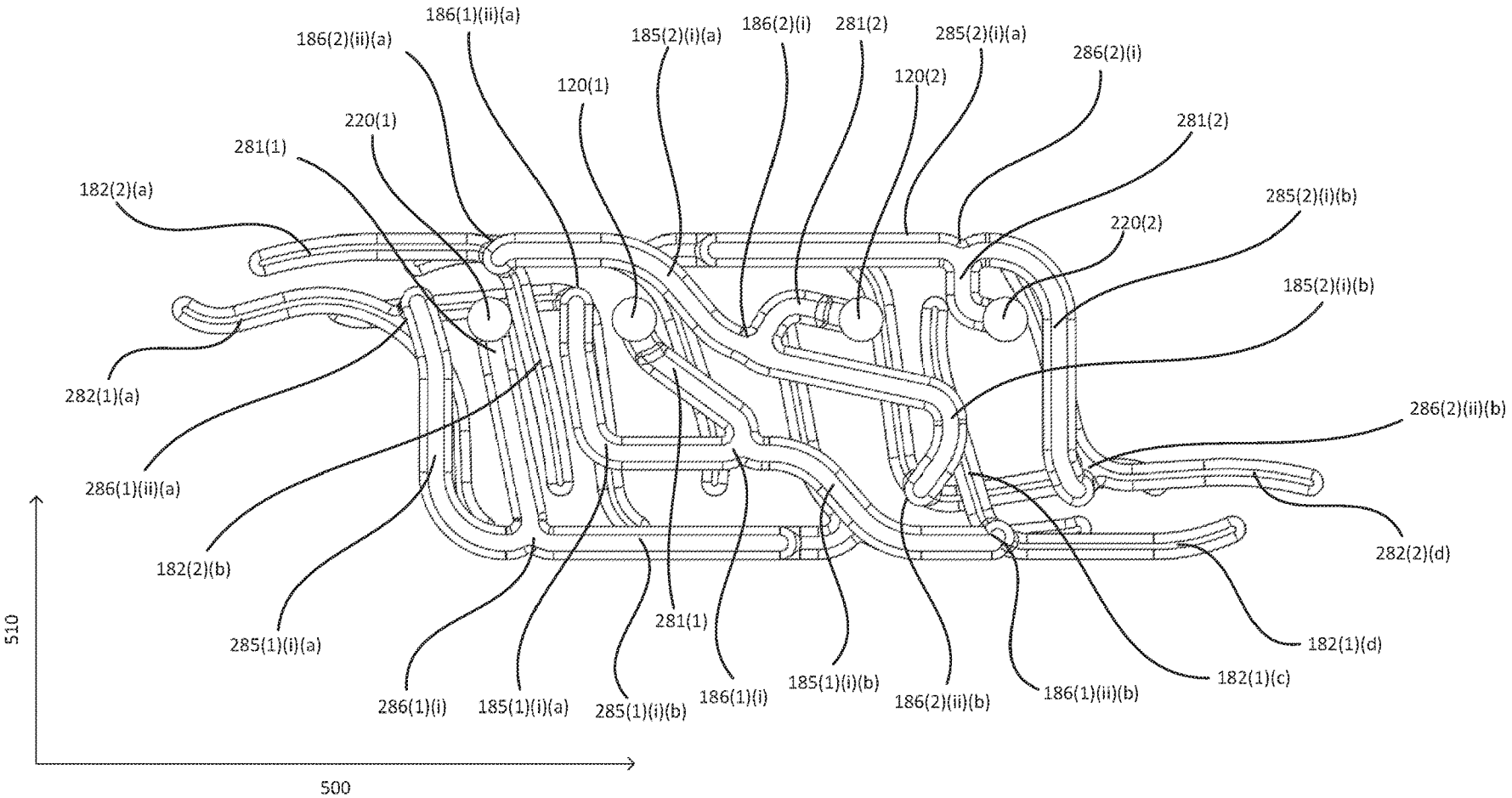
FIG. 9C is a top view of the fluid flow paths in the upper manifold component of FIG. 4.

FIGS. 8B and 8C may be compared with FIGS. 9B and 9C, which illustrate, in respective elevations, the two branched inlet paths 180(1), 180(2) (one for each type of fluid) and the two branched outlet paths 280(1), 280(2) (again, one for each type of fluid) that are provided within the upper manifold component 100, once the layers 910-950 are assembled. FIG. 9B may in turn be compared with FIG. 9A, which is a partially exposed perspective view of the upper manifold component 100 and illustrates the relative disposition of the branched inlet and outlet paths 180, 280 within the assembled layers 910-950.

Returning now to FIG. 8B, the first type of fluid is supplied to the upper manifold component 100 by fluid inlet 120(1) formed in top layer 910. The fluid inlet 120(1) connects directly to a through-hole 960(1)(i) in the second, filter layer 920 (the suffix (i) indicating the level within the branching structure of the through-hole, with lower numbers indicating proximity to the main branch 181). The fluid inlet 120(1) and through-hole 960(1)(i) in the second, filter layer 920 define part of the main branch 181(1) of a branched inlet path 180(1) within the upper manifold component 100.

The through-hole 960(1)(i) then supplies fluid to one of a number of serpentine or curved paths defined by the first (top) 910 layer, second (filter) layer 920 and third layer 930 together. These curved paths lie in the same plane; specifically, they lie in generally the same plane as the filter 925, so that the filter 925 divides each of these curved paths along its length.

It should be noted that, in contrast to these curved paths, filter 925 does not extend across, or divide the through-holes 960(1)(i), 960(2)(i), 960(1)(ii)(a), 960(1)(ii)(b) in the filter layer 920 that correspond to the branched inlet paths 180(1), 180(2): these through-holes are free of filter 925. For example, the main branch 181(1), 181(2) of each of the branched inlet paths 180(1), 180(2) may pass through a respective hole in the filter 925. The effect of this will be discussed further below with reference to FIGS. 10 and 11.

As is apparent from FIG. 8B, fluid flows along a curved path leading from through-hole 960(1)(i) and defined by the first, second and third layers 910, 920, 930 to branching point 186(1)(i), from which two further curved paths extend. Each of these two further curved paths is defined by the first, second and third layers 910, 920, 930 and extends from branching point 186(1)(i) to a respective through-hole 960(1)(ii)(a), 960(1)(ii)(b). Each of the curved paths corresponds to part of a respective first-level sub-branch 185(1)(i)(a), 185(1)(i)(b) (where 185 indicates generally a sub-branch, with the suffix (i), as before, indicating the level within the branching structure, with lower numbers indicating proximity to the main branch 181, and (a), (b) etc.

indicating the particular sub-branch within the level in question). At branching point 186(1)(i) main branch 181(1) of branched inlet path 180(1) branches into the two first-level sub-branches 185(1)(i)(a), 185(1)(i)(b).

As will also be apparent from FIG. 8B, through-hole 960(1)(ii)(a) in the second, filter layer 920 connects directly with through-hole 960(1)(iii)(a) in the third layer 930; similarly, through-hole 960(1)(ii)(b) connects directly with through-hole 960(1)(iii)(b). However, whereas through-hole 960(1)(iii)(a) in the third layer 930 connects directly to through hole 960(1)(iv)(a) in the fourth layer 940, through-hole 960(1)(ii)(b) is fluidically connected to a curved path defined in a plane between the third and fourth layers 930, 940. More particularly, through-hole 960(1)(ii)(b) defines a path that meets the curved path at a junction part-way along its length. This junction thereby provides branching point 186(1)(ii)(b).

At this branching point 186(1)(ii)(b), first-level sub-branch 185(1)(i)(b) branches into two second-level sub-branches, which, as the branched path 180(1) includes only two levels of branching, are end sub-branches 182(1)(*c*), 182(1)(*d*) (where 182 indicates generally an end sub-branch, with (a), (b), (c) etc. indicating the particular end sub-branch).

The curved path that includes branching point 186(1)(ii)(b) is fluidically connected, at one end, to through-hole 960(1)(iv)(b) and, at the other end, to through-hole 960(1)(iv)(c), both formed in fourth layer 940. Through-hole 960(1)(iv)(b) is in turn directly connected to through-hole 960(1)(v)(c) in the fifth layer 950; similarly, through-hole 960(1)(iv)(c) is directly connected to through-hole 960(1)(v)(d) in the fifth layer 950. In this way, end sub-branches 182(1)(*c*), 182(1)(*d*) extend through the fourth and fifth layers 940, 950, thus enabling fluid to be supplied to respective lower manifold components 50(*c*), 50(*d*).

Returning now to through-hole 960(1)(ii)(a), as noted above this through-hole in the third layer 930 connects directly to through hole 960(1)(iv)(a) in the fourth layer 940. Thus, through-hole 960(1)(iii)(a) and through hole 960(1)(iv)(a) each define a path that forms a part of first-level sub-branch 185(1)(i)(a).

As is apparent from FIG. 8B, through-hole 960(1)(iv)(a) is fluidically connected to a curved path defined in a plane between the fourth and fifth layers 940, 950. More particularly, through-hole 960(1)(iv)(a) defines a path that meets this curved path at a junction part-way along its length. This junction thereby provides branching point 186(1)(ii)(a).

At this branching point 186(1)(ii)(a), first-level sub-branch 185(1)(i)(a) branches into two second-level sub-branches, which, as the branched path 180(1) includes only two levels of branching, are end sub-branches 182(1)(*a*), 182(1)(*b*).

The curved path that includes branching point 186(1)(i)(a) is fluidically connected, at one end, to through-hole 960(1)(v)(a) and, at the other end, to through-hole 960(1)(v)(b), both formed in fifth layer 940. In this way, end sub-branches 182(1)(*a*), 182(1)(*b*) extend through the fifth layer 950, thus enabling fluid to be supplied to respective lower manifold components 50(*a*), 50(*b*).

As will also be apparent from FIG. 8B, the branched outlet path 280(1) is similarly made up of curved paths in planes parallel to layers 910-950 that are linked by through-holes 970(1).

For example, through-holes 970(1)(iii)(a)-(d) in the fourth layer 940 each define a path that forms a part of a respective end sub-branch 282(1)(*a*)-(*d*) of the branched outlet path 280(1). Through-hole 970(iii)(a) connects directly to through-hole 970(1)(ii)(a), which is at one end of a curved path defined in a plane between the third and fourth layers 930, 940, whereas through-hole 970(iii)(b) connects directly to through-hole 970(1)(ii)(b), which is at the other end of the same curved path. Through-hole 970(1)(i)(a) in the third layer 930 defines a path that meets this curved path at a junction part-way along its length. This junction thereby provides branching point 286(1)(ii)(a).

At this branching point 286(1)(ii)(a), first-level sub-branch 285(1)(i)(a) branches into end sub-branch 282(1)(*a*) and end sub-branch 282(1)(*b*). End sub-branch 282(1)(*a*) is made up of the paths defined by through holes 970(1)(ii)(a) and 970(1)(iii)(a), as well as the portion of the curved path leading from through hole 970(1)(ii)(a) to branching point 286(1)(ii)(a). Similarly, end sub-branch 282(1)(*b*) is made up of the paths defined by through holes 970(1)(ii)(b) and 970(1)(iii)(b), as well as the portion of the curved path leading from through hole 970(1)(ii)(b) to branching point 286(1)(ii)(a).

As will be apparent from FIG. 8B, and FIGS. 9A-9C, branched outlet path 280(1) continues upwards through the layers 910-950 of the upper manifold component 100, to main branch 281(1), which is connected to fluid outlet 220(1).

Thus, at a general level, it will be understood that branched inlet path 180(1) is configured to receive the first type of fluid from the fluid supply system (via inlet 120(1)) and to supply it to each of the lower manifold components 50(*a*)-(*d*) via respective end sub-branches 182(1)(*a*)-(*d*). Similarly, branched outlet path 280(1) is configured to receive the first type of fluid from each of the lower manifold components 50(*a*)-(*d*) via respective end sub-branches 282(1)(*a*)-(*d*) and to return it to the fluid supply system (via outlet 220(1)).

As noted above, FIG. 8C illustrates in a similar manner to FIG. 8B the through-holes 960(2), 970(2) and branching points 186(2) that correspond to a branched inlet path 180(2) and a branched outlet path 280(2) for a supplying a second droplet fluid type. As will be apparent, branched inlet path 180(2) and branched outlet path 280(2) are similarly made up of curved paths in planes parallel to layers 910-950 that are linked by through-holes 960(2), 970(2). Therefore, the specific connections shall not be discussed here in detail.

However, it will be understood that, at a general level, branched inlet path 180(2) is configured to receive the first type of fluid from the fluid supply system (via inlet 120(2)) and to supply it to each of the lower manifold components 50(*a*)-(*d*) via respective end sub-branches 182(2)(*a*)-(*d*). Similarly, branched outlet path 280(1) is configured to receive the first type of fluid from each of the lower manifold components 50(*a*)-(*d*) via respective end sub-branches 282(2)(*a*)-(*d*) and to return it to the fluid supply system (via outlet 220(1)).

Therefore, the branched inlet paths 180 and the branched outlet paths 280 combine to supply each type of fluid to all of the lower manifold components 50(*a*)-(*d*) and to receive each type of fluid from all of the lower manifold components 50(*a*)-(*d*).

Turning now to FIG. 9C, which is a top view of the fluid flow paths in the upper manifold component of FIG. 4, the arrangement of the branched inlet and outlet paths 180, 280 may be seen clearly. More particularly, it is apparent that each branched path 180, 280 overlaps with the other branched paths 180, 280 in the array direction 500 and the depth direction 505, as well as the ejection direction 510.

More subtly, the branched paths 180, 280 may be described as having footprints that overlap, when viewed from the ejection direction 505. More particularly, the footprint for a branched path 180, 280 may be defined as a polygon that lies in a plane normal to the ejection direction 505 and that bounds the outermost (in the array and depth directions 500, 505) end sub-branches. Put differently, each end sub-branch corresponds to a vertex of the polygon. This may assist in supplying a number of different types of fluid to respective groups of arrays of fluid chambers 150, where arrays within each group are distributed over the array direction 500 and the depth direction 505.

It is also apparent from FIGS. 9B and 9C that the branched paths 180, 280 are intertwined with each other. Thus, when viewed in the ejection direction (as in FIG. 9C) sub-branches 182, 185 of one branched path 180, 280 cross sub-branches of other branched paths 180, 280.

More subtly, a first sub-branch 182, 185 of a first branched path 180, 280 may cross a first sub-branch 182, 185 of a second branched path 180, 280 on one side with respect to the ejection direction, whereas a second sub-branch 182, 185 of the first branched path 180, 280 may cross a second sub-branch 182, 185 of the second branched path 180, 280 on the other side with respect to the ejection direction. An example of this is provided by branched paths 180(1) and 280(1) in FIGS. 9B and 9C: first level sub-branch 185(1)(i)(b) of branched inlet path 180(1) crosses end sub-branch 282(1)(*c*) of branched outlet path 280(1) above it, whereas end sub-branch 182(1)(*a*) of branched inlet path 180(1) crosses end sub-branch 282(1)(*a*) of branched outlet path 280(1) below it.

Such features may assist in providing a compact structure (in the array and depth directions 500, 505) that is able to supply a number of different types of fluid to respective groups of arrays of fluid chambers 150.

Details of the routing of fluid through the filter 925 by the branched inlet paths will now be described in further detail with reference to FIGS. 10A, 10B and 11.

Figure 10A:
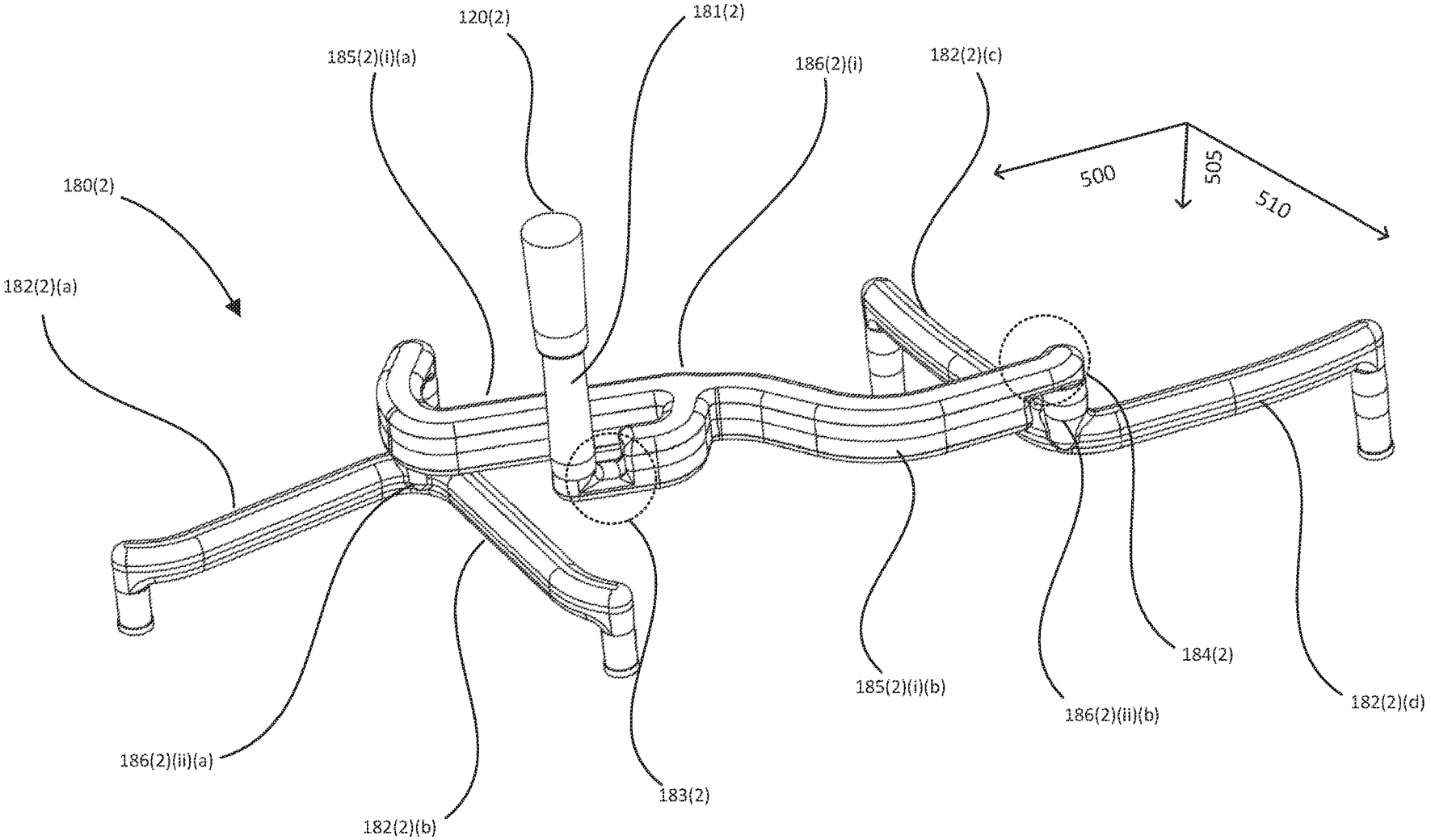
FIG. 10A is a perspective view of one of the branched inlet paths shown in FIGS. 9A-8C.

FIG. 10A is a perspective view of the branched inlet path 180(2) for the second fluid type. The overall structure of this branched inlet path 180(2) is clearly shown by the drawing: the branched inlet path 180(2) originates at a main branch 181(2), which is connected to fluid inlet 120(2), and then branches, at branching point 186(2)(i), into two first-level sub-branches 185(2)(i)(a). 185(2)(i)(b). Each of these first-level sub-branches 185(2)(i)(a). 185(2)(i)(b) in turn branches, at a respective branching point 186(2)(ii)(a), 188(2)(ii)(b), into two corresponding second-level sub-branches. As the branched inlet path 180(2) has only two levels of branching these second-level sub-branches are end sub-branches 182(2)(*a*). As discussed above, each of these end sub-branches 182(2)(*a*) supplies fluid (of the second type) to a respective one of the lower manifold components 50(*a*)-(*d*).

Figure 10B:
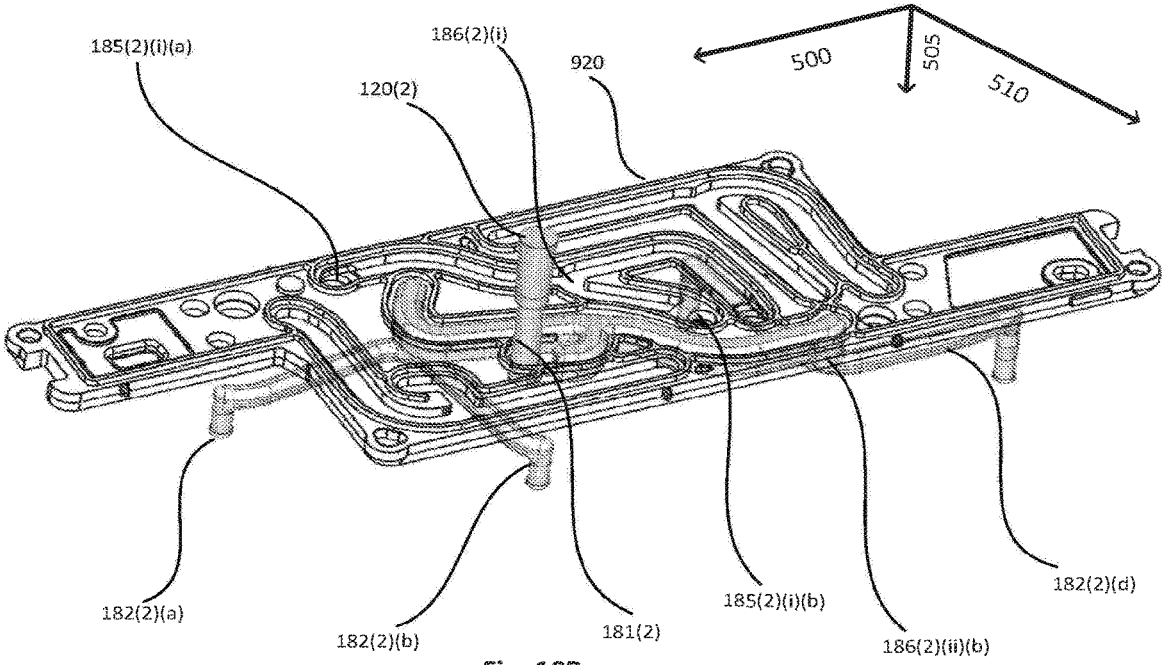
FIG. 10B is a perspective view of the branched inlet path of FIG. 10A showing the disposition of the flow path relative to one of the layers of the upper manifold component.

FIG. 10B is a perspective view of the branched inlet path of FIG. 10A showing the disposition of the flow path relative to the filter layer 920 of the upper manifold component 100. As is apparent from FIG. 10B, the filter 925 cuts across the two first-level sub-branches 185(2)(i)(a), 185(2)(i)(b). In the specific arrangement shown, the filter 925 may be described as generally dividing each of the two first-level sub-branches 185(2)(i)(a), 185(2)(i)(b) along its length.

In addition, the filter cuts across a portion of the main branch 181(2). More particularly, the filter cuts across a portion of the main branch that connects to the branching point 186(2)(i).

However, as noted above, filter 925 does not extend across, or divide the through-holes 960(1)(i), 960(2)(i). 960(1)(ii)(a), 960(1)(ii)(b) in the filter layer 920 that correspond to the branched inlet paths 180(1), 180(2); these through-holes are free of filter 925. For example, the main branch 181(1), 181(2) of each of the branched inlet paths 180(1), 180(2) may pass through a respective hole in the filter 925.

As shown in FIG. 10A, the main branch 181(2) proceeds through through-hole 960(2)(i) to a space defined between the second, filter layer 920 and the third layer 930. This space provides a narrowed portion 183(2) of the main branch 181(2). Beyond this narrowed portion 183(2) of the main branch 181(2), the main branch 181(2) widens to a portion where it is defined by the first, second (filter) and third layers 910, 920, 930. This portion of the main branch 181(2) is divided along its length by filter 925 and leads to branching point 186(2)(i). Depending on the particular arrangement, a possible consequence of a filter dividing a portion of a main branch of a branched path along its length is that filtering occurs over a large surface area.

As noted above, at branching point 186(2)(i) the main branch 181(2) branches into two first-level sub-branches 185(2)(i)(a), 185(2)(i)(b). The portion of each of these first-level sub-branches 185(2)(i)(a), 185(2)(i)(b) that leads from branching point 186(2)(i) is defined by the first, second (filter) and third layers 910, 920, 930. This same portion of each first-level sub-branch 185(2)(i)(a), 185(2)(i)(b) is divided along its length by filter 925. As with the main branch, a possible consequence of a filter dividing a portion of a sub-branch of a branched path along its length is that filtering occurs over a large surface area.

Further, this portion leads to a narrowed portion of the same first-level sub-branch 185(2)(i)(a), 185(2)(i)(b) that is defined by just the second, filter layer 920 and the third layer 930—though not by the filter 925 of the filter layer 920. Each first-level sub-branch 185(2)(i)(a), 185(2)(i)(b) then proceeds through a respective through-hole in the second layer 960(2)(ii)(a), 960(2)(ii)(b) and a respective through-hole in the third layers 960(2)(iii)(a), 960(2)(iii)(b)

Figure 11:
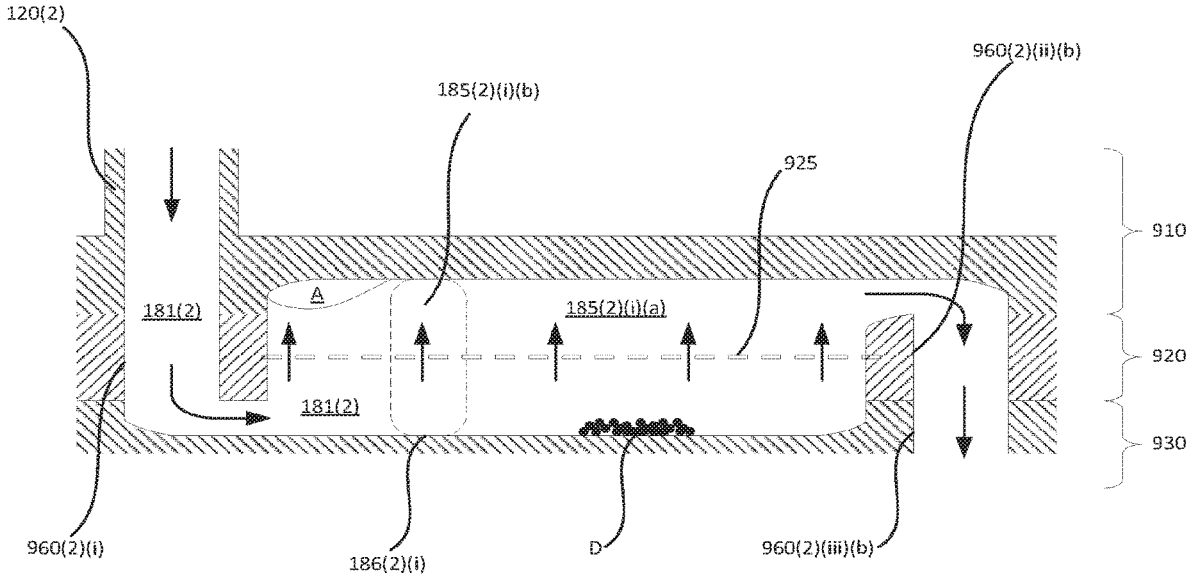
FIG. 11 is an example cross-section through a fluid flow path showing first and second curved paths and respective first and second through-holes.

The flow of fluid through the filter is illustrated in FIG. 11, which is a schematic view of a cross-section through the upper manifold component 100 that is taken along a curved path, which follows the length of the main branch 181(2) from through-hole 960(2)(i), through branching point 186(2)(i), and then follows the length of sub-branch 185(2)(*b*) to through-hole 960(2)(ii). As may be seen, FIG. 11 illustrates clearly the first, second (filter) and third layers 910-930 of the upper manifold component 100.

As may be seen, fluid flows downwards along the main branch 181(2) from the fluid inlet 120(2). The fluid then turns and flows horizontally through the narrowed portion 183(2) of the main branch and then into the wider portion of main branch 181(2) that leads to branching point 186(2)(i). This wider portion of the main branch 181(2) is divided by filter 925. Fluid flows from one side of the filter 925 to the other in this wider portion of the main branch 181(2). More particularly, in this wider portion of the main branch, the fluid adjacent to the filter 925 is flowing perpendicularly to the plane of the filter 925. As a result, when the head is arranged so that the ejection direction 505 is vertically downwards, i.e. in the same direction as gravity, fluid flows vertically—against gravity—through the filter 925 within this wider portion of the main branch 181(2).

At branching point 186(2)(i) the flow splits, with a portion of the flow proceeding along sub-branch 185(2)(i)(a) and the remainder flowing along sub-branch 185(2)(i)(b) (it being noted that, in the specific example shown in FIGS. 4, 5, and 8-10 the sub-branches 182, 185 of the branched paths 180(1), 180(2) are configured such that a substantially even split in flow occurs at each branching point 186).

The portion of each sub-branch 185(2)(i)(a), 185(2)(i)(b) that leads from the branching point 186(2)(i) to the narrower portion 184(2) thereof is divided by filter 925. Fluid flows from one side of the filter 925 to the other within this portion of each sub-branch 185(2)(i)(a), 185(2)(i)(b). More particularly, within this portion of each sub-branch 185(2)(i)(a), 185(2)(i)(b), the fluid adjacent to the filter 925 is flowing perpendicularly to the plane of the filter 925. As a result, when the head is arranged so that the ejection direction 505 is vertically downwards, fluid flows vertically—against gravity—through the filter 925 within this portion of each sub-branch 185(2)(i)(a), 185(2)(i)(b).

Where fluid flows against gravity through the filter 925, detritus D that is filtered from the fluid may, when it sinks within the fluid, naturally tend to move away from the filter 925. This may reduce instances of the detritus D blocking the filter. For example, if fluid flowed vertically downwards through the filter 925, detritus could settle on the filter and, over time, reduce the effectiveness of the filtering.

Also as a result of the fluid flowing against gravity through the filter 925, air bubbles are forced through the filter 925 and collect above the filter 925 as a small pocket of air A. Having the air A collect on the far side of the filter 925 in this way may allow efficient use to be made of the area of the filter 925. For example, if fluid flowed vertically downwards through the filter 925, the air could collect in pockets above the filter 925 that might impede the spreading of fluid over the surface of the filter 925.

On the other hand, it should be noted that the head 10 will nonetheless function when arranged such that the ejection direction 505 is not vertically downwards. Moreover, substantially the same flow patterns as illustrated in FIG. 11 and as described above (aside from references to fluid flowing against gravity) may be expected. However, in such cases, detritus D and/or air A may not collect in the same manner as illustrated in FIG. 11.

It should be appreciated that, in the upper manifold component 100 of FIGS. 4, 5, 8 and 9, the branched path 180(1) for the first type of droplet fluid has a substantially similar structure, with its main branch 181(1) including a similar narrowed portion defined between the second and third layers and its first-level sub-branches 185(1)(i)(a), 185(1)(i)(b) also including similar narrowed portions defined between the first and second layers. Further, when the head 10 is arranged such that the ejection direction 505 is vertically downwards (i.e. in the same direction as gravity) the branched path 180(1) for the first type of droplet fluid is similarly arranged so that fluid flows against gravity through the filter 925.

It should be noted that the upper manifold component 100 of FIGS. 4, 5, and 8-11 is only an example of a droplet deposition head where a branched path directs fluid against gravity through a filter and that other arrangements that operate according to the same principle are possible. For example, other droplet deposition heads may be constructed such that a filter does not divide a main branch and/or a sub-branch of a branched path along its/their lengths (though as noted above this may allow filtering to occur over a large area).

Conversely, it should be noted that other arrangements are possible where a filter divides a main branch and/or one or more sub-branches of a branched path along its/their lengths, but where the branched path is not arranged so as to direct fluid against gravity through the filter.

It should still further be noted that, in some examples, the filter 925 may be omitted. For instance, sufficient filtering of the droplet fluid may have taken place in the fluid supply system before it reaches the head 10.

From this description, it should be understood that forming (at least in part) manifold components, such as the upper manifold component 100, from a number of layers that each extend normal to the ejection direction (so that the layers, as a whole, may be described as being stacked in the ejection direction) may enable relatively complex branched path arrangements to be provided in a relatively straightforward manner. Moreover, the thus-manufactured manifold component may be relatively compact in the ejection direction 505.

Further, because each layer may be manufactured separately, a complex three-dimensional structure for each branched inlet 180 or outlet 280 path can be more accurately manufactured, ensuring, for instance, that fluid is provided to each end sub-branch 182 within the branched path 180, 280 with balanced flow characteristics. For instance fluid may be supplied with substantially balanced pressures, and/or with balanced flow rates and/or with balanced velocities, to each of the end sub-branches 182. This may assist in ensuring that fluid is provided to the chambers within the arrays 150 of the head with balanced flow characteristics. For instance fluid may be supplied with substantially balanced pressures, and/or with balanced flow rates and/or with balanced velocities, to each of the fluid chambers of the head.

As will be seen from FIGS. 8 to 11, the layout of the branched inlet 180 and outlet paths 280 and sub-branches 20, 32 is carefully designed so that the paths are intertwined with each other.

Making the upper manifold component 100 out of a plurality of layers may reduce the complexity of providing such a structure. For example, it may be relatively straightforward to provide in each of a plurality of planes parallel to such layers, a fairly complex pattern of multiple curved, serpentine paths, each of which corresponds to one or more sub-branches within a particular branched path. These curved paths may be formed between adjacent layers, or between three, four or more consecutive layers. These curved paths may be shaped to curve around each other, while being suitably offset from each other to enable proper fluidic sealing of each path. As discussed above, these paths may additionally or instead be suitably shaped so as to provide desirable fluidic properties, such as balancing the flow rate, pressure etc. of sub-branches of the same level within a branched inlet or outlet path.

By then providing through-holes (through the layers of the manifold component, such as upper manifold component 100), which link these complex patterns of curved paths together, branched paths with complex, intertwining geometry and suitable control of fluidic properties may be provided in a relatively straightforward manner. Further, because much of the complexity of the structure is provided in planes parallel to the layers of the manifold component, the manifold component may have such beneficial properties while still being relatively compact in the direction in which the layers are stacked. Thus, where the layers extend perpendicularly to the ejection direction, as in the droplet deposition head shown in FIG. 4, the manifold component may be relatively compact in the ejection direction 505. As noted above, this may simplify the integration of the droplet deposition head 10 within a larger droplet deposition apparatus.

It is envisaged that constructions that do not specifically include an upper manifold component may be provided that nonetheless include multiple layers, which provide, in each of a number of planes parallel to the layers, multiple curved fluid paths, and a number of fluid paths perpendicular to the layers that fluidically connect together curved paths in different planes. As discussed above these perpendicular and curved paths may provide complex branched inlet and/or outlet paths in a manner that is straightforward to manufacture.

On the other hand, it should be appreciated that this is only an example of a way of providing such intertwined branched paths and that such intertwined branched paths may be formed in any suitable manner.

It is envisaged that the manifold components described herein, including those discussed above with reference to FIGS. 1-12, may be formed by moulding, for instance by injection moulding. For example, where a manifold component is made up of a number of stacked layers, each layer may be moulded as a separate part, with these parts then assembled together.

The manifold component(s) may therefore (or otherwise) be formed substantially from polymeric materials and/or plastic materials. Factors that may be taken into account when selecting an appropriate material for the manifold components include:

- Chemical compatibility with the droplet fluid (particularly where it is desired that the droplet fluid be heated prior to ejection);
- Little difference in coefficient of thermal expansion as compared with components that the manifold component is attached to, such as the actuator component (which may reduce stress in the connections, such as glue bonds, between components), or as compared with layers within the manifold components formed of different materials (e.g. non-polymeric materials), for example as described above with reference to the carrier layer 76, in the case where this is formed from ceramic material;
- Mechanical stability, for example so that the geometry of each moulded part is maintained following moulding (e.g. a planar part remains flat);
- Adhesion/cure rates to any adhesive used to connect the parts of a manifold component together, or to connect the manifold components together;

Suitable materials may include injectable thermoplastics, of which a number of examples are known, such as polystyrene, polyethylene, polyetherketone (PEK), polyetheretherketone (PEEK), or polyphenylene sulphide (PPS). However, injectable thermosetting materials may also be appropriate in some circumstances.

To achieve the desired performance, an engineering plastic or high performance plastic may be used, such as PPS, PEK, PEEK, etc.

In addition, the use of filled polymeric materials may be desirable in some cases owing to their generally greater mechanical strength and thermal resistance. For instance, a glass, mineral and/or ceramic filled polymeric material might be used, depending on the particular design of the component; the filler may suitably be a fibrous material, such as glass, mineral and/or ceramic fibres. Filling may also aid in achieving a particular coefficient of thermal expansion (CTE) for the component, for example where efforts are being made to reduce the difference in CTE between the manifold component and components attached thereto.

The alignment of the arrays 150 belonging to the various groups and lower manifold components 50(*a*)-(*d*) of the droplet deposition head 10 of FIG. 4 will now be described with reference to FIG. 12, which is a schematic end view of the lower manifold components of FIG. 4.

The four lower manifold components 50(*a*)-(*d*) are shown clearly in the drawing. In the specific example illustrated, two groups of arrays are provided: a first group configured to eject droplets of a first type of fluid from corresponding nozzles 155(1); and a second group configured to eject droplets of a first type of fluid from corresponding nozzles 155(2). However, further groups of nozzles could be provided in other constructions.

As may be seen, the arrays 150 belonging to each lower manifold component 50 and their corresponding nozzles 155 are arranged in substantially the same manner as described above with reference to FIG. 6B. Accordingly, two pairs of nozzle rows 155(1)(i)-(ii) and 155(2)(i)-(ii) are provided for each lower manifold component 50 (each nozzle row 155 corresponding to a respective array 150). The first pair of nozzle rows 155(1)(i)-(ii) belongs to the first group and therefore is configured for ejection of a first type of droplet fluid; the second pair of nozzle rows 155(2)(i)-(ii) belongs to the second group and therefore is configured for ejection of the second type of droplet fluid. The nozzle rows 155 within a pair are located adjacent one another, as are the corresponding arrays of fluid chambers.

Each pair of arrays may, for example, be provided by a single actuator component, though in other constructions each array could be provided by a separate actuator component, or all of the arrays for a lower manifold component could be provided by the same actuator component.

Further, for arrays corresponding to a particular one of the lower manifold components 50(*a*)-(*d*), each array 150 in a first group is aligned in the array direction 500 with a respective array 150 in the second group. This is apparent, for example, from the alignment of nozzle row 155(1)(*a*)(ii) with nozzle row 155(2)(*a*)(ii). In this way, as the deposition medium is indexed past the droplet deposition head 10, each portion of its width in the array direction 500 is addressed by an array 150 from every group within a lower manifold component 50(*a*)-(*d*).

Furthermore, arrays 150 that correspond to the same lower manifold component 50 and to the same group are offset from each other in the array direction 500 by a small amount 502. This is apparent, for example, from considering nozzle row 155(1)(*a*)(i) and nozzle row 155(2)(*a*)(ii).

As discussed above, this offset may, for example, be of the order of the nozzle spacing 501 for each array. The offset could, for example be approximately 1/N times the nozzle spacing 501, where N is the number of arrays within the same group that correspond to the same lower manifold component (or, potentially, M+I/N times the nozzle spacing, where M is an integer); in the example shown in FIG. 12, N=2. Hence, or otherwise, the nozzles of the N arrays may together provide an array of nozzles with spacing 1/N, when viewed in a depth direction 505, perpendicular to the array direction 500 and the ejection direction 510. As also discussed above, the nozzles 155 from the N arrays may accordingly be interleaved with respect to the array direction 500, as shown in FIG. 6B. Thus, the multiple arrays may provide the printhead with a higher resolution than a single array.

Figure 12:
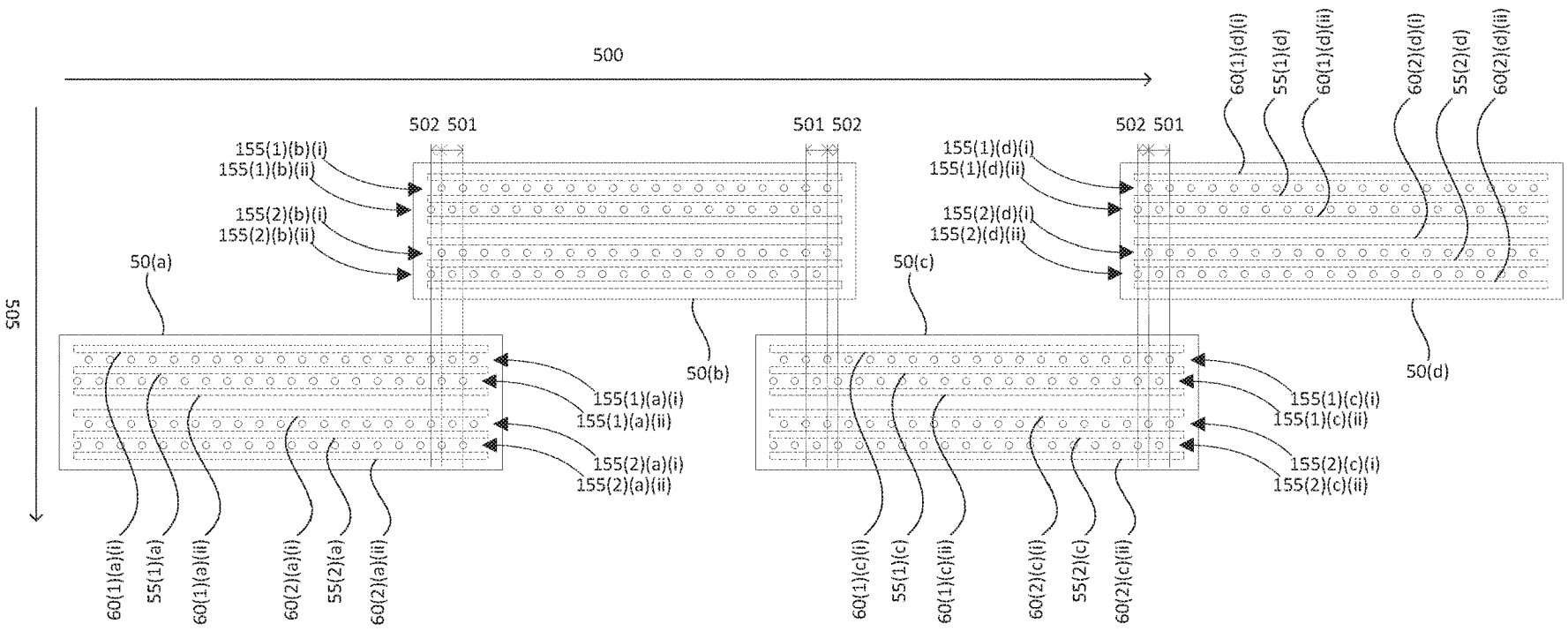
FIG. 12 is a schematic end view of the lower manifold components of FIG. 4.

As may also be seen from FIG. 12, a nozzle row belonging to one group is aligned in the depth direction 505 with a nozzle row within the same group, but corresponding to a different lower manifold component (for instance such that the nozzles of the two rows generally lie on a single line). For example, nozzle row 155(1)(*b*)(i), which corresponds to the first group and to lower manifold component 50(*b*), is aligned in the depth direction 505 with nozzle row 155(1) (*d*)(i), which also corresponds to the first group, but corresponds to lower manifold component 50(*d*). It will be appreciated that the corresponding arrays of chambers 150 are similarly arranged.

As a result such arrangement of multiple arrays 150 corresponding the same group but different lower manifold components, the multiple arrays address a width, in the array direction 500, that is significantly greater than the length of a single array in the array direction—and address this width with a higher resolution than a single array.

While in the constructions described with reference to FIGS. 1-11 above the branching paths have branched into two sub-branches at each branching point, it should be appreciated that they could branch into any suitable number of sub-branches, such as three, four, or more sub-branches.

While the droplet deposition heads described above with reference to FIGS. 1-11 have at most two levels of branching, it should be appreciated that other constructions might have any suitable number of branching levels.

It should also be noted that, while in the constructions described with reference to FIGS. 1-11 above the end sub-branches have been of the same level in the branching structure, in other constructions the end sub-branches could belong to different levels; for example, some end-sub-branches could belong to the first level, whereas others could belong to the second level. Nonetheless, having end-sub-branches of the same level in the branching structure may simplify shaping the branched path so as to provide desirable fluidic properties (such as balancing the flow rate, pressure etc.) of the fluid in the end-sub-branches.

It should still further be noted that, while the droplet deposition head of FIGS. 4 to 12B has been described as being configured for use with two different types of droplet fluid, it could of course be utilised—in some cases without modification—with only one type of fluid. In such a situation, a point on the deposition medium may be addressed by two fluid chambers from respective arrays. Thus, such an arrangement may allow for the single fluid to be deposited in greater volumes.

It will be appreciated that the various features of the manifold components described above may be implemented with a wide range of designs for the component(s) that provide the arrays of fluid chambers. However, purely by way of example, a suitable structure for an actuator component that provides an array of fluid chambers, where each chamber is provided with a respective actuating element and a respective nozzle, and where each actuating element is actuable to eject a droplet of fluid, shall now be described with reference to FIGS. 13A and 13B.

Figure 13A:
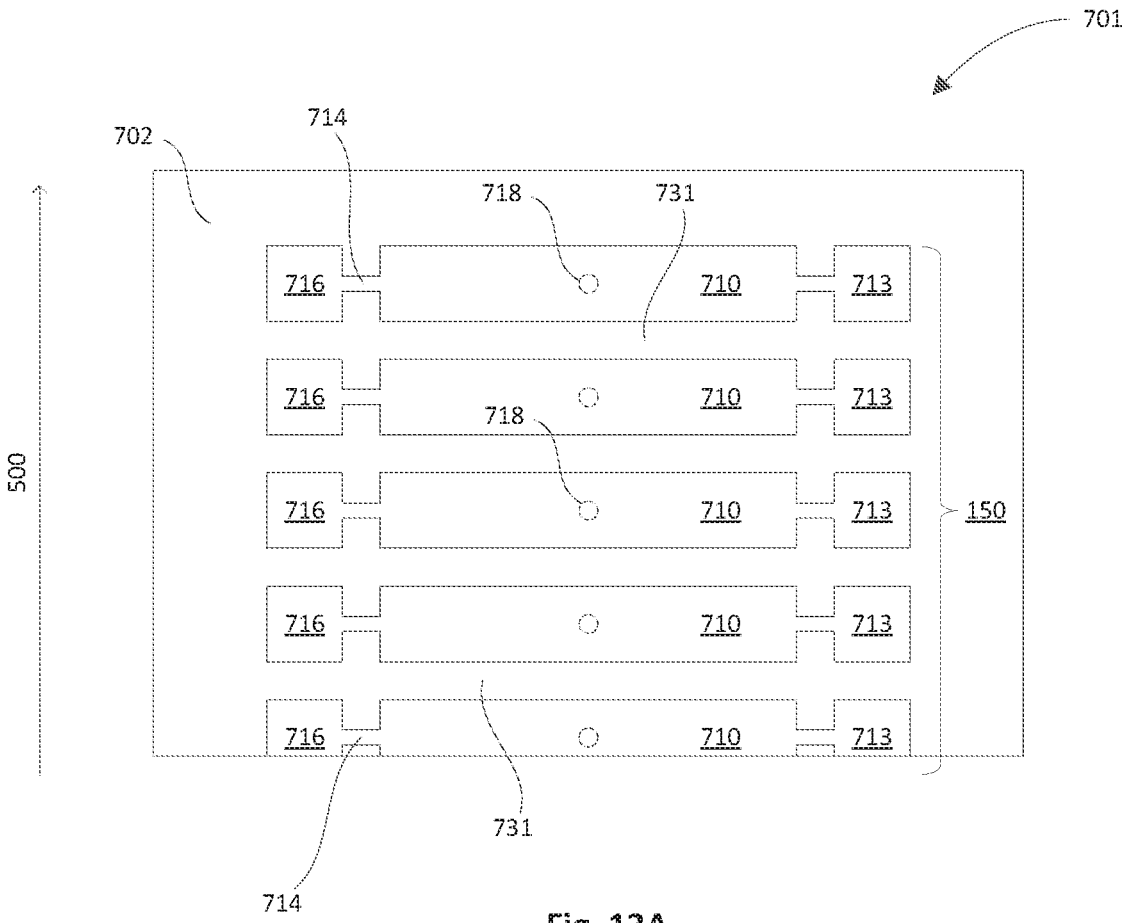
FIG. 13A is a cross-section through an example of an actuator component, which provides an array of fluid chambers.

FIG. 13A shows a cross-section through such an actuator component 701, with the view being taken along the ejection direction. More particularly, as indicated by the dashed line in FIG. 13B, the cross-section show in FIG. 13A is taken in a plane that passes through each of the fluid chambers 710 within the array 150.

Figure 13B:
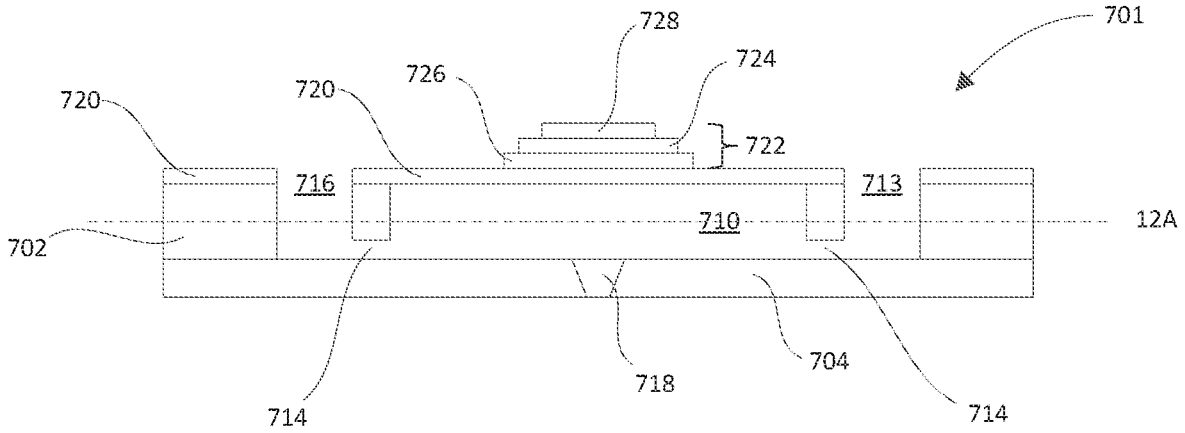
FIG. 13B is a further cross-section through the actuator component of FIG. 13A, the view being taken in the direction of the array of fluid chambers.

The actuator component 701 of FIGS. 13A and 13B is a thin film piezoceramic actuator and comprises a die stack. The die stack 701 comprises a fluid chamber substrate 702 and a nozzle layer 704, which includes nozzles 718. As also shown in FIGS. 13A and 13B, the actuator component 701 comprises an array 150 of fluid chambers 710, which are arranged side-by-side in an array direction 500. As will be apparent, each fluid chamber is elongate in a direction perpendicular to the array direction 500. In addition, neighbouring chambers within the array 150 are separated, one from the next, by partition walls 731.

As may be seen from FIG. 13A, each of the fluid chambers 710 has a fluidic inlet port 713 in fluidic communication therewith.

As may be seen from FIG. 13B, the fluidic inlet port 713 is provided at a top surface of the fluidic chamber substrate 702 towards one end of the fluidic chamber 710 along a length thereof.

During use, droplet fluid is supplied to the fluidic chamber 710 from the fluidic inlet port 713. Hence, the inlet port 713 is fluidically connected so as to receive fluid from a widening inlet chamber 55.

The actuator component 701 further includes a fluidic channel 714 provided within the fluidic chamber substrate 702 in fluidic communication with the fluidic chamber 710, and arranged to provide a path for droplet fluid to flow therebetween.

Furthermore, the actuator component 701 includes a fluidic outlet port 716 in fluidic communication with the fluidic chamber 710, whereby ink may flow from the fluidic chamber 710 to the fluidic outlet port 716 via a fluidic channel 714 formed in the fluidic chamber substrate 702. The fluidic outlet port 716 may be fluidically connected so as to return fluid to a narrowing outlet chamber 60.

As shown in FIG. 13B, the fluidic outlet port 716 is provided at the top surface of the fluidic chamber substrate 702 towards an end of the fluidic chamber 710 opposite the end towards which the fluidic inlet port 713 is provided.

The actuator component 701 may be arranged to allow droplet fluid to flow continuously from the fluidic inlet port 713 to the fluidic outlet port 716, along the length of the fluidic chamber 710, for example when the upper manifold component 100 described above is connected to a fluid supply system. Thus, the actuator component 701 may be considered to operate in a recirculation mode or "through-flow" mode.

In alternative arrangements, fluid may be supplied to the fluidic chamber 710 from both fluidic ports 713 and 716 (for example two widening inlet chambers are provided in the lower manifold component 50 described above). In a further alternative, the fluidic outlet port 716 may be omitted such that substantially all of the ink supplied to the fluidic chamber 710 via fluidic inlet port 713 is ejected from the nozzle 718, whereby the inkjet printhead may be considered to operate in a non through-flow mode.

The fluidic chamber substrate 702 may comprise silicon (Si), and may, for example, be manufactured from a Si wafer, whilst the associated features, such as the fluidic chamber 710, fluidic inlet/outlet ports 713/716 and fluidic channels 714 may be formed using any suitable fabrication process, e.g. an etching process, such as deep reactive ion etching (DRIE) or chemical etching.

Additionally or alternatively, the associated features of the fluidic chamber substrate 702 may be formed from an additive process e.g. a chemical vapour deposition (CVD) technique (for example, plasma enhanced CVD (PECVD)), atomic layer deposition (ALD), or the features may be formed using a combination of removal and/or additive processes.

In the present example, the nozzle layer 704 is provided at a bottom surface of the fluidic chamber substrate 702, whereby "bottom" is taken to be a side of the fluidic chamber substrate 702 having the nozzle layer 704 thereon.

The surfaces of various features of the die 701 may be coated with protective or functional materials, such as, for example, a suitable coating of passivation material or wetting material.

The actuator component 701 further includes a nozzle 718 in fluidic communication with the fluidic chamber 710, whereby the nozzle 718 is formed in the nozzle layer 704 using any suitable process e.g. chemical etching, DRIE, laser ablation etc.

The actuator component 701 further includes a membrane 720, provided at the top surface of the fluidic chamber substrate 702, and arranged to cover the fluidic chamber 710. The top surface of the fluidic chamber substrate 702 is taken to be the surface of the fluidic chamber substrate 702 opposite the bottom surface.

The membrane 720 is deformable to generate pressure fluctuations in the fluidic chamber 710, so as to change the volume within the fluidic chamber 710, such that ink may be ejected from the fluidic chamber 710 via the nozzle 718, as a droplet.

The membrane 720 may comprise any suitable material, such as, for example a metal, an alloy, a dielectric material and/or a semiconductor material. Examples of suitable materials include silicon nitride ($Si_3N_4$), silicon dioxide ($SiO_2$), aluminium oxide ($Al_2O_3$), titanium dioxide ($TiO_2$), silicon (Si) or silicon carbide (SiC). The membrane 720 may additionally or alternatively comprise multiple layers.

The membrane 720 may be formed using any suitable processing technique, such as, for example, ALD, sputtering, electrochemical processes and/or a CVD technique. When the membrane 720 is provided on the top surface, apertures corresponding to the fluidic ports 713/716 may be provided in the membrane 720, e.g. using a suitable patterning technique for example during the formation of the membrane 720.

The droplet unit 6 further comprises an actuating element 722 provided on the membrane 720, which is arranged to deform the membrane 720, such that the inkjet printhead operates in roof mode.

However, any suitable type of actuator or electrode configuration capable of effecting droplet generation may be used, for example inkjet printheads operating in a shared-wall configuration, whereby the actuating elements are configured as actuable walls formed of piezoelectric material that separate adjacent fluid chambers within the array.

The actuating element 722 is a piezoelectric element 724 provided with two electrodes 726 and 728. The piezoelectric element 724 may, for example, comprise lead zirconate titanate (PZT), however any suitable material may be used.

An electrode is provided in the form of a lower electrode 726 on the membrane 720. The piezoelectric element 724 is provided on the lower electrode 726 using any suitable deposition technique. For example, a sol-gel deposition technique may be used to deposit successive layers of piezoelectric material to form the piezoelectric element 724 on the lower electrode 726, or the piezoelectric element 724 may be formed using any suitable technique.

A further electrode in the form of an upper electrode 728 is provided on the piezoelectric element 724 at the opposite side of the piezoelectric element 724 to the lower electrode 726, however any suitable configuration of the electrodes could be used.

The electrodes 726/728 may comprise any suitable material e.g. iridium (Ir), ruthenium (Ru), platinum (Pt), nickel (Ni) iridium oxide ($Ir_2O_3$), $Ir_2O_3$/Ir and/or gold (Au). The electrodes 726/728 may be formed using any suitable technique, such as a sputtering technique.

The electrodes 726/728 and the piezoelectric element 724 may be patterned separately or in the same processing step to define the actuating element 722.

When a voltage differential is applied between the electrodes 726/728, a stress is generated in the piezoelectric element 724, causing the actuating element 722 to deform on the membrane 720. This deformation changes the volume within the fluidic chamber 710 and ink droplets may be discharged from the nozzle 718 by driving the piezoelectric actuator 722 with an appropriate signal. The signal may be supplied from a controller (not shown), for example, as a voltage waveform. The controller may comprise a power amplifier or switching circuit connected to a computer running an application which generates signals in response to print data provided thereto e.g. uploaded thereto by a user.

Further material/layers (not shown) may also be provided in addition to the electrodes 726/728 and piezoelectric elements 724 as required.

A wiring layer comprising electrical connections is provided on the membrane 720, whereby the wiring layer may comprise two or more electrical tracks for example, to connect the upper electrode 728 and/or lower electrode 726 of the actuating element 722 to the controller, directly or via further drive circuitry.

The electrical tracks comprise a conductive material, e.g. copper (Cu), gold (Ag), platinum (Pt), iridium (Ir), aluminium (Al), titanium nitride (TiN). The electrical tracks may, for example, have a thickness of between 0.01 μm to 2 μm, and, in some embodiments, the thickness may be between 0.1 μm and 1 μm, and in further embodiments the thickness may be between 0.3 μm and 0.7 μm.

The wiring layer may comprise further materials (not shown), for example, a passivation material to protect the electrical tracks from the environment and from contacting the ink.

Additionally or alternatively, the passivation material may comprise a dielectric material provided to electrically insulate electrical tracks from each other e.g. when stacked atop one another or provided adjacent each other.

The passivation material may comprise any suitable material, for example: $SiO_2$, $Al_2O_3$ or $Si_3N_4$.

The wiring layer may further comprise adhesion electrical tracks, the passivation material, the electrodes 726/728 and/or the membrane 720.

The actuator component 701 may include further features not described herein. For example, a capping substrate (not shown) may be provided atop the fluidic chamber substrate 702, for example at the top surface, the membrane 720 and/or the wiring layer to cover the actuating element 722 and to further protect the actuating element 722. The capping substrate may further define fluidic channels for supplying ink to the fluidic inlet ports 713 e.g. from the lower manifold component 50 and for receiving ink from the fluidic outlet port 716.

It is again noted that the construction shown in FIGS. 13A and 13B is only an example of an actuator component that may be used within a droplet deposition head 10 described above. In other arrangements the actuator component might include arrays of chambers that are provided with any suitable type of actuating element. For instance, the actuator component could be of shared-wall design, with the actuating elements being walls comprising piezoelectric material that separate adjacent chambers within the array. Indeed, in some arrangements, the actuating elements could be electrostatic or thermal actuating elements.

Features of the droplet deposition head 10 described with respect to one example embodiment may be combined with other example droplet deposition heads described above.

For instance, as described above, each lower manifold component may provide fluidic connection to at least two arrays 150 from each of a group of arrays, or to only one array from each of a group of arrays.

In some examples, no provision may be made for returning fluid to the fluid supply system. Accordingly, the upper manifold component 100 and the lower manifold component 50 may only supply fluid along a branched inlet path 180 in one direction to the arrays; that is, there may be no fluid outlet ports 220(1), 220(2), 67(1), 67(2), no branched outlet path 280 or narrowing outlet chambers 60.

In some examples, any number of layers of the upper manifold component 100 or the lower manifold component 50 may be replaced or duplicated. For instance, in some examples, there is no filter 925.

Other examples and variations are contemplated within the scope of the appended claims.

It should be noted that the foregoing description is intended to provide a number of non-limiting examples that assist the skilled reader's understanding of the present invention and that demonstrate how the present invention may be implemented.

The invention claimed is:

1. A manifold component for a droplet deposition head, comprising:

a first end and a second end opposite to the first end, the manifold component extending from the first end to the second end to define an ejection direction and the manifold component comprising:

a plurality of layers, each of which extends substantially normal to the ejection direction, and at least one fluid inlet located at the first end of the manifold component, wherein:

the manifold component comprises, at the second end of the manifold component, a mount for receiving an actuator component, the actuator component provides at least one array of fluid chambers, each array of fluid chambers being provided with a respective actuating element and a respective nozzle, each actuating element being actuable to eject a droplet of fluid in the ejection direction through the corresponding one of the nozzles, each array extending in an array direction perpendicular to the ejection direction;

at least one widening inlet chamber is provided within the manifold component, a width of each widening inlet chamber in the array direction increasing with distance in the ejection direction from a first widening inlet chamber end to a second widening inlet chamber end, the first widening inlet chamber end being fluidically connected and configured to receive fluid from one or more of the fluid inlets, and the second widening inlet chamber end providing a fluid connection at the mount, so as to supply fluid to one or more of the arrays; and the plurality of layers comprise:

a first layer, which is formed from a first material, and a second layer, which is formed from a second material, the second material having a lower coefficient of thermal expansion than the first material.

2. The manifold component of claim 1, further comprising:

at least one fluid outlet located at the first end of the manifold component; and at least one narrowing outlet chamber provided within the manifold component, wherein:

the width of each narrowing outlet chamber in the array direction decreases with distance in the ejection direction from a first narrowing outlet chamber end to a second narrowing outlet chamber end, a first narrowing outlet chamber end providing a fluid connection at the mount and receiving fluid from one or more of the arrays, and a second narrowing outlet chamber end of each narrowing outlet chamber being fluidically connected and returning fluid to one of the fluid outlets.

3. The manifold component of claim 2, wherein the at least one narrowing outlet chamber is provided adjacent to an exterior surface of the manifold component, the exterior surface being configured to enable a driver IC to be mounted thereupon.

4. The manifold component of claim 3, wherein the plurality of layers comprise one or more mounting layers located at the second end of the manifold component and are formed from the second material, and the second material is a ceramic material.

5. The manifold component of claim 4, wherein the exterior surface is configured to enable the driver IC to be mounted in thermal contact with the one or more mounting layers.

6. The manifold component of claim 4, wherein a portion of each widening inlet chamber and each narrowing outlet chamber that are formed within the one or more mounting layers has a substantially constant width in the array direction.

7. The manifold component of claim 4, wherein:

the second layer is that one of the one or more mounting layers which is nearest to the first end of the manifold component; and the first layer is injection molded.

8. The manifold component of claim 2, wherein each widening inlet chamber and each narrowing outlet chamber is formed within two or more of the plurality of layers.

9. The manifold component of claim 8, wherein:

the second layer is disposed adjacent to the first layer and the first layer and the second layer each has a bonding side, which extends perpendicular to the ejection direction, and the first layer bonding side opposes the second layer bonding side;

one of the bonding sides has formed thereon a plurality of ridges;

another of the bonding sides has disposed thereon adhesive in a pattern corresponding to the plurality of ridges, the adhesive bonding together the bonding sides; and the plurality of ridges are formed on the one of the bonding sides that is the first layer bonding side.

10. The manifold component of claim 9, wherein:

the plurality of ridges are in contact with the other of the bonding sides; and the contact between the bonding sides is through the ridges.

11. The manifold component of claim 10, wherein:

each of the bonding sides has formed therein a respective aperture for each widening inlet chamber and each narrowing outlet chamber; and the ridges separately surround each of the apertures formed in the one of the bonding sides.

12. The manifold component of claim 9, wherein when viewed from the ejection direction, one or more of the ridges follow a boundary, at least in part, of each of the reduced-thickness regions.

13. The manifold component of claim 8, wherein:

a thickness, in the ejection direction, of a portion of the first layer adjacent the second layer decreases towards edges of the first layer to provide one or more reduced-thickness regions at the edges of the first layer;

one or more recesses are formed at the edges of the first layer, each recess separating, with respect to the ejection direction, a respective one of the reduced-thickness regions from another portion of the first layer; and the plurality of layers further comprise a third layer, which is disposed on the opposite side of the first layer to the second layer, and each recess separates, with respect to the ejection direction, a respective one of the reduced-thickness regions from a portion of the first layer adjacent a third layer.

14. The manifold component of claim 8, wherein:

a thickness, in the ejection direction, of a portion of the first layer adjacent the second layer decreases towards each end of the first layer with respect to the array direction to provide a respective reduced-thickness region at each end;

a recess is formed at each end of the first layer with respect to the array direction, each recess separating, with respect to the ejection direction, a respective one of the reduced-thickness regions from another portion of the first layer; and the plurality of layers further comprise a third layer, which is disposed on the opposite side of the first layer to the second layer, and each recess separates, with respect to the ejection direction, a respective one of the reduced-thickness regions from a portion of the first layer adjacent a third layer.

15. The manifold component of claim 8, wherein:

one or more voids are formed in the portion of the first layer adjacent to the second layer, each void being located in a corner of the first layer and extending into the first layer in the ejection direction; and each of the voids extends through the entirety of the portion of the first layer adjacent the second layer.

16. The manifold component of claim 1, wherein the layers are formed of polymeric material, the polymeric material is a filled with a filler that is a fibrous material.

17. The manifold component of claim 1, wherein any of the plurality of layers nearer to the second end than the second layer is formed of the second material.

18. The manifold component of claim 1, wherein the first material is a filled polymeric material with a filler that is a fibrous material, and the second material is a metal or an alloy.

19. An apparatus for routing fluids in an inkjet printer comprising:

a plurality of layers, each of which extends substantially normal to a first direction, the plurality of layers providing, in each of a plurality of planes parallel to the layers:

multiple curved fluid paths, and a plurality of fluid paths perpendicular to the layers that fluidically connect together curved paths in different planes, wherein:

the perpendicular paths and the curved paths provide two or more branched fluid paths within the manifold component, each of the branched paths comprising a main branch, branching at one or more branching points into two or more sub-branches and culminating in a plurality of end sub-branches; and each end sub-branch is fluidically connected to a fluid inlet of a manifold component according to claim 1.

20. An apparatus comprising:

a lower manifold component extending from a first end to a second end to define an ejection direction, the lower manifold component comprising:

a plurality of layers, each of which extends substantially normal to the ejection direction, and at least one fluid inlet located at the first end of the manifold component; and an upper manifold component comprising:

multiple curved fluid paths, and a plurality of fluid paths perpendicular to the layers that fluidically connect together curved paths in different planes, wherein:

the lower manifold component comprises, at the second end of the manifold component, a mount for receiving an actuator component that provides at least one array of fluid chambers, each array of fluid chambers being provided with a respective actuating element and a respective nozzle, each actuating element being actuable to eject a droplet of fluid in the ejection direction through the corresponding one of the nozzles, each array extending in an array direction perpendicular to the ejection direction;

at least one widening inlet chamber is provided within the manifold component, the width of each widening inlet chamber in the array direction increasing with distance in the ejection direction from a first widening inlet chamber end to a second widening inlet chamber end, the first widening inlet chamber end being fluidically connected and configured to receive fluid from one or more of the fluid inlets, and the second widening inlet chamber end providing a fluid connection at the mount, so as to supply fluid to one or more of the arrays;

the plurality of layers comprise:

a first layer, which is formed from a first material, and a second layer, which is formed from a second material, the second material having a lower coefficient of thermal expansion than the first material; and the perpendicular paths and the curved paths provide two or more branched fluid paths within the upper manifold component, each of the branched paths comprising a main branch branching at one or more branching points into two or more sub-branches and culminating in a plurality of end sub-branches; and each end sub-branch is fluidically connected to the fluid inlet of the lower manifold component.

* * * * *